US010850907B2

(12) United States Patent
Zhang et al.

(10) Patent No.: US 10,850,907 B2
(45) Date of Patent: Dec. 1, 2020

(54) AIR-FILLING PACKAGING APPARATUS

(71) Applicant: Shanghai Air-paq Composite Material Co., Ltd., Shanghai (CN)

(72) Inventors: Jiaying Zhang, Shanghai (CN); Zhiwei Wu, Shanghai (CN); Fei Xie, Shanghai (CN)

(73) Assignee: SHANGHAI AIR-PAQ COMPOSITE MATERIAL CO., LTD., Shanghai (CN)

( * ) Notice: Subject to any disclaimer, the term of this patent is extended or adjusted under 35 U.S.C. 154(b) by 49 days.

(21) Appl. No.: 15/737,740

(22) PCT Filed: Aug. 17, 2016

(86) PCT No.: PCT/CN2016/095671
§ 371 (c)(1),
(2) Date: May 27, 2018

(87) PCT Pub. No.: WO2016/202313
PCT Pub. Date: Dec. 22, 2016

(65) Prior Publication Data

US 2019/0144190 A1 May 16, 2019

(30) Foreign Application Priority Data

Jun. 17, 2015 (CN) ..... 2015 1 0336782
Aug. 28, 2015 (CN) ..... 2015 1 0540383
Aug. 28, 2015 (CN) ..... 2015 2 0661371 U
Aug. 28, 2015 (CN) ..... 2015 2 0661372 U
Sep. 29, 2015 (CN) ..... 2015 1 0632050
Sep. 29, 2015 (CN) ..... 2015 2 0768905 U
Dec. 4, 2015 (CN) ..... 2015 1 0884072
Dec. 4, 2015 (CN) ..... 2015 2 0998275 U
Dec. 4, 2015 (CN) ..... 2015 2 0998565 U

(51) Int. Cl.
*B65D 81/03* (2006.01)
*B65D 30/24* (2006.01)
*B65D 81/05* (2006.01)

(52) U.S. Cl.
CPC ..... *B65D 81/03* (2013.01); *B65D 31/14* (2013.01); *B65D 81/052* (2013.01)

(58) Field of Classification Search
CPC ..... B65D 81/03; B65D 31/14; B65D 81/052
USPC ..... 383/3; 206/522
See application file for complete search history.

(56) References Cited

U.S. PATENT DOCUMENTS 8,728,595 B1 * 5/2014 Liao ..... B65D 81/052 206/522
2003/0094394 A1 * 5/2003 Anderson ..... B32B 21/08 206/522
2003/0096068 A1 * 5/2003 Peper ..... B32B 21/08 428/34.1

(Continued)

*Primary Examiner* — Jes F Pascua
(74) *Attorney, Agent, or Firm* — Raymond Y. Chan; David and Raymond Patent Firm

(57) ABSTRACT

An air-filling packaging apparatus includes at least an air cushion body formed by at least two layers of air chamber films. The air cushion body includes multiple air-storing units. The air-storing units are heat-sealed to form a series of 2D heat-sealing seams, folded, and heat-sealed to form a series of 3D heat-sealing seams so as to make a 3D packaging bag for packaging an object to be packaged. The 3D packaging bag provides a cushioning function for the object to be packaged.

8 Claims, 41 Drawing Sheets

(56) References Cited

U.S. PATENT DOCUMENTS

| | | | | |
|---|---|---|---|---|
| 2004/0163991 | A1* | 8/2004 | Koyanagi | B65D 81/052 206/521 |
| 2005/0109656 | A1* | 5/2005 | Ishizaki | B65D 81/03 206/522 |
| 2005/0263205 | A1* | 12/2005 | Koyanagi | B31D 5/0073 141/10 |
| 2005/0263425 | A1* | 12/2005 | Tanaka | B65D 81/052 206/522 |
| 2006/0032779 | A1* | 2/2006 | Tanaka | B65D 81/052 206/522 |
| 2009/0188830 | A1* | 7/2009 | Liao | B65D 81/052 206/522 |
| 2009/0242450 | A1* | 10/2009 | Zhang | B65D 81/03 206/522 |
| 2013/0048529 | A1* | 2/2013 | Liao | B65D 31/00 206/522 |
| 2013/0168286 | A1* | 7/2013 | Liao | B65D 81/052 206/522 |
| 2014/0205208 | A1* | 7/2014 | Liao | B65D 33/00 383/3 |
| 2014/0262914 | A1* | 9/2014 | Liao | B65D 81/022 206/522 |
| 2015/0259120 | A1* | 9/2015 | Liao | B65D 81/03 220/732 |
| 2018/0093809 | A1* | 4/2018 | Zhang | B65D 23/08 |
| 2018/0127152 | A1* | 5/2018 | Zhang | B65D 25/04 |

* cited by examiner

A-A

图16

AIR-FILLING PACKAGING APPARATUS

CROSS-REFERENCE TO RELATED APPLICATIONS

This is a non-provisional application that claims the benefit of priority under 35U.S.C. § 371 to international application number PCT/CN2016/095671, international filing date Aug. 17, 2016, wherein the entire contents of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an air-filling packaging apparatus, and more particularly to an air-filling packaging apparatus that has a cushioning function.

Description of Related Arts

With the change of modern lifestyles and the rapid development of logistics industry, numerous goods, such as electronic products, chemical products, medical products, ceramics, glass, and other daily necessities, are traded through logistics. Nevertheless, serious loss can happen when these goods are damaged or distorted due to incidents like squeezing, collision, dropping, etc., which are sometimes inevitable during the storing or transportation processes.

In order to protect the goods, people utilize packaging box or the like to package the products before storing or transportation, which provides a certain cushioning function for the products so as to protect them. Currently, common packaging to boxes include paper packaging boxes and air packaging bags. A Conventional paper packaging box cannot offer an ideal cushioning function to serve as a good protection. As a result, it usually requires the products being packaged by foams or soft plastics for several layers before putting into the packaging box in order to provide a good anti-collision quality. Unfortunately, this will definitely increase its transportation cost, make packaging process harder, waste time, decrease working efficiency, and raise labor cost, which has failed to meet the demands of modern transportation industry.

On the other hand, air packaging substances provide the cushioning function by filling air into films, which can be inflated and utilized right on the packaging site. Therefore, contrasting to conventional packaging solutions, air packaging materials have the advantages of lower transportation cost, easier storing, better cushioning performance, and more environmental friendly. Conventional air packaging bags usually include a plurality of air side walls formed of bent air-storing columns. The air side walls surround to form an internal accommodation for storing an object. A few common examples thereof include a U-shaped bag, a C-shaped bag, an O-shaped bag, and etc. Unfortunately, the single cushion structure of such conventional packaging bags or the arrangement of the air cushion fits on and around the object still cannot provide a satisfied cushioning function in some situations that require a relatively higher anti-collision performance.

SUMMARY OF THE PRESENT INVENTION

An object of the present invention is to provide an air-filling packaging apparatus that provides a cushioning function in a multistage manner, so as to provide a reinforced cushion protection for an object packaged in the air-filling packaging apparatus and to prevent the object from being damaged when being impacted or shocked.

Another object of the present invention is to provide an air-filling packaging apparatus, which, according to some embodiments, has a cavity formed by surrounding a plurality of air-storing side walls formed by a plurality of air-storing units, wherein the air-filling packaging apparatus further comprises an inner bag portion adapted for being arranged in the cavity so as to form an accommodating chamber for accommodating the object, wherein the air-storing side walls that formed the accommodating chamber forms an outer bag portion, wherein the outer bag portion and the inner bag portion provide cushioning function in a multistage cushioning manner for the object.

Another object of the present invention is to provide an air-filling packaging apparatus, wherein the inner bag portion can be affixed in the uninflated outer bag portion beforehand or be tucked into the outer bag portion to form a inner bag after the object was packaged therein, such that the inflated outer bag portion can provide a level of cushion and the inner bag portion can provide another level of cushion, such that the impact or shock borne by the outer bag portion will not pass onto the object directly, which means the cushioning function is reinforced.

Another object of the present invention is to provide an air-filling packaging apparatus, wherein after the outer bag portion is inflated, the inner bag portion will be attached on the inner side of the outer bag portion or be suspended in the outer bag portion, wherein if the inner bag portion is suspended, there will be a buffer gap between the inner bag portion and the outer bag portion, such that the object will also be suspendedly accommodated in the outer bag portion, which will not be affected by external shock or impact easily.

Another object of the present invention is to provide an air-filling packaging apparatus, wherein the inner bag portion and the outer bag portion are connected or integrally formed, wherein the inner bag portion may comprise air-storing units of small diameter air chambers so as to provide air cushioning function on the inner side or be a non-inflating portion so as to provide packaging and cushioning function with a non-inflated inner bag.

Another object of the present invention is to provide an air-filling packaging apparatus, wherein according to an embodiment, two air-storing side walls of the air-storing side walls that formed the cavity are inclinedly arranged, such that the object will not directly attach the two sides of the air-storing side walls, such that the front and rear side walls and the air-storing side walls of the two sides of the air-storing side walls that formed the cavity can provide different cushioning functions.

Another object of the present invention is to provide an air-filling packaging apparatus, wherein the lengths of the front and rear side walls of the air-storing side walls that formed the cavity are different, such that the cross section thereof is approximately in a trapezoidal shape. As a result, there will be a buffer space between the object and the two sides of the air-storing side wall, such that the two sides of the air-storing side wall can provide a first cushioning function and the arrangement of the buffer space can provide a second cushioning function. Hence, when the two sides of the air-storing side wall are impacted or collided, the impact force will not be directly transferred to the object, which means a reinforced cushioning function can be provided.

Another object of the present invention is to provide an air-filling packaging apparatus, wherein according to an embodiment, the secondary heat-sealing seam for heat-sealing a plurality of air-storing units to form a 3D packaging bag is arranged between two of the adjacent air-storing units on the bottom side, such that one or more of the air-storing units in the bottommost can form the reinforcing cushion unit on the bottom portion of the 3D packaging bag. Therefore, on the bottom side of the 3D packaging bag, the air-storing units that formed the cavity can provide a level of cushioning function and the reinforcing cushion unit can provide another level of cushioning function, so as to achieve multistage cushioning.

Another object of the present invention is to provide an air-filling packaging apparatus, wherein according to an embodiment, the 3D packaging bag formed by a plurality of the air-storing units comprises a main bag body and a flank cushion portion on at least a side of the main bag body, wherein the main bag body and the flank cushion portion are respectively formed by different parts of the air-storing units, such that the main bag body can provide a level of cushioning function, while the flank cushion portion can provide another level of cushioning function, which can therefore enhance the side cushioning performance of the air-filling packaging apparatus.

Another object of the present invention is to provide an air-filling packaging apparatus that provides a sloping cushion portion to thicken the cushion, so as to provide a reinforced cushion protection for a object packaged in the air-filling packaging apparatus and to prevent the object from being damaged when being impacted or shocked.

Another object of the present invention is to provide an air-filling packaging apparatus, which, according to some embodiments, comprises a sloping cushion portion formed by a plurality of air-storing side walls formed by a plurality of air-storing units, wherein the air-storing side walls and the sloping cushion portion can provide a reinforced cushioning function for the object to be packaged.

Another object of the present invention is to provide an air-filling packaging apparatus, wherein the lengths of the front and rear side walls of the air-storing side walls that formed the cavity are different, so as to form the sloping cushion portion between the two side walls thereof. As a result, there will be a buffer space between the object and the sloping cushion portion, such that the sloping cushion portion thickens the cushion. Hence when the air-storing unit of the sloping cushion portion is impacted or collided, the external impact force will not be directly transferred to the content, which means a reinforced cushioning function can be provided.

Another object of the present invention is to provide an air-filling packaging apparatus, wherein according to an embodiment, the 3D (three-dimensional) heat-sealing seam for heat-sealing a plurality of air-storing units to form a 3D packaging bag makes the air-filling packaging apparatus comprise a ringlike side wall formed by a plurality of air-storing units and a bottom reinforced sloping cushion portion to thicken the cushion on the bottom side of the 3D packaging bag for providing the cushioning function.

Another object of the present invention is to provide an air-filling packaging apparatus, wherein according to an embodiment, the 3D packaging bag formed by a plurality of the air-storing units comprises a main bag body and a flank cushion portion on at least a side of the main bag body, wherein the main bag body and the flank cushion portion are formed by a plurality of sub-air-storing units of the air-storing units, such that the main bag body can provide a level of cushioning function, while the flank cushion portion can provide another level of cushioning function, which can therefore enhance a side cushioning performance of the air-filling packaging apparatus.

An object of the present invention is to provide an air-filling packaging apparatus, which can completely accommodate the object and provide good cushioning function in multiple directions.

Another object of the present invention is to provide an air-filling packaging apparatus, comprising a main accommodating portion and a lid portion, wherein the lid portion can close an opening of the main accommodating portion after the air-filling packaging apparatus has accommodated the object in an accommodating chamber, such that the object can provide a cushioning protection in multiple directions.

Another object of the present invention is to provide an air-filling packaging apparatus, comprising a main accommodating portion and a subsidiary portion, wherein the subsidiary portion can reinforce the cushioning function of the main accommodating portion so as to provide a good cushioning function for the object on a side.

Another object of the present invention is to provide an air-filling packaging apparatus, comprising a subsidiary portion, which is able to not only provide the object on a side, but also accommodate the accessory of the object, so as to independently provide a buffer gap for the accessory of the object.

Another object of the present invention is to provide an air-filling packaging apparatus, which provides an accessory chamber, wherein the air-filling packaging apparatus is suitable for an object with an accessory, wherein the accessory chamber provides accommodation and buffer space for the accessory of the object, so as to avoid the main body of the object and its accessory from colliding with each other and damaging the object during transportation.

Another object of the present invention is to provide an air-filling packaging apparatus, which, according to some embodiments, comprises a cavity formed by surrounding a plurality of air-storing side walls formed by a plurality of air-storing units, wherein the air-filling packaging apparatus further comprises an accessory chamber for providing cushioning function for the accessory of the object.

Another object of the present invention is to provide an air-filling packaging apparatus, wherein according to an embodiment, the 3D packaging bag formed by a plurality of the air-storing units comprises a main accommodating portion, an accessory accommodating portion, and a flank cushion portion on at least a side of the main accommodating portion, wherein the main accommodating portion and the flank cushion portion are formed by different parts of the air-storing units, such that the main accommodating portion can provide a level of cushioning function, while the flank cushion portion can provide another level of cushioning function, which can therefore enhance the side cushioning performance of the air-filling packaging apparatus.

According to the following description, other advantages and features of the present invention can be revealed and they can be achieved through the means and combinations specified in the appended claims.

According to the present invention, the above and other objects and advantages can be achieved through an air-filling packaging apparatus for packaging a object, the air-filling packaging apparatus comprises at least an air cushion body formed by at least two layers of air chamber films, wherein the air cushion body comprises a plurality of air-storing units, wherein the air-storing units are heat-sealed to form a series of 2D heat-sealing seams, folded, and then heat-sealed to form a series of 3D heat-sealing seams so as to make a 3D packaging bag for packaging the object, wherein the 3D packaging bag provides a cushioning function for the object.

According to an embodiment of the present invention, the air-filling packaging apparatus further comprises at least an inflation valve formed by at least two layers of valve films, wherein the inflation valve is adapted for inflating the air-storing units and self-sealing after the inflation so as to prevent air leakage, wherein the 3D packaging bag provides cushioning function in a multistage manner for the object.

According to an embodiment of the present invention, the air-storing units are arranged side-by-side and surround around so as to form the 3D packaging bag, wherein part of the air-storing units form an inner bag portion, while another part of the air-storing units form an outer bag portion, wherein the inner bag portion is adapted for being arranged on the outer bag portion, such that the inner bag portion and the outer bag portion provide the cushioning function in a multistage manner.

According to an embodiment of the present invention, the inner bag portion and the outer bag portion are independent to each other and heat-sealingly connected or the inner bag portion and the outer bag portion are integrally formed.

According to an embodiment of the present invention, the inner bag portion is adapted for being tucked into the outer bag portion, wherein when the outer bag portion is inflated, the inner bag portion will be attached with the inner surface of the outer bag portion or the inner bag portion is suspendedly arranged in the outer bag portion.

According to an embodiment of the present invention, the inner bag portion is heat-sealedly affixed in the outer bag portion.

According to an embodiment of the present invention, the inner bag portion is uninflatable, while the outer bag portion is inflatable.

According to an embodiment of the present invention, the air cushion body comprises a main channel arranged thereon, wherein the inflation valve comprises a plurality of air inlet channels formed thereon providing air inlet to each the air-storing unit, wherein part of the air-storing units heat-sealingly close the air inlet channel or the main channel through at least a row of choke seam to form the uninflatable air-storing unit for making the inner bag portion, while another part of the air-storing units form the outer bag portion.

According to an embodiment of the present invention, the inner bag portion is formed by one, two or more layers of films of the air chamber films or the valve films.

According to an embodiment of the present invention, the air-filling packaging apparatus further comprises a plurality of air resisting seam arranged thereon, wherein part of the air-storing units have the air resisting seam heat-sealed thereon so as to have smaller air storage and to form the inner bag portion, wherein the air storage of the inner bag portion is smaller than the air storage of the outer bag portion.

According to an embodiment of the present invention, the inner bag portion is inflatable, while the outer bag portion is uninflatable.

According to an embodiment of the present invention, the air-storing units are circularly arranged, the left and right ends thereof are heat-sealingly connected through at least a longitudinal heat-sealing seam, and the top side and the bottom side thereof are respectively heat-sealed through at least a transverse heat-sealing seam so as to connect the front side and back side of the inner bag portion and the outer bag portion and to prevent the inflation inlet of the main channel from being sealed off.

According to an embodiment of the present invention, the air-filling packaging apparatus further comprises at least two stopping seams respectively arranged on the two sides of the inner bag portion so as for limiting the object between the stopping seams and keeping the object a distance from the outer bag portion.

According to an embodiment of the present invention, each the stopping seam are inclinedly or longitudinally extended.

According to an embodiment of the present invention, the transverse heat-sealing seam on the bottom side is arranged between the two adjacent air-storing units on the bottom side so as to turn one or more of the air-storing units on the outer side of the transverse heat-sealing seam into one or more reinforcing cushion unit of the 3D packaging bag.

According to an embodiment of the present invention, a plurality of the air-storing units are bent to form a plurality of side walls, wherein the left and right side walls of the 3D packaging bag are inclinedly arranged so as to reinforce the side cushioning performance of the 3D packaging bag.

According to an embodiment of the present invention, the air-storing units are arranged side-by-side and surround around so as to form the 3D packaging bag, wherein a plurality of the air-storing units are bent to form a plurality of side walls, wherein the left and right side walls of the 3D packaging bag are inclinedly arranged so as to reinforce the side cushioning performance of the 3D packaging bag.

According to an embodiment of the present invention, the air-storing units are circularly arranged, the left and right ends thereof are heat-sealingly connected through at least a longitudinal heat-sealing seam, and the bottom side thereof is heat-sealed through at least a transverse heat-sealing seam so as to connect the front side and back side thereof and to prevent the inflation inlet of the main channel from being sealed off.

According to an embodiment of the present invention, the side walls comprise a left front side wall and a right front side wall on the two sides of the longitudinal heat-sealing seam, the left and right side walls, and a rear side wall, wherein the length of a full front side wall formed by the left front side wall and the right front side wall is shorter than the length of the rear side wall, such that the left and right side walls are respectively inclinedly extended between the front side wall and the rear side wall.

According to an embodiment of the present invention, the transverse heat-sealing seam on the bottom side is arranged between the two adjacent air-storing units on the bottom side so as to turn one or more of the air-storing units on the outer side of the transverse heat-sealing seam into one or more reinforcing cushion unit of the 3D packaging bag.

According to an embodiment of the present invention, the air-storing units are arranged side-by-side and surround around so as to form the 3D packaging bag, wherein the air-storing units are turned into a plurality of interconnected sub-air-storing units through the heat-sealing of a plurality of bending seams, wherein part of the sub-air-storing units form an packaging body for packaging the object, while another part of the sub-air-storing units form at least a flank cushion portion on the outer side of the packaging body, such that the flank cushion portion and the packaging body provide cushioning effect in a multistage manner for the object.

According to an embodiment of the present invention, the air-filling packaging apparatus further comprises two section sealing seams formed by heat-sealingly connecting at least four layers of the air chamber films, wherein the packaging body is formed between two the section sealing seams, wherein the flank cushion portions are formed on the outer sides of two section sealing seams each.

According to an embodiment of the present invention, each air-storing unit comprises one, two, three, four, or more of the sub-air-storing units at the portion that the flank cushion portion is correspondingly formed.

According to an embodiment of the present invention, the sub-air-storing units of the flank cushion portions are circularly arranged in the shape selected from the group consisting of circle, triangle, and polygon.

According to an embodiment of the present invention, the air-filling packaging apparatus further comprises a buffer gap defined by the sub-air-storing units of the flank cushion portions in the inner side thereof for packaging accessories of the object.

According to an embodiment of the present invention, each flank cushion portion comprises a cushion base formed by the sub-air-storing units thereof and two cushion waists respectively extended from the cushion base, wherein the cushion base and the cushion waists are arranged in a manner that the cross section of the flank cushion portion is triangular.

According to an embodiment of the present invention, the air cushion body comprises a main channel arranged thereon, wherein the inflation valve comprises a plurality of air inlet channels formed thereon providing air inlet to each air-storing unit, wherein the air-storing units are circularly arranged, the left and right ends thereof are heat-sealingly connected through at least a longitudinal heat-sealing seam, and the bottom side thereof is heat-sealed through at least a transverse heat-sealing seam so as to connect the front side and back side thereof, wherein the main channel has an inflation inlet arranged at the top side or bottom side of the 3D packaging bag, such that when the inflation inlet is at the bottom side, the heat-sealing of the transverse heat-sealing seam prevents the inflation inlet of the main channel from being sealed off.

According to an embodiment of the present invention, the packaging body further comprises a plurality of the bending seams heat-sealingly connecting two layers of the air chamber films on the side adjacent to the flank cushion portion so as to respectively turn the left and right side walls of the packaging body into a plurality of sub-side walls.

According to an embodiment of the present invention, part of the air-storing units form an inner bag portion, while another part of the air-storing units form an outer bag portion, wherein the outer bag portion comprises the packaging body and the flank cushion portion, wherein the inner bag portion is adapted for being arranged on the outer bag portion, such that the inner bag portion and the outer bag portion provide the cushioning function in a multistage manner.

According to an embodiment of the present invention, the air-filling packaging apparatus further comprises at least an inflation valve formed by at least two layers of valve films, wherein the inflation valve is adapted for inflating the air-storing units and self-sealing after the inflation so as to prevent air leakage, wherein the 3D packaging bag comprises at least a sloping cushion portion to thicken the cushion and to provide cushioning function for the object.

According to an embodiment of the present invention, the air-storing units are respectively longitudinally arranged and divided into a plurality of sub-air-storing units, wherein part of the sub-air-storing units form a plurality of side walls, while another part of the sub-air-storing units form a sloping cushion portion, wherein the sloping cushion portion is arranged between two of the side walls of a plurality of the side walls in a sloping manner, so as to reinforce the cushioning performance of the 3D packaging bag.

According to an embodiment of the present invention, the air-filling packaging apparatus further comprises a series of dividing seams among the air-storing units, wherein the 3D heat-sealing seam is on the dividing seam on the air-storing units of the two sides of the 3D packaging bag, wherein the air-storing units are bent along the bending seam and heat-sealed through the 3D heat-sealing seam to form the sloping cushion portion.

According to an embodiment of the present invention, a plurality of the side walls comprise a front side wall and a rear side wall on the two sides of the bending seam, wherein the lengths of the front side wall and the rear side wall are different, wherein the sloping cushion portion is extended between the front side wall and the rear side wall, so as to reinforce the cushioning performance of the 3D packaging bag.

According to an embodiment of the present invention, the 3D heat-sealing seam is arranged between two adjacent air-storing units of the two sides of the air-filling packaging apparatus, wherein the air-storing units are bend through the bending seam and heat-sealed through the 3D heat-sealing seam to form the sloping cushion portion.

According to an embodiment of the present invention, the air-storing units are arranged longitudinally and transversely surround around so as to form the 3D packaging bag, wherein the air-storing units are turned into a plurality of interconnected sub-air-storing units through the heat-sealing of a plurality of bending seams, wherein part of the air-storing units form an packaging body for packaging the object, while another part of the air-storing units form at least a flank cushion portion on the outer side of the packaging body through the heat-sealing of the 3D heat-sealing seam, so as to reinforce the cushioning performance of the 3D packaging bag.

According to an embodiment of the present invention, each the air-storing unit comprises one, two, three, or more of the sub-air-storing units at the portion that the flank cushion portion is correspondingly formed.

According to an embodiment of the present invention, the bending seam comprises four intermittently heat-sealed bending seams, wherein the 3D packaging bag comprises two sloping cushion portions and a plurality of side walls formed through the bending seam and the heat-sealing seam thereon, wherein a plurality of the side walls comprise two front side walls and a rear side wall on the two sides of the sloping cushion portion, wherein the 3D packaging bag further comprises an opening formed between the two front side walls for picking and placing the object, wherein the two sloping cushion portion is respectively extended between each the front side wall and the rear side wall, so as to respectively reinforce the cushioning performance of the 3D packaging bag.

According to an embodiment of the present invention, the heat-sealing seam further comprises a longitudinal end sealing seam heat-sealingly connecting the head and tail of the front side wall and the rear side wall along the longitudinal direction, so as to form a ringlike side wall of the 3D packaging bag for packaging the object, wherein the sloping cushion portion is turned into a bottom reinforced sloping cushion portion through the end sealing seam, so as to thicken the cushion and provide cushioning function.

According to another aspect of the present invention, the present invention provides an air-filling packaging apparatus for packaging a object, which comprises at least an air cushion body formed by at least two layers of air chamber films and at least an inflation valve formed by at least two layers of valve films, wherein the air cushion body comprises a plurality of air-storing units, wherein the inflation valve is for inflating the air-storing units and self-sealing after the inflation so as to prevent air leakage, wherein air-storing units form a 3D packaging bag through heat-sealing of a series of heat-sealing seam and bending, wherein the heat-sealing seam comprises at least a bending seam that heat-sealingly connects the two air chamber films to divide the air-storing units into a plurality of interconnected sub-air-storing units, wherein the bending seam comprises a front bending seam and a rear bending seam, wherein when the air cushion body is bent along the front bending seam and the rear bending seam, the front bending seam and the rear bending seam are spacingly and alternately arranged so as to turn the sub-air-storing units between the front bending seam and the rear bending seam into at least a sloping cushion portion of the 3D packaging bag.

According to an embodiment of the present invention, the heat-sealing seam comprises one the bending seam, wherein the front bending seam and the rear bending seam divide inflated the air cushion body into a front side wall, a rear side wall, and the sloping cushion portion extended inclinedly from the front side wall and the rear side wall, wherein the air-filling packaging apparatus further comprises an opening formed between the front side wall and the rear side wall for picking and placing the object.

According to an embodiment of the present invention, the heat-sealing seam comprises two the bending seam, wherein the front bending seams and the rear bending seams divide the air cushion body into two front side wall, a rear side wall, and two sloping cushion portion extended inclinedly from the two front side wall and the rear side wall, wherein the air-filling packaging apparatus further comprises an opening formed between the two front side wall for picking and placing the object.

According to an embodiment of the present invention, the heat-sealing seam further comprises two 3D heat-sealing seams respectively arranged on the left and right sides of the air cushion body, wherein each the 3D heat-sealing seam heat-sealingly connects the front and rear side walls, wherein the 3D heat-sealing seams keep different distances from the front and rear bending seams.

According to an embodiment of the present invention, each 3D heat-sealing seam is further arranged between two adjacent the air-storing units of the two sides of the air cushion body, so as to respectively form a flank cushion portion on the outermost air-storing units of the left and right sides.

According to an embodiment of the present invention, the air-filling packaging apparatus further comprises an accommodating chamber formed between the front and rear side walls for packaging the object and a buffer gap formed between the sloping cushion portion and the rear side wall for providing deformation space for the sloping cushion portion.

According to an embodiment of the present invention, the front and rear side walls are surroundingly arranged and connected so as to respectively form a ringlike outer wall and a ringlike inner wall.

According to an embodiment of the present invention, the air-filling packaging apparatus further comprises at least an inflation valve formed by at least two layers of valve films, wherein the inflation valve is adapted for inflating the air-storing units and self-sealing after the inflation so as to prevent air leakage, wherein the 3D packaging bag comprises a main accommodating portion and a subsidiary portion attached on the main accommodating portion, such that the air-filling packaging apparatus provides cushioning function for the object in all directions.

According to an embodiment of the present invention, the 3D packaging bag further comprises a lid portion connected with the main accommodating portion and a series dividing seam between adjacent the air-storing units, wherein each of the air-storing units is turned into a plurality of sub-air-storing units through a plurality of bending seams, wherein the sub-air-storing units respectively form the main accommodating portion, the lid portion, and the subsidiary portion.

According to an embodiment of the present invention, the sub-air-storing units are surroundingly arranged to form a plurality of side walls, wherein after being heat-sealed with the 3D heat-sealing seam, part of the side walls form the main accommodating portion, part of the side walls form the lid portion, and another part of the side walls form the subsidiary portion.

According to an embodiment of the present invention, the main accommodating portion comprises an opening and a bottom portion, wherein the lid portion is connected on the side of the opening of the main accommodating portion, while the subsidiary portion is connected on the side of the bottom portion of the main accommodating portion.

According to an embodiment of the present invention, the lid portion comprises a connecting portion connected with the main accommodating portion, a cushion portion connected with the connecting portion, and an extremity connected with the cushion portion, wherein the cushion portion has a cushion cavity, wherein the extremity and the connecting portion are adapted for closing the opening of the main accommodating portion.

According to an embodiment of the present invention, part of the sub-air-storing units of the air-storing units are bent through the bending seam and heat-sealed through a main accessory 3D heat-sealing seam between two the bending seams so as to form the cushion portion.

According to an embodiment of the present invention, the subsidiary portion comprises three, four, five, or more side walls each formed by surroundingly arranging a plurality of the sub-air-storing units.

According to an embodiment of the present invention, the subsidiary portion further comprises one or more connecting portion integrally connecting the main accommodating portion and the accessory accommodating portion.

According to an embodiment of the present invention, the 3D heat-sealing seam further comprises a chamber 3D heat-sealing seam heat-sealing and dividing the main accommodating portion into two or more sub-accommodating portions.

According to an embodiment of the present invention, the 3D heat-sealing seam further comprises a first main accessory 3D heat-sealing seam dividing the main accommodating portion from the subsidiary portion and a second main accessory 3D heat-sealing seam dividing the main accommodating portion from the lid portion.

According to an embodiment of the present invention, part of the sub-air-storing units of the main accommodating portion form at least a flank cushion portion on the outer side of the main accommodating portion through the heat-sealing of the 3D heat-sealing seam.

According to an embodiment of the present invention, the flank cushion portion comprises one, two, three, or more of the sub-air-storing units.

According to an embodiment of the present invention, the diameters of the air-storing units of the main accommodating portion/subsidiary portion/lid portion are selectively different or identical.

According to an embodiment of the present invention, the sub-air-storing units of the main accommodating portion and the subsidiary portion further comprise a plurality of branch air-storing units formed through a sub-dividing seam, wherein the diameter of the branch air-storing unit is smaller than the diameter of the sub-air-storing unit of the subsidiary portion and the main accommodating portion.

According to an embodiment of the present invention, the sub-air-storing units of the main accommodating portion and the lid portion further comprise a plurality of branch air-storing units formed through a sub-dividing seam, wherein the diameter of the branch air-storing unit is smaller than the diameter of the sub-air-storing unit of the lid portion and the main accommodating portion.

According to an embodiment of the present invention, the sub-air-storing units of the lid portion and the subsidiary portion further comprise a plurality of branch air-storing units formed through a sub-dividing seam, wherein the diameter of the branch air-storing unit is smaller than the diameter of the sub-air-storing unit of the subsidiary portion and the lid portion.

According to an embodiment of the present invention, the air cushion body is formed by heat-sealing and folding an air chamber layer and a second air chamber layer, wherein the air cushion body comprises an inflation inlet and a main channel thereon, wherein each the inflation unit comprises an inflation valve thereon, such that air enters the main channel from the inflation inlet and then enters each the inflation unit via the inflation valve.

According to an embodiment of the present invention, the inflation valve comprises two valve films respectively heat-sealed with the first air chamber layer and the second air chamber layer of the air cushion body, so as to form an air inlet channel between the two valve films, such that after the air-storing units are inflated through the air inlet channel, the inner surfaces of the two valve films will attached with each other automatically, so as to prevent the air that entered the air-storing units from leaking via the air inlet channel.

According to an embodiment of the present invention, the inflation valve is a self-adhesive film check valve comprising two or more layers of valve films, which, for example, comprise a first valve film, a second valve film, a check sealing film, and etc.

According to an embodiment of the present invention, the air-filling packaging apparatus further comprises at least an inflation valve formed by at least two layers of valve films, wherein the inflation valve is adapted for inflating the air-storing units and self-sealing after the inflation so as to prevent air leakage, wherein the 3D 3D packaging bag comprises a main accommodating portion and at least an accessory accommodating portion so as to provide a main accommodating chamber and an accessory chamber, wherein the main accommodating chamber is for packaging the object, while the accessory chamber is for packaging accessories of the object and providing cushioning function.

According to an embodiment of the present invention, the air-storing units are longitudinally arranged and divided into a plurality of sub-air-storing units, wherein part of the sub-air-storing units form a main accommodating portion, while another part of the sub-air-storing units form the accessory accommodating portion.

According to an embodiment of the present invention, the air-filling packaging apparatus further comprises a series dividing seam among the air-storing units, wherein the 3D heat-sealing seam comprises a main 3D heat-sealing seam on a dividing seam of the air-storing units of the two sides of the 3D packaging bag, wherein the air-storing units are bend along the bending seam and heat-sealed through the main 3D heat-sealing seam to form the main accommodating portion.

According to an embodiment of the present invention, the 3D heat-sealing seam further comprises a main accessory 3D heat-sealing seam dividing the main accommodating portion from the accessory accommodating portion.

According to an embodiment of the present invention, the air-filling packaging apparatus further comprises one or more connecting portion integrally connecting the main accommodating portion and the accessory accommodating portion, wherein the connecting portion is formed on the two sides of the main accessory 3D heat-sealing seam.

According to an embodiment of the present invention, the accessory accommodating portion comprises three, four, five, or more side walls each formed by surroundingly arranging a plurality of the sub-air-storing units.

According to an embodiment of the present invention, part of the sub-air-storing units of the main accommodating portion form at least a flank cushion portion on the outer side of the main accommodating portion through the heat-sealing of the 3D heat-sealing seam.

According to an embodiment of the present invention, the flank cushion portion comprises one, two, three, or more of the sub-air-storing units.

According to an embodiment of the present invention, the diameters of the air-storing units of the air-filling packaging apparatus are selectively different or identical.

According to an embodiment of the present invention, the sub-air-storing units of main accommodating portion and the accessory accommodating portion further comprise a plurality of branch air-storing units formed through a sub-dividing seam, wherein the diameter of the branch air-storing unit is smaller than the diameter of the sub-air-storing unit of the accessory accommodating portion and the main accommodating portion.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
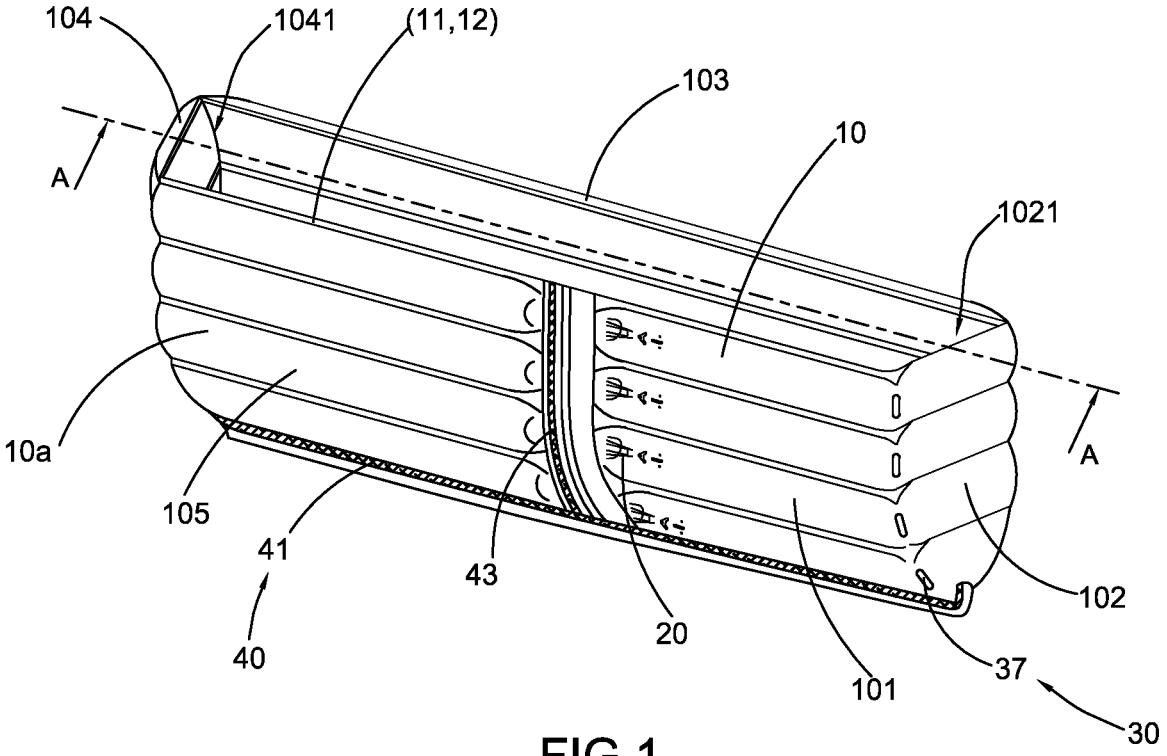
FIG. 1 is a 3D perspective view of the air-filling packaging apparatus according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

FIG. 1-6 illustrate the air-filling packaging apparatus according to a first preferred embodiment of the present invention, which has an inflatable structure so as to be inflated to provide an air cushioning function for various packaged objects, such as electronic products, food, medical products, chemical products, biological materials, plastics and ceramics, and fast moving consumer goods. The air-filling packaging apparatus can be easily stored and transported in a non-inflated state before use, while it can then be inflated on site, which is convenient to use.

According to this preferred embodiment of the present invention, the air-filling packaging apparatus can be embodied as an air cushion material which is filled with air for example. Nevertheless, person skilled in the art should be able to understand that it can also be filled with other gas based on the application and needs. According to this preferred embodiment, it can form a 3D packaging bag after being inflated, so as to provide air cushioning function for an object.

According to the this preferred embodiment, the air-filling packaging apparatus comprises at least an air cushion body 10. Namely, either one of the air cushion body 10 forms a 3D packaging bag or a plurality of the air cushion bodies 10 form the 3D packaging bag through heat-sealing connecting, such as adhesive bonding, heat-sealing, and etc. The embodiment illustrated in FIGS. 1-6 is formed by one air cushion body 10. More specifically, referring to FIG. 71A, the air cushion body 10 comprises at least two air chamber films 11 and 12 forming the 3D packaging bag comprising one or more interconnected air-storing units 13 through a series of 2D heat-sealing seams 30 and 3D heat-sealing seams 40, wherein each the air-storing unit 13 forms a air storage chamber 14 that is able to store gas therein.

Figure 5:
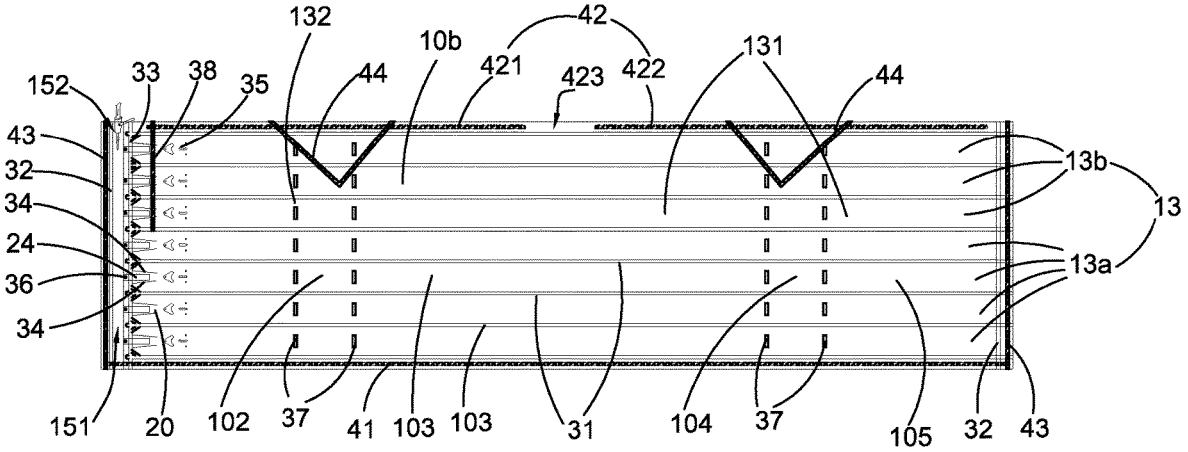
FIG. 5 is a perspective view illustrating the uninflated air-filling packaging apparatus being expanded in a plane manner according to the above first preferred embodiment of the present invention.

Person skilled in the art should be able to understand that the 2D heat-sealing seams 30 are for sealing multiple films into a 2D cushion material, as is illustrated in FIG. 5, through heat-sealing. The 3D heat-sealing seams 40 are additional heat-sealing on the above 2D cushion material to turn the air-filling packaging apparatus into a 3D packaging device that has a 3D structure and can accommodate the object, as FIG. 1 illustrates. The 2D heat-sealing seams 30 and the 3D heat-sealing seams 40 can connect multiple layers of films together through adhesive bonding, heat-sealingly connection, and etc. Preferably, according to this embodiment, the 2D heat-sealing seams 30 and the 3D heat-sealing seams 40 are both formed through heat-sealing technology.

More specifically, the 2D heat-sealing seams 30 comprise a plurality of dividing seams 31 dividing the two air chamber films 11 and 12 into a plurality of the air-storing units 13. Preferably, each row of the dividing seams 31 is formed by heat-sealing technology that heat-sealingly connects two layers of the air chamber films 11 and 12 so as to form a row of the dividing seam 31 between two adjacent air-storing units 13. Each of the dividing seams 31 may be a continuous heat-sealed line so as to allow a plurality of the air-storing units 13 to be independent to one another. It is understandable that the dividing seam 31 on the top side and the bottom side can respectively become a top side boundary seam and a bottom side boundary seam of the air cushion body 10, as FIG. 5 illustrates. The dividing seam 31 may also be an intermittent heat-sealed line so as to have a plurality of the air-storing units 13 be interconnected. The air-storing unit 13 can be in various shapes, such as linear, circular, polygon, irregular, and etc. Referring to FIGS. 1-6, the air cushion body 10 according to the present invention may comprise a plurality of air-storing pillars abreast arranged, but the present invention shall not be limited thereto.

Figure 71A:
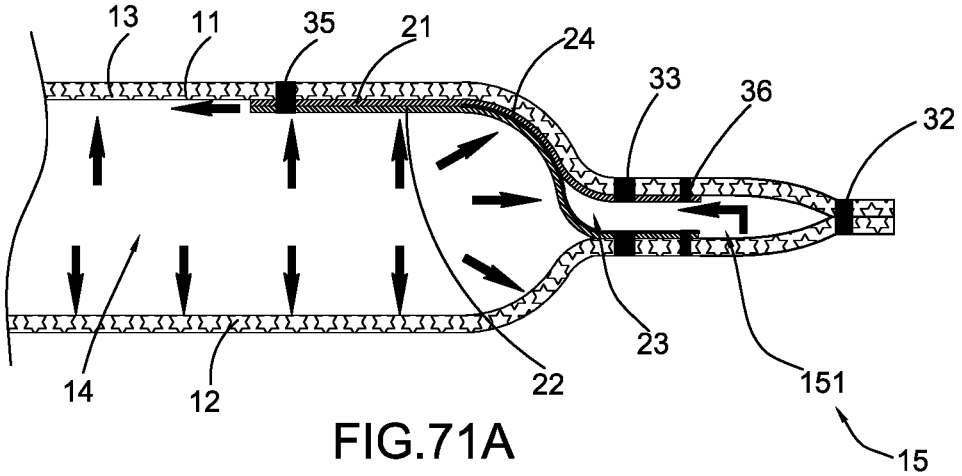
FIG. 71A is a perspective view of the one-way inflation valve for the air-filling packaging apparatus according to the above embodiment of the present invention.

According to this preferred embodiment, referring to FIG. 71A, the air cushion body 10 further comprises an inflation valve 20 formed by at least two valve films 21 and 22. The two valve films 21 and 22 of the inflation valve 20 and the air chamber films 11 and 12 are overlappedly arranged. Besides, an air inlet channel 23 is formed between the valve films 21 and 22 for inflating air into the air storage chamber 14. It is understandable that the lengths of the valve films 21 and 22 are shorter than the lengths of the air chamber films 11 and 12. When the air storage chamber 14 is inflated via the air inlet channel 23 and the air pressure in the air storage chamber 14 has attained the predetermined required value, the air pressure in the air storage chamber 14 will act on the valve films 21 and 22 so as to attach the valve films 21 and 22 on one of the air chamber film, which closes the air inlet channel 23 and makes the inflation valve 20 serve as a one-way valve. When each air-storing unit 13 has at least an air inlet channel 23 formed therein and each of the air-storing units 13 is independent to one another, even if one of the air-storing units 13 is damaged and leaks, the rest of the air-storing units 13 will not be affected, but still serve to provide air cushions.

It is understandable that the air chamber films 11 and 12 of the air cushion body 10 and the valve films 21 and 22 of the inflation valve 20 can respectively be made of various suitable membrane materials, such as polyethylene film, polypropylene film, polyvinyl chloride film, polyester film, polystyrene film, composite film, and etc, wherein the present invention shall not be limited thereto, as long as suitable flexible films are utilized. It is worth mentioning that in order to enhance the one-way sealing function, the valve films 21 and 22 of the inflation valve 20 can also be self-adhesive films acquired by adding chemical composition to the above films.

The air cushion body 10 further comprises a main channel unit 15 connected with each of the air-storing units 13 preferably, integrally extended from each of the air-storing units 13. More specifically, according to this preferred embodiment, the extending directions of the main channel unit 15 and the air-storing unit 13 are perpendicular to each other. For example, according to this embodiment, each the air-storing unit 13 is extended along a transverse direction, while the main channel unit 15 is extended along a longitudinal direction. The main channel unit 15 forms a main channel 151 that has an inflation inlet 152. When the inflation inlet 152 has an inflation nozzle arranged thereat for conducting an inflation process, gas will enter the main channel 151 from the inflation inlet 152 along a longitudinal direction, and enter each the air-storing unit 13 along a transverse direction. Then, when the air pressure of each the air storage chamber 14 reaches a predetermined value, the valve films 21 and 22 of the inflation valve 20 will attached on one of the air chamber films 11 and 12, so as to self-seal and prevent the inflated gas from reversing into the main channel 151.

It is worth mentioning that, it is understandable that the main channel unit 15 can be formed by two layers of the air chamber films 11 and 12, two layers of the valve films 21 and 22, or either one layer of the air chamber films 11 and 12 and either one layer of the valve films 21 and 22.

Referring to FIG. 5, the 2D heat-sealing seams 30 further comprise a continuously sealed edge sealing seam 32 respectively on the left and right sides and a continuously sealed main channel sealing seam 33 on the left side of the air cushion body 10, wherein the main channel 151 is formed between the left edge sealing seam 32 and the main channel sealing seam 33. It is understandable that the edge sealing seam 32 is formed through heat-sealing technology, such as adhesive bonding, heat-sealing, and etc., to sealedly connect the two air chamber films 11 and 12. The main channel sealing seam 33 is formed through heat-sealing technology, such as adhesive bonding and heat-sealing, to sealedly connect the two air chamber films 11 and 12 and the two valve films 21 and 22 respectively, as FIG. 71A illustrates. For example, the main channel sealing seam 33 on the up and down sides that are formed through a first heat-sealing technology respectively heat-sealedly connects the air chamber film 11 and the valve film 21 and heat-sealedly connects the air chamber film 12 and the valve film 22.

Referring to FIG. 5, each air-storing unit 13 comprises two spaced gas duct seams 34 adjacent to the main channel 151 and formed through heat-sealedly connecting the air chamber films 11 and 12 and the valve films 21 and 22. The air inlet channel 23 formed by the valve films 21 and 22 are arranged between the two gas duct seams 34.

Referring to FIG. 71A, the valve films 21 and 22 are further heat-sealedly connected with the air chamber film 11 through a plurality of connecting seams 35, such that when the air pressure in the air storage chamber 14 attained a predetermined value, the air pressure will act on the valve films 21 and 22 and because of the arrangement of the connecting seams 35, the valve films will be pushed toward the air chamber film 11 and eventually be attached on the air chamber film 11, so as to close the air inlet channel 23. That is to say, the connecting seams 35 heat-sealedly connect the two valve films 21 and 22 and the air chamber film 11. Besides, referring to FIG. 5, the shape of each the connecting seams 35 allows it to further prevent the air from backflow. In other words, when the air in the air storage chamber 14 is going to flow back, it will be obstructed by the connecting seams 35 and cannot return into the main channel 151 easily.

In addition, when the 2D heat-sealing seams 30 are being formed through heat-sealing, the air inlet channel 23 of the valve films 21 and 22 of the inflation valve 20 can be formed through the arrangement a heatproof barrier device. Then the heatproof barrier device can be removed after the heat-sealing process. According to this embodiment, referring to FIGS. 5 and 71A, a heatproof layer 24 is arranged between the valve films 21 and 22 of the inflation valve 20 and attached with the inner surface of one of the valve films 21 and 22. The heatproof layer 24 can be embodied as thermostable inks and etc. As a result, when the main channel sealing seam 33 is formed through heat-sealing, the two valve films 21 and 22 will not be heat-sealedly connected, such that the air inlet channel 23 can be connected with the main channel 151 and the access thereof will not be closed due to the heat-sealing.

According to this preferred embodiment, the main channel 151 is formed by the two air chamber films 11 and 12, the heatproof layer 24 and the valve films 21 and 22 respectively have extending section extended into the main channel 151, and the 2D heat-sealing seams 30 further comprise a joint seam 36 longitudinally and spacingly arranged at the position corresponding to the extending section of the heatproof layer 24. Because of the arrangement of the heatproof layer 24, the joint seam 36 respectively connects the two air chamber films 11 and 12 and the two valve films 21 and 22, while the two valve films 21 and 22 are not heat-sealedly connected with each other. The arrangement of the joint seam 36 allows adjacent valve films 21 and 22 and the correspondingly connected air chamber films 11 and 12 to be expanded together to open the corresponding air inlet channel 23 when air enters the main channel 151 during the inflation of the air cushion body 10.

The 2D heat-sealing seams 30 further comprises a plurality intermittent bending seams 37, wherein the inflated air cushion body 10 is adaptable for bending along the bending seams 37, such that the air cushion body 10 can form a plurality of side walls. More specifically, the bending seams 37 divides each the air-storing unit 13 into a plurality of sub-air-storing units 131. The bending seams can be arranged in the middle of the air-storing units 13 and respectively form a connecting channel 132 on the two sides thereof, such that the adjacent sub-air-storing units 131 can be interconnected and communicated, as FIG. 5 illustrates. It is understandable that the bending seam can also be arranged on the two sides of the air-storing units 13, while the connecting channel 132 is arranged in the middle of the air-storing units 13. Correspondingly, it is understandable that each bending seam 37 heat-sealedly connects two layers of the air chamber films 11 and 12.

Referring to FIG. 5, the 2D heat-sealing seams 30 further comprises a choke seam 38 sealing off the air inlet channel of the two air-storing units 13, as the figure illustrates, of the air-storing units 13 on the top side of the air cushion body 10. Namely, the choke seam can be arranged near by the tail of the air inlet channel 23 to heat-sealedly connect the two air chamber films 11 and 12 and the two valve films 21 and 22, so as to make each the air-storing unit 13 uninflatable and form non-inflated air-storing pillar.

Correspondingly, the arrangement of the choke seam 38 can divide a plurality of transversely extended air-storing units 13 into a plurality of inflatable air-storing units 13*a* and a plurality of uninflatable air-storing units 13*b* arranged longitudinally. For instance, referring to FIG. 5, the three air-storing units on the top side are uninflatable, which are, according to this embodiment of the present invention, to form an inner bag portion 10*b*, while the four inflation units 13*a* on the bottom side are inflatable, so as to form an outer bag portion 10*a*. In other words, according to this preferred embodiment of the present invention, it provides cushioning function in a multistage manner through the inflatable outer bag portion 10*a* and the non-inflated inner bag portion 10*b*.

Further, according to the embodiment illustrated in FIGS. 1-5, the 2D heat-sealing seams 30 comprise four rows of the bending seams 37, such that the air cushion body 10 is adaptable to form the right front side wall 101, right side wall 102, rear side wall 103, left side wall 104, and left front side wall 105 along the four bending seams 37. The above mentioned side walls 101-105 are bent to form a cavity 106 with an opening 107 on the top side thereof. Namely, the side walls 101-105 are surroundingly arranged and the air-storing units 13 respectively to form a ringlike air-storing pillar. That is, referring to FIG. 5, the left part of the first row of the bending seam 37 is arranged for forming the right front side wall 101, the right side wall 102 is formed between the first and second rows of the bending seams 37, the rear side wall 103 is formed between the second and third rows of the bending seams 37, the left side wall 104 is formed between the third and fourth rows of the bending seams 37, and the left front side wall 105 is formed in the right side of the fourth row of the bending seam 37. It is understandable that the side walls 101-105 are respectively formed by the sub-air-storing units 131 integrally extended from the air-storing unit 13 along the length direction thereof.

Figure 3:
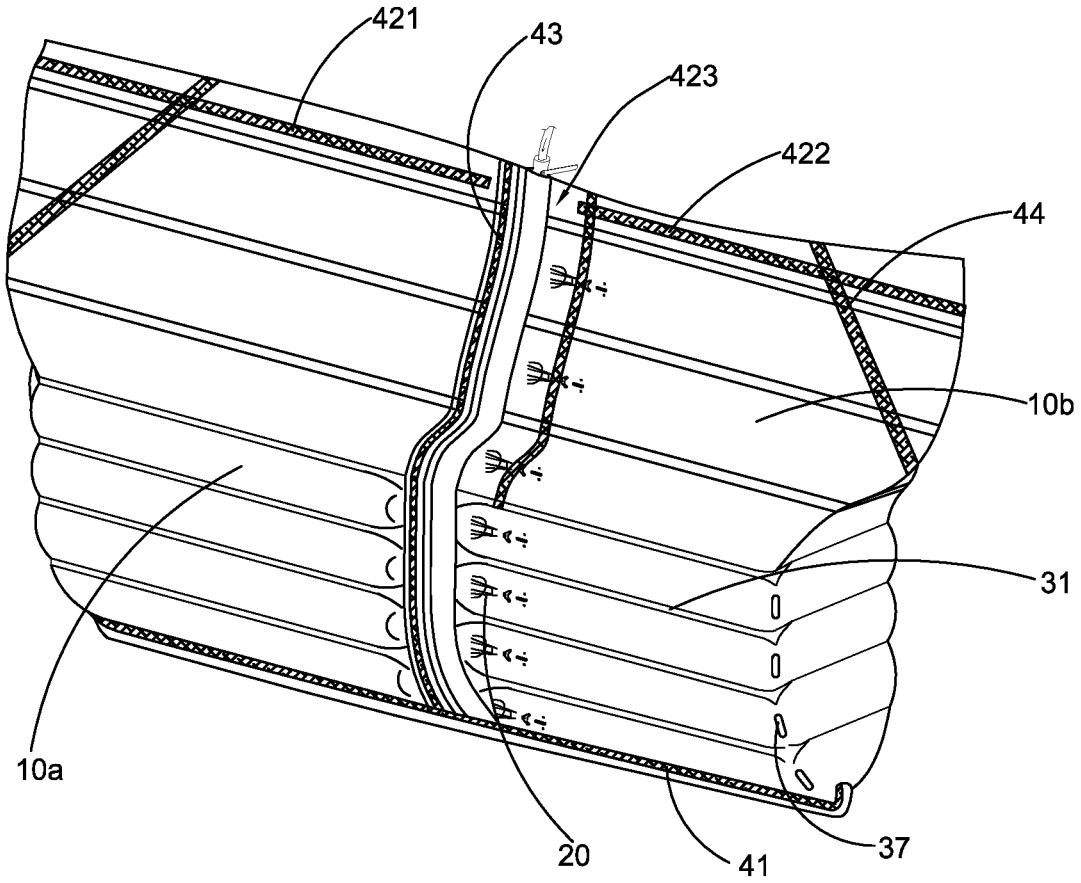
FIG. 3 is a perspective view illustrating the inner bag portion of the air-filling packaging apparatus being arranged in the outer side thereof according to the above first preferred embodiment of the present invention.
Figure 6:
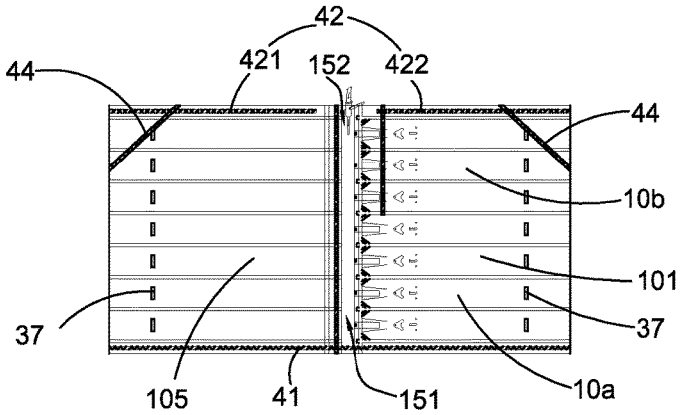
FIG. 6 is a perspective view illustrating the uninflated air-filling packaging apparatus being through a second heat-sealing according to the above first preferred embodiment of the present invention.
Figure 7:
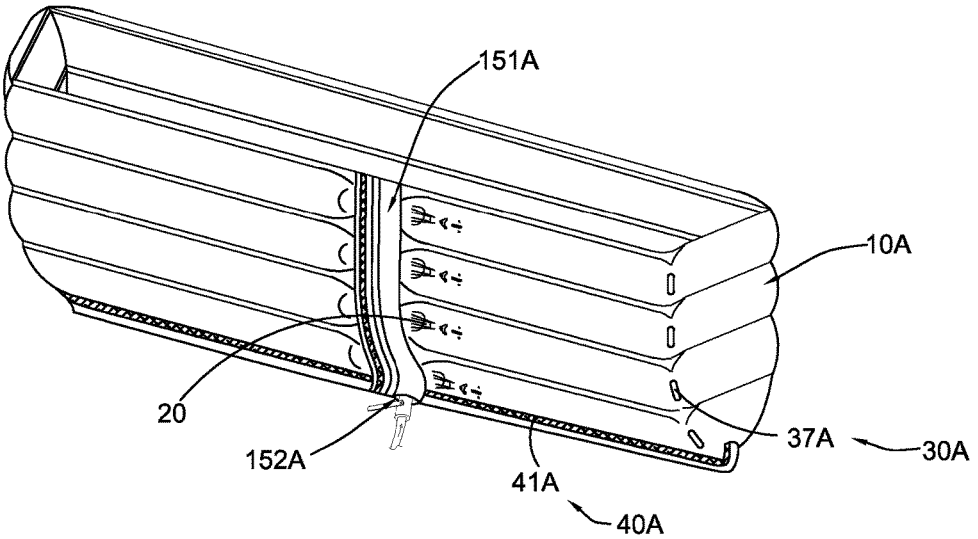
FIG. 7 is a 3D perspective view of the air-filling packaging apparatus according to a second preferred embodiment of the present invention.
Figure 8:
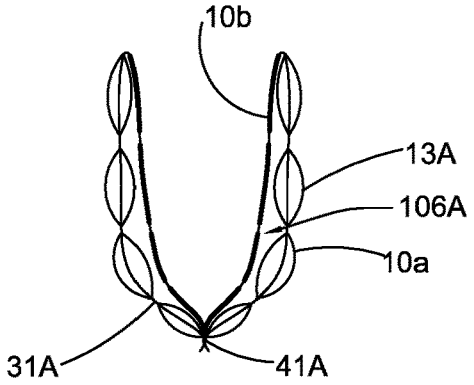
FIG. 8 is a side sectional view of the air-filling packaging apparatus according to the above second preferred embodiment of the present invention.

Correspondingly, referring to FIGS. 1 and 5, the 3D heat-sealing seams 40 comprise a transverse heat-sealing seam 41 on the bottom side heat-sealing and connecting the bottom sides the front side wall 101 and the rear side wall 103, so as to seal off the bottom side of the outer bag portion 10*a*. The 3D heat-sealing seams 40 further comprise a transverse heat-sealing seam 42 on the top side heat-sealing and connecting the top sides of the front side walls 101 and 105 and the rear side wall 103, so as to seal off the top side of the inner bag portion 10*b*. The 3D heat-sealing seams 40 further comprise a longitudinal end sealing seam 43 heat-sealedly connecting the right front side wall 101 and the left front side wall 105 along the longitudinal direction which means the air cushion body 10 is circularly arranged and the head and tail thereof are connected. Thus, the air cushion body 10 is able to form a 3D packaging bag having the inflatable outer bag portion 10*a* on the bottom side and the non-inflated inner bag portion 10*b* on the top side through the transverse heat-sealing seams 41 and 42 and the end sealing seam 43 that heat-sealedly connect multiple layers of films. FIGS. 3 and 6 respectively illustrate the 3D packaging bag after and before inflated.

Moreover, it should be noted that FIG. 5 illustrates the state of the plane cushion material formed through heat-sealing of the 2D heat-sealing seams 30, it also illustrates the position of the 3D heat-sealing seams 40, such that one may understand the forming process of the 3D packaging bag more easily.

Figure 2:
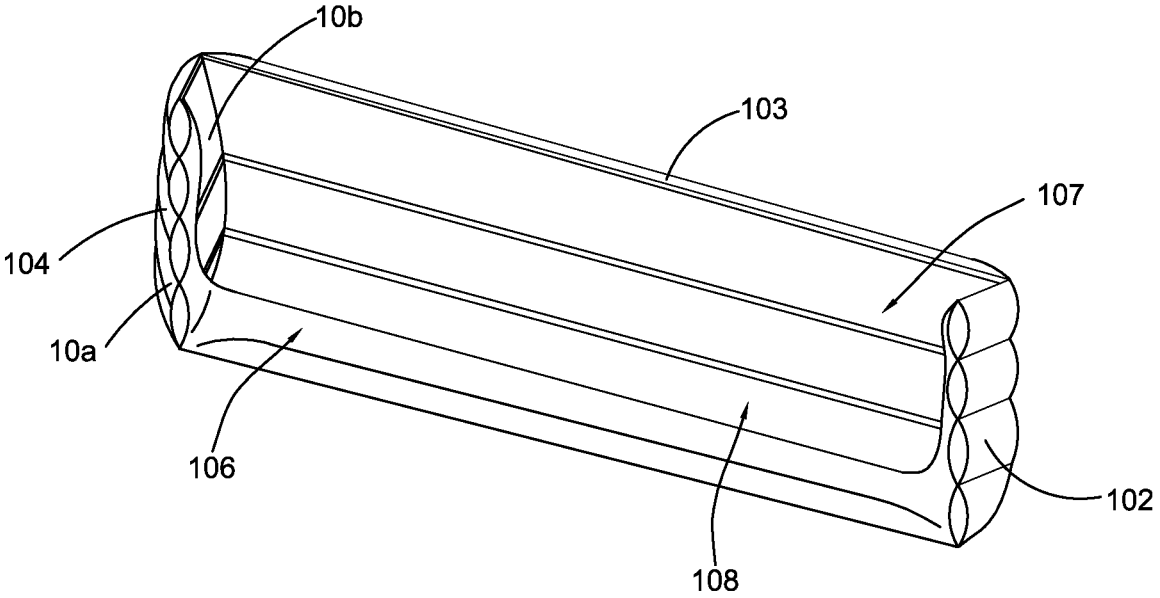
FIG. 2 is a sectional view of the air-filling packaging apparatus according to the above first preferred embodiment of the present invention sectioned along the A-A line in FIG. 1.
Figure 4:
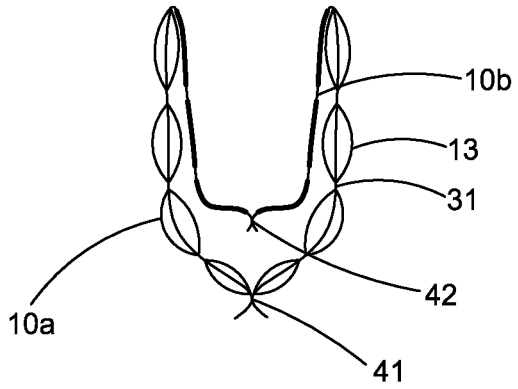
FIG. 4 is a side sectional view of the air-filling packaging apparatus according to the above first preferred embodiment of the present invention.

The inner bag portion 10*b* is adaptable to be tucked into the cavity of the outer bag portion 10*a* so as to form an accommodating chamber 108, as is illustrated in FIGS. 2-4. Thus, the inner bag portion 10*b* is adapted for accommodating the object. Then the inner bag portion 10*b* that accommodates the object therein is further put in the cavity 106 of the outer bag portion 10*a*, such that the outer bag portion 10*a* can provide a level of cushioning function through air cushioning, while the inner bag portion 10*b* can provide another level of cushioning function. Therefore, impact or shock acting on the outer bag portion 10*a* cannot be directly transferred to the object and shaking and impact of the object will not be directly transferred to the outer bag portion 10*a* to damage the outer bag portion 10*a*. That is to say, the outer bag portion 10*a* and the inner bag portion 10*b* are coupled to provide cushioning function in a multistage manner.

It is worth mentioning that when the inner bag portion 10*b* is utilized for loading the object, after the outer bag portion 10*a* is inflated, the external surface of the inner bag portion 10*b* may or may not attach with the inner surface of the outer bag portion 10*a*. Preferably, according to this embodiment, the inner bag portion 10*b* is suspended in the cavity of the outer bag portion 10*a*. In other words, there is a buffer gap between the inner bag portion 10*b* and the outer bag portion 10*a*, which further enhances the cushioning performance. In other words, when the air-storing units 13 of the outer bag portion 10*a* are collided or impacted from the outside, the buffer gap can provide a deformation space for the air-storing units 13, so as to prevent the impact force that acts on the air-storing units 13 from being directly transferred to the object.

Further, the outer bag portion 10*a* and the inner bag portion 10*b* can be heat-sealedly connected. Preferably, according to this embodiment, the outer bag portion 10*a* and the inner bag portion 10*b* are integrally formed. That is to say, they are both formed by integrally extending the same air chamber films and valve films. The outer bag portion 10*a* and the inner bag portion 10*b* are longitudinally arranged and the inner bag portion 10*b* can be tucked into the outer bag portion 10*a*, such that the inner bag portion 10*b* in the outer bag portion 10*a* not only serves to package the object, but also further enhance the cushioning function. When there are external impact and shock acting on the outer bag portion 10*a*, the inner bag portion 10*b* can prevent the object from shaking and stress concentration due to being stuck at a corner.

Besides, the 3D heat-sealing seams 40 further comprise a stopping seam 44 respectively on the two sides of the inner bag portion 10*b* heat-sealedly connecting the front and back sides of the inner bag portion 10*b*. Referring to FIGS. 3, 5, and 6, each stopping seam 44L can be embodied as a heat-sealed seam inclinedly extended from one fringe of the two sides toward the center. Therefore, when the object is accommodated in the accommodating chamber 108 formed by the inner bag portion 10*b* again, it will be retained between the two stopping seams 44. Then, there will be reserved space between the two sides of the object and the inner surfaces of the right side wall 102 and the left side wall 104, such that when the two sides of the 3D packaging bag formed by the air cushion body 10 receive external shock or impact, the impact force will not be directly transferred to the two sides of the object. Hence, the side cushion performance of the air-filling packaging apparatus can be enhanced.

It is worth mentioning that the 3D heat-sealing seams 40 can be continuous heat-sealed seams or intermittent heat-sealed seams. The transverse heat-sealing seams 41 and 42 can be respectively located at the dividing seam 31 on the top or bottom sides of the air cushion body 10 or be formed with the dividing seam 31 through a first heat-sealing process at the same time. According to the embodiment illustrated in FIG. 5, the heat-sealing seams 41 and 42 can respectively be an independent heat-sealed seam formed on the bottom or top edge of the air cushion body 10. The longitudinal end sealing seam 43 can be arranged near by the edge sealing seam 32 of the main channel 151 or be formed with the edge sealing seam 32 of the end sealing seam 43 at once through a first heat-sealing. Alternatively, it can also be an independent heat-sealed seam arranged on the outer edge of the edge sealing seam 32. When it was arranged in the inner side of the edge sealing seam 32, the main channel 151 will be formed between the end sealing seam 43 and the main channel sealing seam 33.

Beside, referring to FIG. 5, when the inflation inlet 152 of the main channel 151 is arranged on the top side of the air cushion body 10, the transverse heat-sealing seam 42 on the top side comprises spacedly arranged heat-sealing sections 421 and 422 and an interval 423 left therebetween, wherein the inflation inlet 152 of the main channel 151 is not heat-sealed at the position corresponding to the interval 423, such that the inflation inlet will not be closed, which allows subsequent inflation operation.

The left side wall 104 and the right side wall 102 can be spacedly arranged in a mostly parallel manner. According to this preferred embodiment of the present invention, more preferably, the left side wall 104 and the right side wall 102 are respectively inclinedly arranged. That is to say, the left side wall 104 is inclinedly extended between the left front side wall 105 and the rear side wall 103, and the right side wall 102 is inclinedly extended between the right front side wall 101 and the rear side wall 103.

According to the embodiment illustrated in FIG. 1, the lengths of the front side walls 101 and 105 are shorter than the length of the rear side wall 103, such that the left side wall 104 and the right side wall 102 can respectively be inclinedly extended to form a buffer space 1041 and 1021 respectively between the rear side wall 103 and themselves. Certainly, it is understandable that as an alternative mode, the length of the front side walls 101 and 105 may also be longer than the length of the rear side wall 103.

Correspondingly, the cross section of the air cushion body 10 is mostly in a trapezoidal shape. When the packaging apparatus is arranged in the inner bag portion 10*b*, the two sides of the object can respectively be positioned at the first and fourth rows of the bending seams 37 without reaching or extending into the buffer space 1041 and 1021. Therefore, the two sides of the object may be kept from attaching with the inflated left side wall 104 and right side wall 102 directly and be spaced therewith, such that when the left side wall 104 and the right side wall 102 are collided or impacted from the outside, the external impact force will not be transferred to the object through the left side wall 104 and the right side wall 102 directly. Rather, the buffer space 1041 and 1021 respectively provide deformation space to the left side wall 104 and right side wall 102. When the left side wall 104 and right side wall 102 are respectively deformed due to receiving the external impact force, the internal air flowing and restoring feature thereof allows them to flexibly recover. When the shock or impact is over, they will automatically recover into their original state without passing the force to the object, so as to remarkably enhance the cushioning performance of the entire multistage cushioning air-filling packaging apparatus. Namely, the sub-air-storing units 131 of the left side wall 104 and the right side wall 102 provide a level of cushion or a first cushion, while the arrangement of the buffer space 1041 and 1021 provides another level of cushion or a second cushion, so as to achieve a cushioning function in a multistage manner.

FIGS. 7-10 illustrate a multistage cushioning air-filling packaging apparatus according to a second preferred embodiment of the present invention. Similarly, according to this preferred embodiment, the air-filling packaging apparatus comprises at least an air cushion body 10A and an inflation valve 20 serving as a self-sealing one-way air inlet. It forms one or more interconnected air-storing units 13A through a series of 2D heat-sealing seams 30A and 3D heat-sealing seams 40A, wherein the air-storing units are circularly arranged to surroundingly form a cavity 106A.

According to this preferred embodiment of the present invention, the air cushion body 10A forms an integrally formed inner bag portion 10*b* and outer bag portion 10*a*, wherein the inner bag portion 10*b* is further affixedly connected with the outer bag portion in the 3D heat-sealing step. In other words, by the time the 3D packaging bag is formed by the plane cushion substance through the 3D heat-sealing seams 40 in the 3D heat-sealing step, the inner bag portion 10*b* will be tucked into the outer bag portion 10*a* and heat-sealedly affixed with the outer bag portion 10*a*, which means the inner bag portion 10*b* is arranged in the outer bag portion 10*a* before inflation. Hence, the inner bag portion 10*b* is affixed in the outer bag portion 10*a* during the production of the multistage cushioning air-filling packaging apparatus. As as result, the inner bag portion 10*b* does not have to be tucked into the inflated outer bag portion 10*a* for packaging the object in the packaging site like what is in the embodiment illustrated in FIGS. 1-6.

It is understandable that it may utilize all kinds of proper way to affix the inner bag portion 10*b* in the outer bag portion 10*a*. For example, according to the embodiment illustrated in FIG. 8, the transverse heat-sealing seam 41A of the outer bag portion 10*a* is further heat-sealedly connected with the fringe of the inner bag portion 10*b*, which may be equal to integrate the transverse heat-sealing seams 41 and 42 of the embodiment illustrated in FIGS. 1-6 into one transverse heat-sealing seam 41A so as to heat-sealedly connect the inner bag portion 10*b* with the outer bag portion 10*a*. It is understandable that the way to connect the inner bag portion 10*b* and the outer bag portion 10*a* may also include heat-sealedly connecting the inner bag portion with one of the dividing seam 31A or the bending seam 37A, wherein the present invention shall not be limited thereto.

Figure 9:
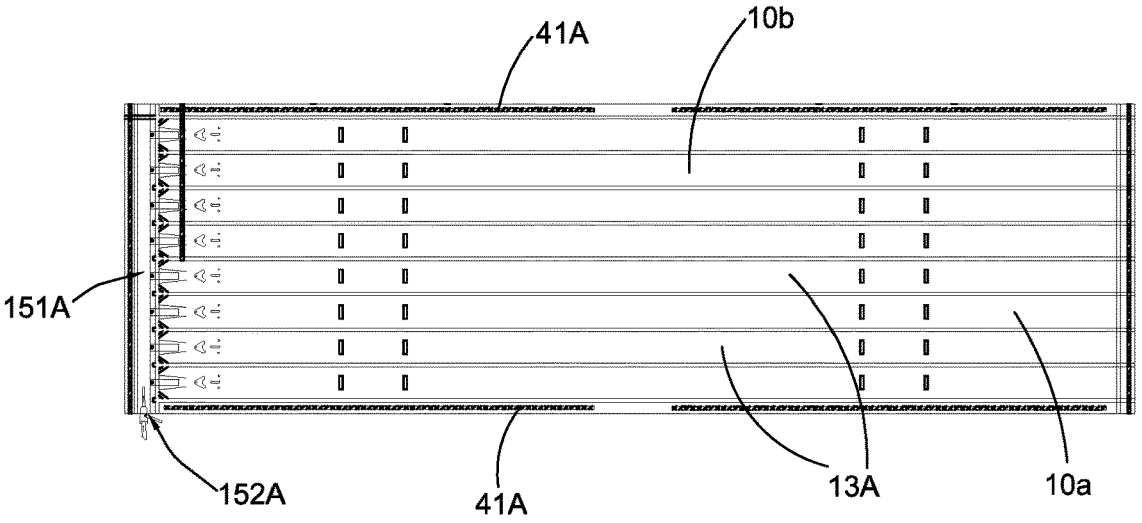
FIG. 9 is a perspective view illustrating the uninflated air-filling packaging apparatus being expanded in a plane manner according to the above second preferred embodiment of the present invention.
Figure 10:
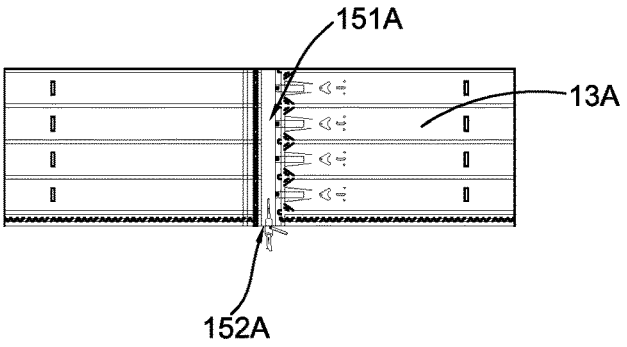
FIG. 10 is a perspective view illustrating the uninflated air-filling packaging apparatus being through a second heat-sealing according to the above second preferred embodiment of the present invention.

Besides, referring to FIGS. 9-10, the inflation inlet 152A of the air cushion body 10A can also be arranged on the bottom side thereof, while, correspondingly, there will be reserved interval at the position of the transverse heat-sealing seam 41A on the bottom side in the middle corresponding to the inflation inlet 152A, so as to avoid the inflation inlet 152A from being closed.

Figure 11A:
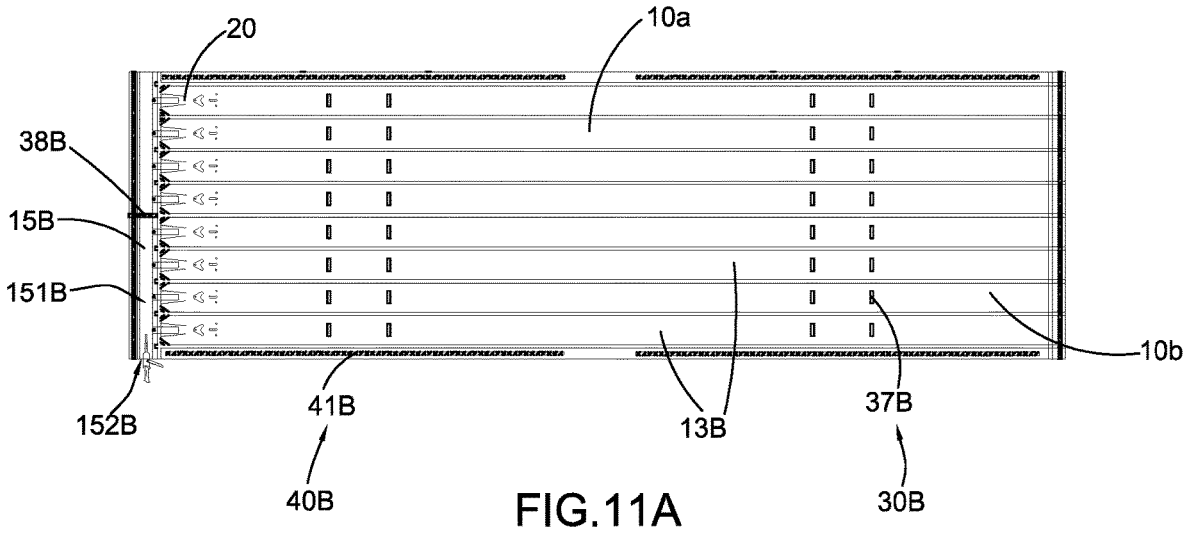
FIG. 11A is a perspective view illustrating the uninflated air-filling packaging apparatus being expanded in a plane manner according to an alternative mode of the above second preferred embodiment of the present invention.
Figure 11B:
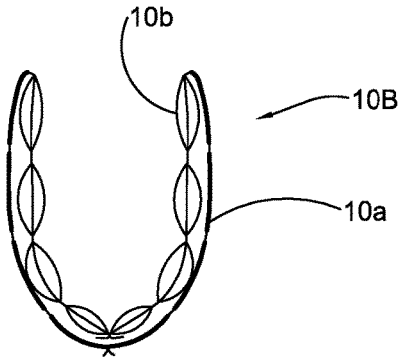
FIG. 11B is a side sectional view of the air-filling packaging apparatus being inflated according to the above alternative mode of the above second preferred embodiment of the present invention.

Referring to FIGS. 11A-11B, according to an alternative mode of the above second preferred embodiment of the present invention, the choke seam 38B is arranged at a proper position at the main channel 151B, such that the choke seam 38B can be utilized to divide a plurality of the air-storing units 13B of the air cushion body 10B into an inflatable part and non-inflated part arranged along the longitudinal direction, which means the width direction. Correspondingly, referring to FIG. 11A, the four air-storing units 13B of the top side are uninflatable, while the four air-storing units 13B integrally extended on the bottom side are inflatable.

That is, when air enters the main channel 151B via the inflation inlet 151B, it can then respectively enter the four air-storing units 13B of the bottom side. Nonetheless, because the choke seam 38B has heat-sealedly connected the films of the main channel unit 15B, the air is not allowed to continue entering the four air-storing units 13B of the top side.

In addition, it is worth mentioning that, according to this embodiment of the present invention, the uninflatable part of the air cushion body 10B forms the outer bag portion 10*a*, while the inflatable part forms the inner bag portion 10*b*. It is understandable that the uninflatable part being inversed and heat-sealed may also form a non-inflated outer bag, such that the non-inflated outer bag can serve as a protection, such as preventing the inflatable inner bag from being punctured by hard objects, as well as provide multistage cushioning protection, as FIG. 11B illustrated.

Figure 12A:
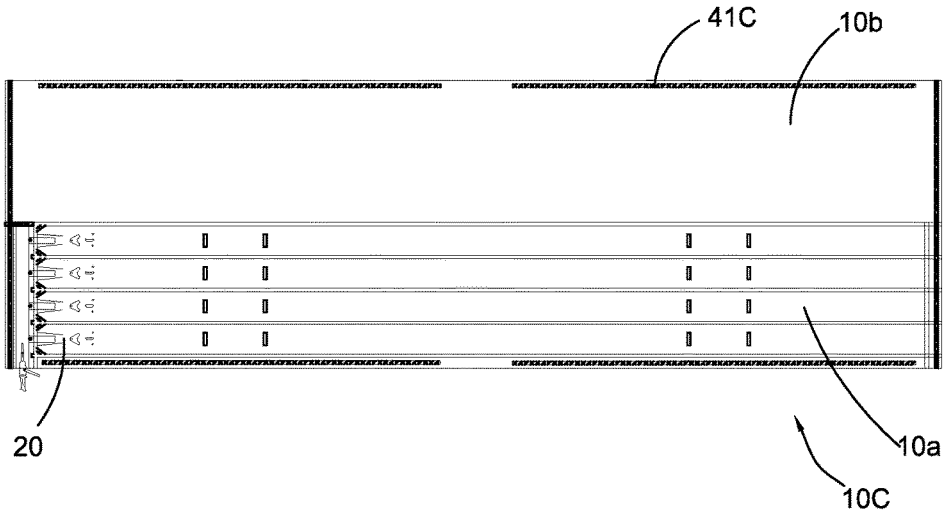
FIG. 12A is a perspective view illustrating the uninflated air-filling packaging apparatus being expanded in a plane manner according to another alternative mode of the above second preferred embodiment of the present invention.
Figure 12B:
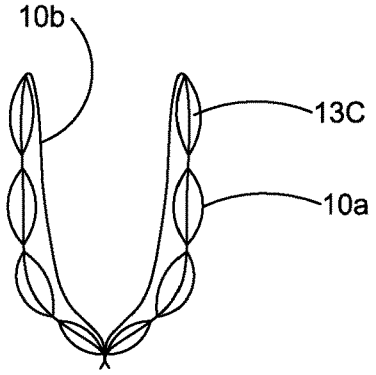
FIG. 12B is a sectional view of the air-filling packaging apparatus being inflated according to the above alternative mode of the above second preferred embodiment of the present invention.

Referring to FIGS. 12A-12B, according to another alternative mode of the above second preferred embodiment of the present invention, the air cushion body 10C forms the outer bag portion 10*a* and the inner bag portion 10*b*, wherein the inner bag portion 10*b* is formed by one layer of the air chamber films 11 or 12. Namely, a single layer of film is connected with the outer bag portion 10*a* and extended from the top side thereof, wherein the film can be heat-sealedly connected or more preferably, integrally formed. That is to say, an extended section of one of the air chamber film, such as the air chamber film 11, which continued to extend toward the top side can be utilized for the inner bag portion 10*a*. In other words, a layer of the film and a plurality of the air-storing units 13C on the bottom side are 3D heat-sealed and the film is tucked into the outer bag portion 10*a* formed by the air-storing units 13C in order to form the inner bag portion 10*b*.

Figure 13A:
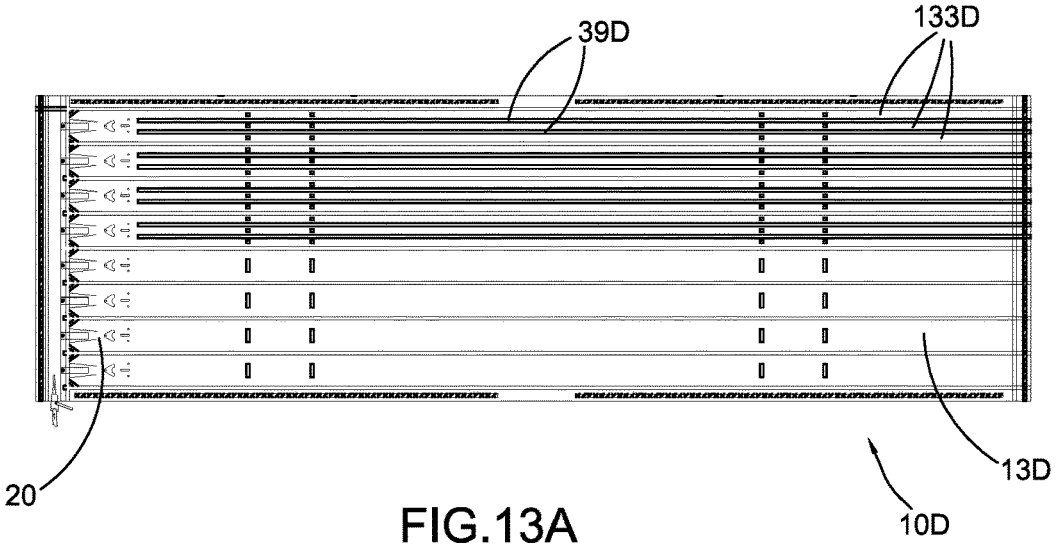
FIG. 13A is a perspective view illustrating the uninflated air-filling packaging apparatus being expanded in a plane manner according to another alternative mode of the above second preferred embodiment of the present invention.
Figure 13B:
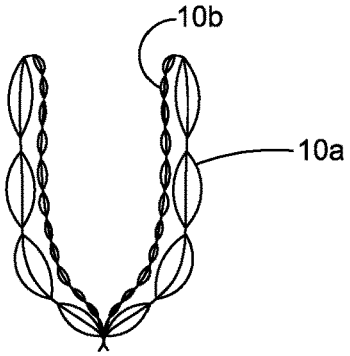
FIG. 13B is a sectional view of the air-filling packaging apparatus being inflated according to the above alternative mode of the above second preferred embodiment of the present invention.

Referring to FIGS. 13A-13B, according to another alternative mode of the above second preferred embodiment of the present invention, the inner bag portion 10*b* and the outer bag portion 10*a* formed by the top side and bottom side of the air cushion body 10D are both inflatable structures. As the figures illustrate, four of the air-storing units 13D on the bottom side form the outer bag portion 10*a*, while four of the air-storing units 13D on the top side form the inner bag portion 10*b*.

More specifically, four of the air-storing units 13D on the top side are respectively divided by transversely extended air resisting seam 39D into a plurality of small diameter air-storing units 133D. Referring to the embodiment illustrated in FIG. 13A, each the air-storing unit 13D is divided into three small diameter air-storing units 133D through two air resisting seam 39D. Thus, a plurality of the small diameter air-storing units 133D is arranged in the large diameter air-storing units on the bottom side, so as to form the inner bag portion 10*b*.

In other words, the inner bag portion 10*b* and the outer bag portion 10*a* can both provide air cushioning function, so as to allow the 3D packaging bag formed by the air cushion body 10D to provide cushioning function in a multistage manner. It is understandable that the venting seam 39D is embodied as a transverse continuous heat-sealed seam to heat-seal two layers of the air chamber films according to this embodiment. According to some alternative mode, there can be spaced heat-sealed seams to ensure that the inner bag portion 10*b* may not only communicate along the length direction thereof, but also have heat-sealed blocks in various suitable shapes, such as a plurality of spaced circle, square, triangle, other polygon, and etc.

Figure 14:
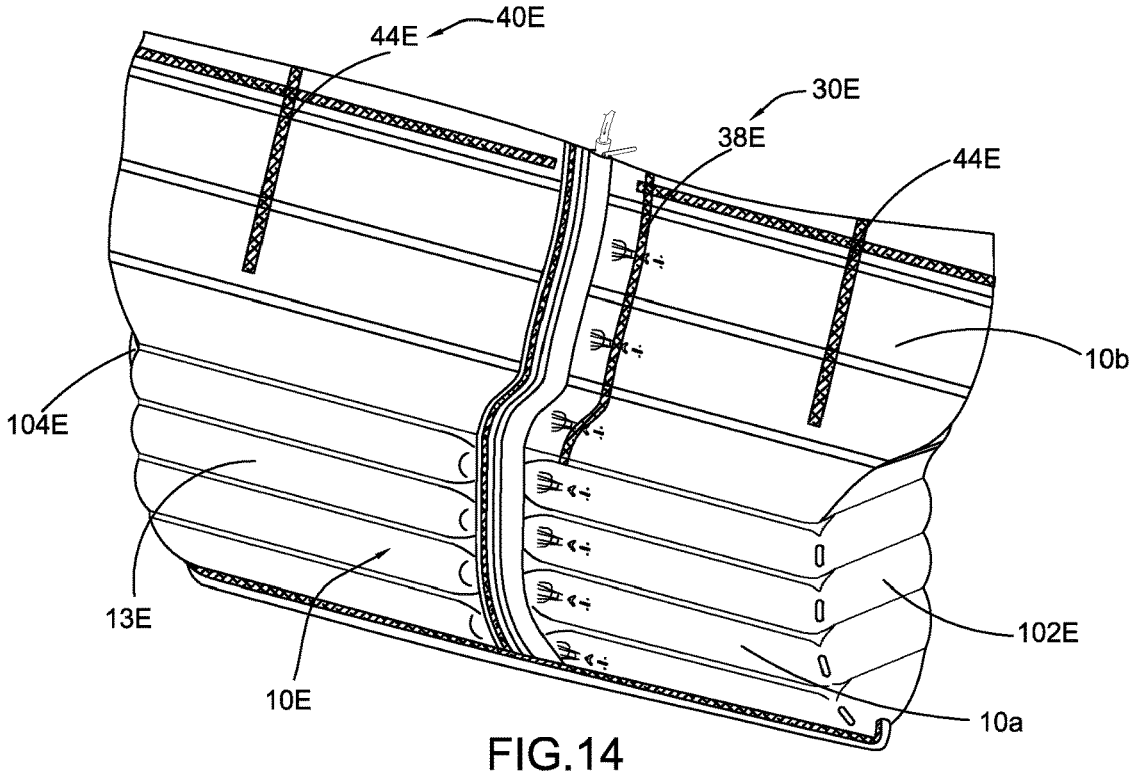
FIG. 14 is a 3D perspective view of the air-filling packaging apparatus according to another alternative mode of the above second preferred embodiment of the present invention.

Referring to FIG. 14, similarly, according to another alternative mode of the above preferred embodiment of the present invention, the air cushion body 10E forms the inner bag portion 10*b* and the outer bag portion 10*a* and the stopping seams 44E are formed on the two sides of the non-inflated inner bag portion 10*b*. Moreover, according to this alternative mode, the stopping seams 44E are not inclinedly extended; instead, they are extended along a vertical direction. Therefore, when the non-inflated inner bag portion 10*b* is tucked into the outer bag portion 10*a* for packaging the object, the object will be retained between the two stopping seams 44.

More specifically, referring to FIG. 14, the two stopping seams 44 are spacedly arranged. Each stopping seam 44 may be a continuous heat-sealed seam or an intermittent heat-sealed seam, while it keeps a predetermined distance from the fringe of the two sides of the inner bag portion 10*b* and extends longitudinally. As a result, when the object is retained between the two stopping seams 44, the object is spaced to the side walls 104E and 102E of the outer bag portion 10*a* of the air cushion body 10E, so as to prevent force acting on the side walls 104E and 102E be directly transferred to the object, such that the cushioning function can be enhanced.

FIGS. 15-20 illustrate a multistage cushioning air-filling packaging apparatus according to a third preferred embodiment of the present invention. Similarly, it comprises at least an air cushion body 10F and an inflation valve 20 serving as a self-sealing one-way air inlet. It forms one or more interconnected air-storing units 13F through a series of 2D heat-sealing seams 30F and 3D heat-sealing seams 40F, wherein the air-storing units are circularly arranged to surroundingly form a cavity 106F.

According to this preferred embodiment of the present invention, the air cushion body 10F forms an integrally formed inner bag portion 10*b* and outer bag portion 10*a*. Besides, a plurality of the air-storing units 13F form an inflatable air-storing unit 13*a*, an uninflatable air-storing unit 13*b* through the arrangement of the choke seam 38, and a reinforcing cushion unit 13*c* that has a bottom side.

More specifically, referring to FIGS. 15-18, the transverse heat-sealing seam 41F of the bottom side of the 3D heat-sealing seams 40 is arranged between two of the adjacent air-storing units 13F on the bottom side, so as to have one or more of the air-storing units 13 on the outermost side of the bottom side form the reinforcing cushion unit 13*c*. In other words, the transverse heat-sealing seam 41F is not arranged on the fringe of the bottom side of the air cushion body 10F, but arranged on the dividing seam 31F between two adjacent air-storing units 13F. Alternatively, the dividing seam 31F and the transverse heat-sealing seam 41F can be formed at the same time in a first heat-sealing process, such that the two sides of the transverse heat-sealing seam 41F along a longitudinal direction are respectively the reinforcing cushion unit 13*c* and the inflatable air-storing unit 13*a*.

Similarly, when the inflation inlet 152F is arranged on the bottom side of the air cushion body 10F, the transverse heat-sealing seam 41F will comprise two transverse heat-sealing sections 411F and 412F and the interval between the two transverse heat-sealing sections 411F and 412F is at the position corresponding to the inflation inlet 152F so as to prevent it from being closed in the heat-sealing process for forming the transverse heat-sealing seam 41F.

Figure 20:
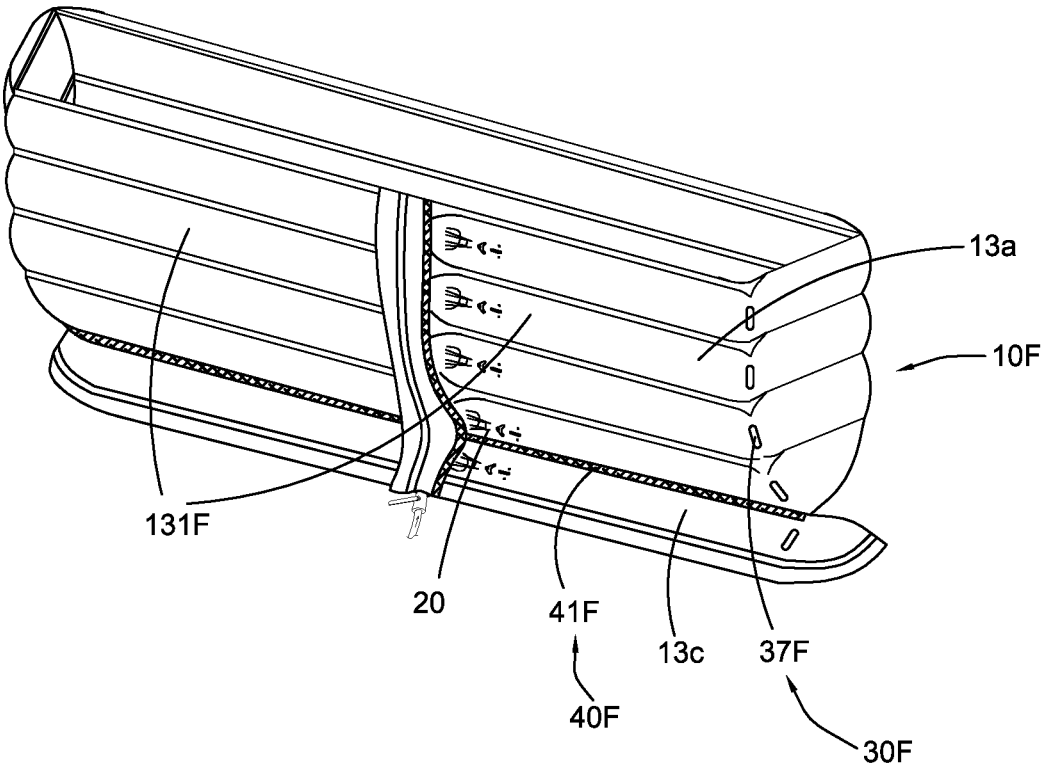
FIG. 20 is a perspective view of the air-filling packaging apparatus according to the above third preferred embodiment of the present invention, where the inner bag portion is tucked into the outer bag portion.

It is understandable that referring to FIG. 20, when the object M is packaged in the multistage cushioning air-filling packaging apparatus, the reinforcing cushion unit 13F on the bottom side provides a first air cushioning function on the bottom side thereof. Besides, the inflatable air-storing unit 13*a* at the inner side of the reinforcing cushion unit 13F provides another level of air cushioning function. Moreover, the inner bag portion 10*b* formed by the non-inflated air-storing units 13*b* further provides another level of cushioning function. Hence, the 3D packaging bag formed by the air cushion body 10F according to this preferred embodiment of the present invention can provide cushioning function in a multistage manner. In other words, this structural design strengthens its overall cushioning performance, especially on the bottom side.

Figure 15:
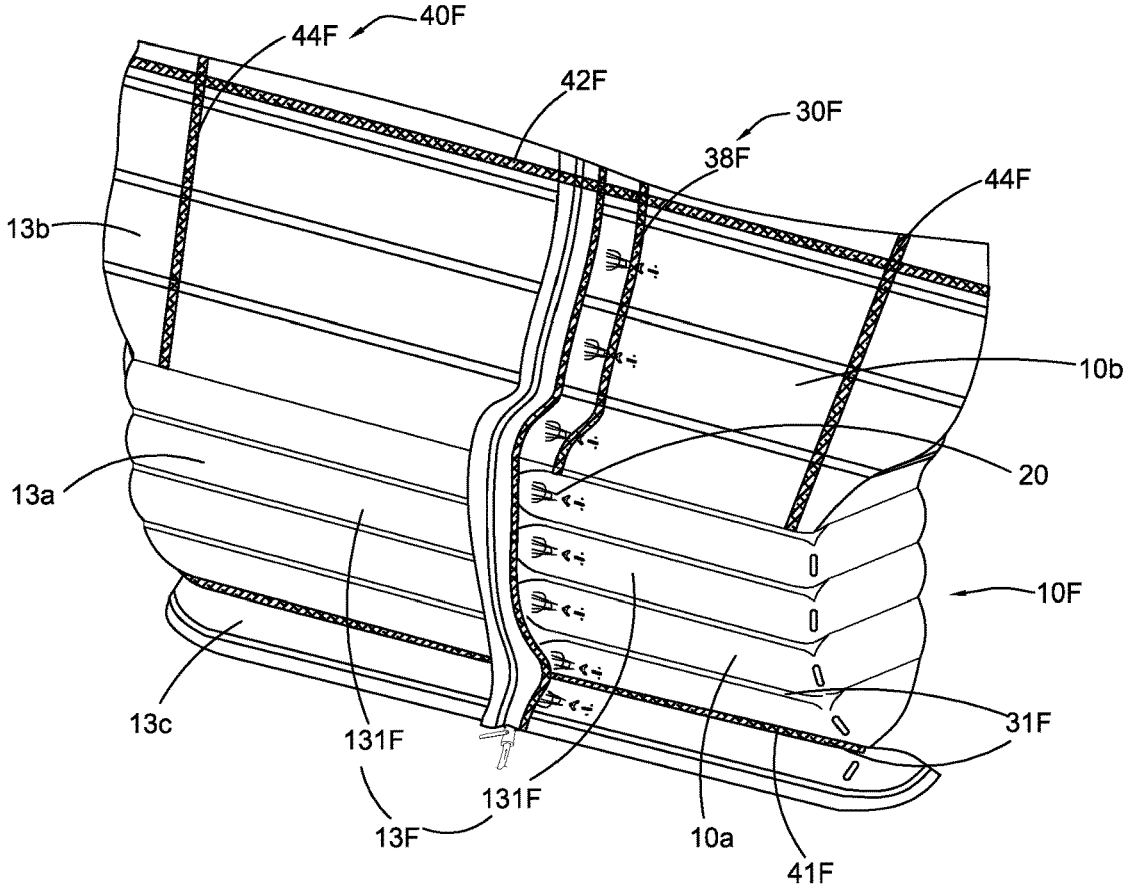
FIG. 15 is a 3D perspective view of the air-filling packaging apparatus according to a third preferred embodiment of the present invention.
Figure 16:
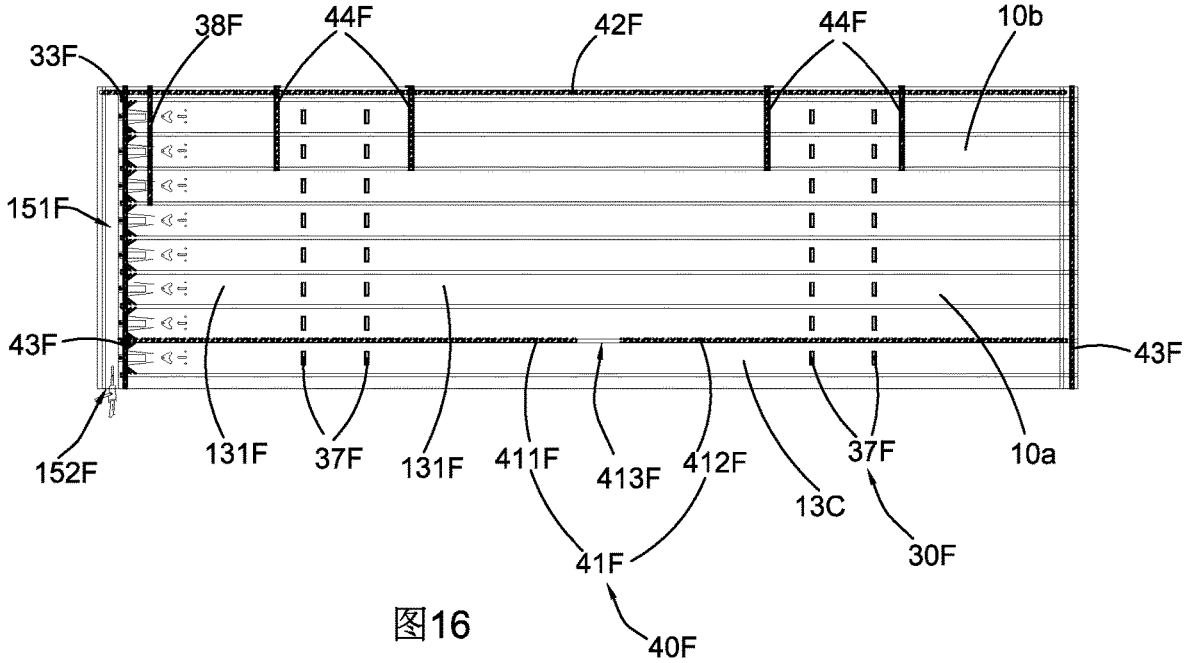
FIG. 16 is a perspective view illustrating the uninflated air-filling packaging apparatus being expanded in a plane manner according to the above third preferred embodiment of the present invention.
Figure 17:
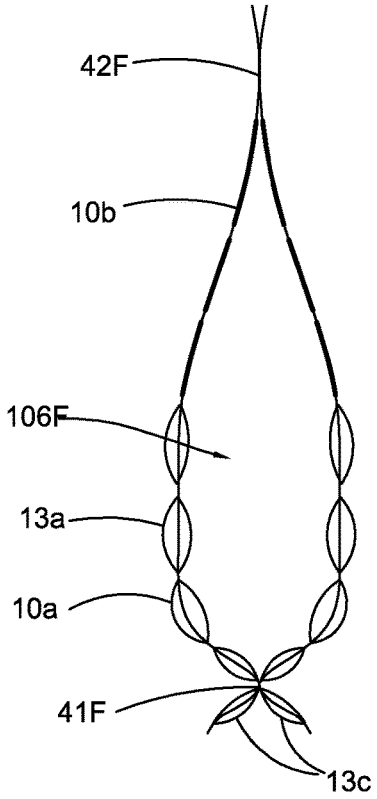
FIG. 17 is a perspective view of the inflated air-filling packaging apparatus according to the above third preferred embodiment of the present invention, where the inner bag portion has not been tucked into the cavity of the outer bag portion yet.
Figure 18:
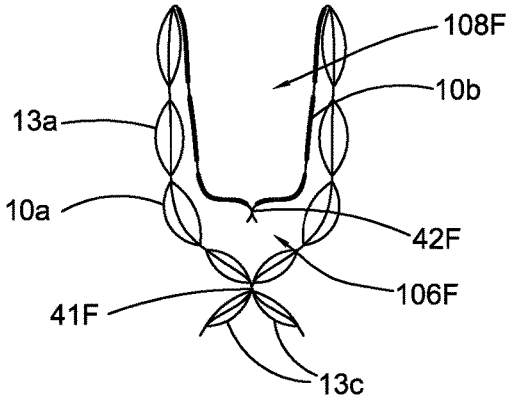
FIG. 18 is a perspective view of the inflated air-filling packaging apparatus according to the above third preferred embodiment of the present invention, where the inner bag portion has been tucked into the cavity of the outer bag portion.

Besides, referring to FIGS. 15-16, according to this embodiment, the longitudinal end sealing seam 43F of the 3D heat-sealing seams 40 can also be formed at the position corresponding to the main channel sealing seam 33F. Alternatively, the main channel sealing seam 33F and the end sealing seam 43F can be formed at once in the first heat-sealing process, so as to connect the head and tail of the air cushion body 10F. Similarly, the transverse heat-sealing seams 41F and 42F of the 3D heat-sealing seams 40 respectively heat-sealedly connect the top side and bottom side of the air cushion body 10, so as to form the cavity 106F. In addition, similar with the above second embodiment, the transverse heat-sealing seams 41F and 42F may also be formed together, such that the outer bag portion 10*b* can be affixedly connected with the inner bag portion 10*a*. Therefore, it will not cost labor to tuck the outer bag portion 10*b* into the inflated inner bag portion 10*a* on the packaging site.

Similarly, the longitudinally arranged stopping seams 44F on the two sides of the inner bag portion 10*b* can serve to retain and limit the object M, such that the object M can be spaced with the side walls formed on the two sides of the air cushion body 10F, so as to reinforce the side cushioning function.

Figure 19:
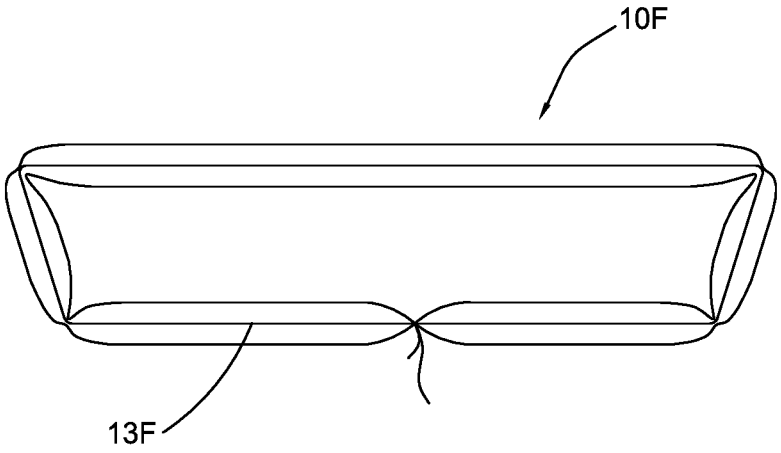
FIG. 19 is a sectional view of the inflated air-filling packaging apparatus according to the above third preferred embodiment of the present invention.

Moreover, referring to FIG. 19, similar with the above first embodiment, the left and right side walls can be inclinedly arranged and the lengths of the front and rear side walls are different, such that the cross section thereof will be in a trapezoidal shape, which can then further enhance the side cushion performance of the multistage cushioning air-filling packaging apparatus according to this preferred embodiment of the present invention.

Figure 21:
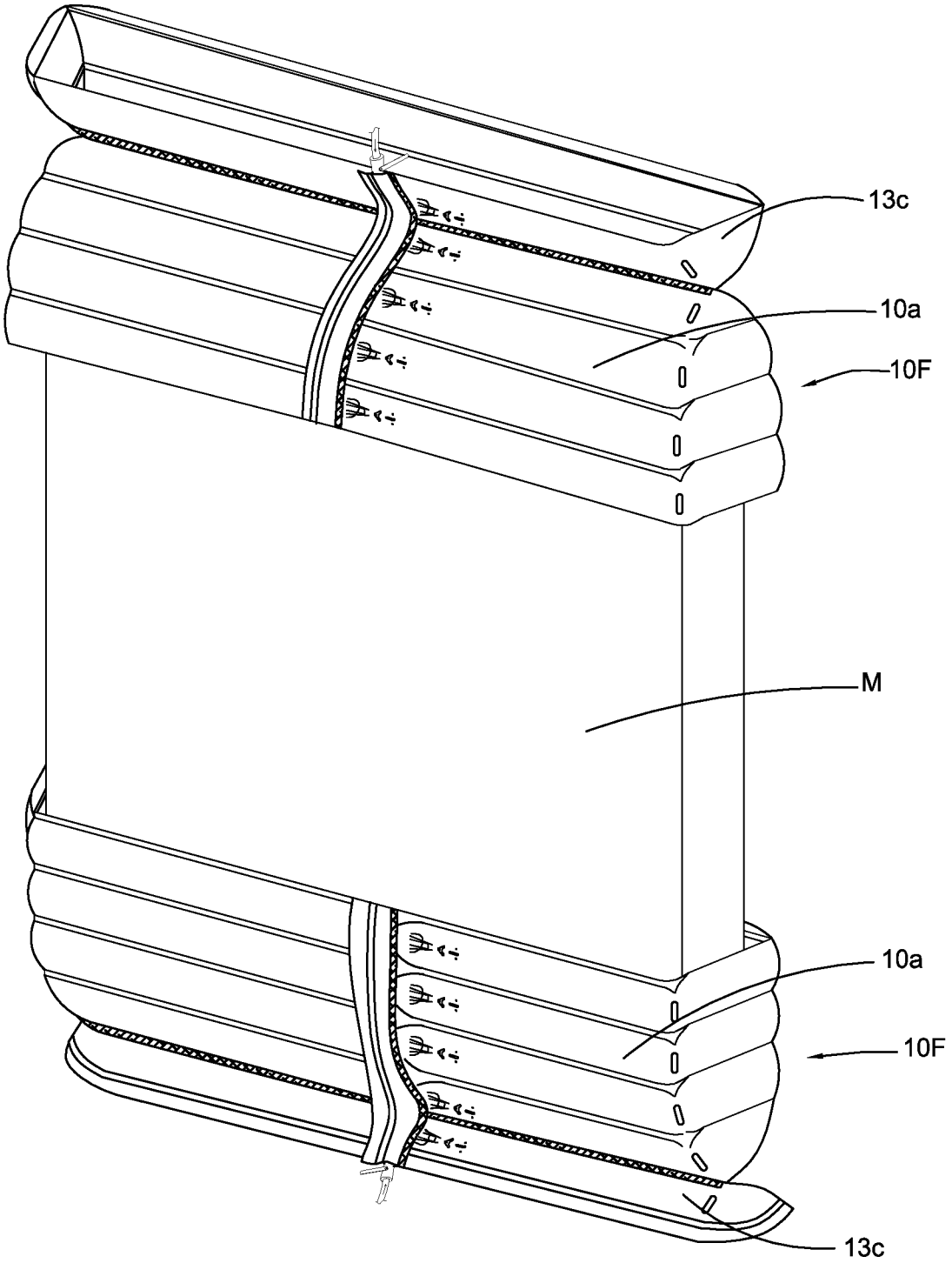
FIG. 21 is a perspective view of the air-filling packaging apparatus being utilized to package a object according to a third preferred embodiment of the present invention.

It is worth mentioning that the multistage cushioning air-filling packaging apparatus of the present invention can be utilized to accommodate the object M in the accommodating chamber 108F of the outer bag portion 10*b*. For example, a multistage cushioning air-filling packaging apparatus can be utilized to accommodate an object M in the inside thereof and match with other packing case or packaging box to store or transport the object M. According to the application of this preferred embodiment illustrated in FIG. 21, the object M can be packaged by coupling two of the multistage cushioning air-filling packaging apparatuses. In other words, the present invention provides a packaging assembly, which comprises two of the multistage cushioning air-filling packaging apparatuses, wherein two extremities of the object M are respectively accommodated in an accommodating chamber 108F of the outer bag portion 10*b* of the multistage cushioning air-filling packaging apparatus, wherein the entire package is put in other packing case or packaging box for storing or transporting the object M. Besides, the structure of the multistage cushioning air-filling packaging apparatus according to the present invention can significantly enhance the cushioning performance in all sides, so as to prevent the object M from being damaged by external impact or shock.

Figure 22:
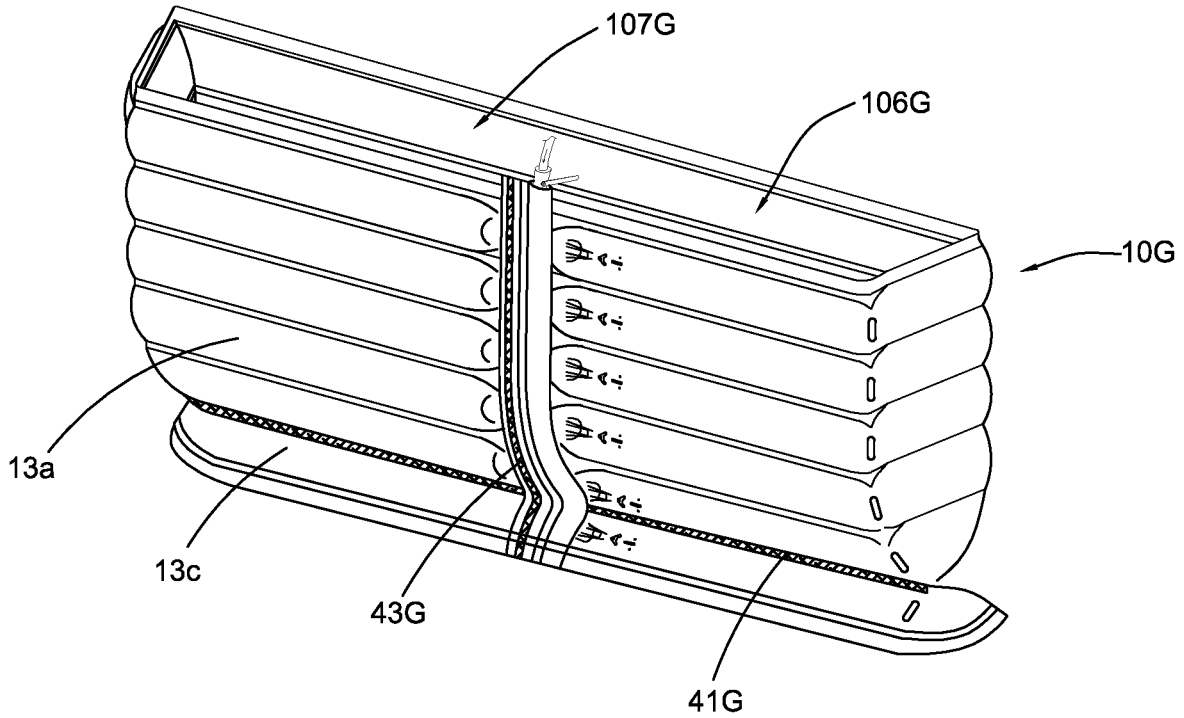
FIG. 22 is a perspective view of the air-filling packaging apparatus without inner bag portion according to an alternative mode of the above third preferred embodiment of the present invention.
Figure 23:
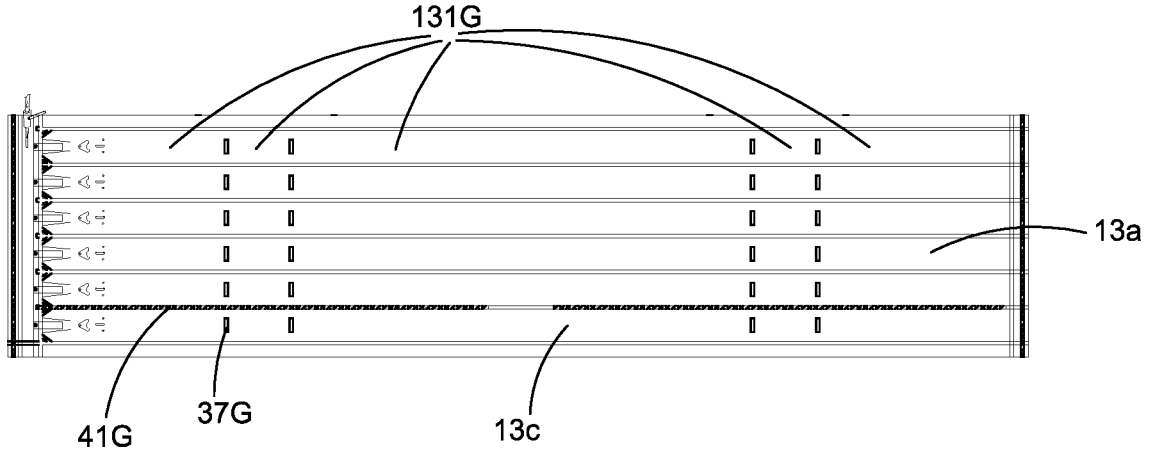
FIG. 23 is a perspective view illustrating that the uninflated air-filling packaging apparatus without inner bag portion is expanded in a plane manner according to another alternative mode of the above third preferred embodiment of the present invention.

FIGS. 22-23 illustrate an alternative mode of the above third preferred embodiment of the present invention. According to this alternative mode, the inner bag portion 10*b* can also be removed from the above third preferred embodiment. Referring to the figure, the air cushion body 10G forms a plurality of the air-storing units 13G, where the air-storing units 13G for forming the cavity 106G are defined, such that a packaging body is formed. Besides, the reinforcing cushion unit 13*c* is formed by one or more of the air-storing units 13G on the bottom side through the transverse heat-sealing seam 41G on the bottom side.

According to this embodiment, the transverse heat-sealing seam 41G on the bottom side seals on the bottom side of the 3D packaging bag formed by the multistage cushioning air-filling packaging apparatus. Nonetheless, the other side of the 3D packaging bag does not require the arrangement of another transverse heat-sealing seam 42F, such that the opening 107G can be formed on the top side of the 3D packaging bag. The object is then able to be directly put into the cavity 106G through the opening 107G.

Similarly, each of the air-storing units 13G is divided into a plurality of communicated sub-air-storing units 131G through a plurality of the dividing seams 37G, so as to form a plurality of side walls, wherein the front and rear side walls are not equally long, such that the left and right side walls can be inclinedly extended, which can reinforce the cushioning performance of the left and right sides. The reinforcing cushion unit 13*c* of the bottom side can enhance the cushioning performance of the bottom side.

It is understandable that because the transverse heat-sealing seam 41G heat-sealedly connects the front and rear side walls, a buffer space is formed among the adjacent air-storing units 13*a* on the left and right sides and the reinforcing cushion unit 13*c*, such that the reinforcing cushion unit 13*c* gain a deformation space based on the establishment of the buffer space, which enhances the cushioning function on the bottom side. Further, when the reinforcing cushion unit 13*c* is a relatively large diameter air chamber unit and the adjacent air-storing unit 13*a* is a relatively small diameter air chamber unit, the buffer space will be increased, so as to provide more deformation space for the reinforcing cushion unit 13*c*.

In addition, when the bottom side of the packaging body formed by the air-storing units 13*a* is a small diameter air chamber unit, which means what next by the transverse heat-sealing seam 41G and in the inner side thereof is a small diameter air chamber unit and what in the two sides of the small diameter air chamber unit are large diameter air chamber units, due to the tautening of connection between the front and back side walls by the transverse heat-sealing seam 41G, the small diameter air chamber unit will be hidden between the large diameter air chamber units on the two sides thereof. Therefore, the small diameter air chamber unit will not be affected by external impact or shock, so as to further enhance the cushioning performance on the bottom side of the 3D packaging bag formed by the multistage cushioning air-filling packaging apparatus.

Figure 24:
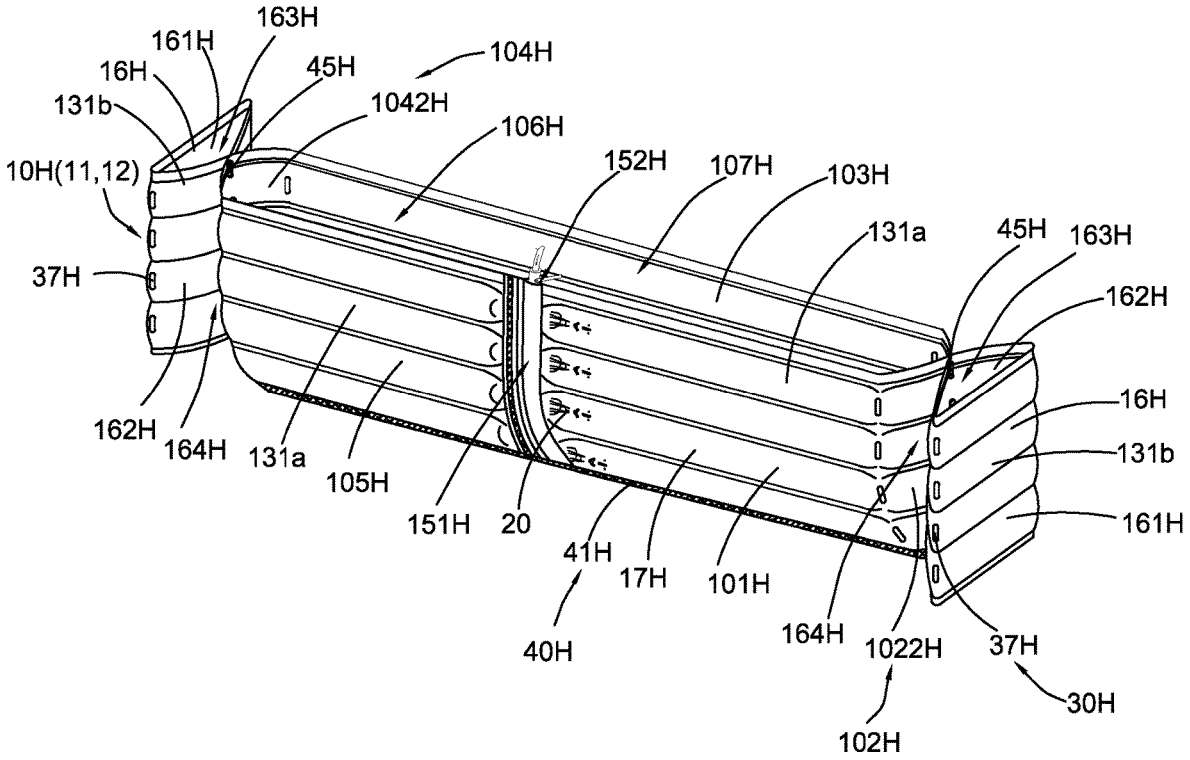
FIG. 24 is a 3D perspective view of the air-filling packaging apparatus according to a fourth preferred embodiment of the present invention.
Figure 25:
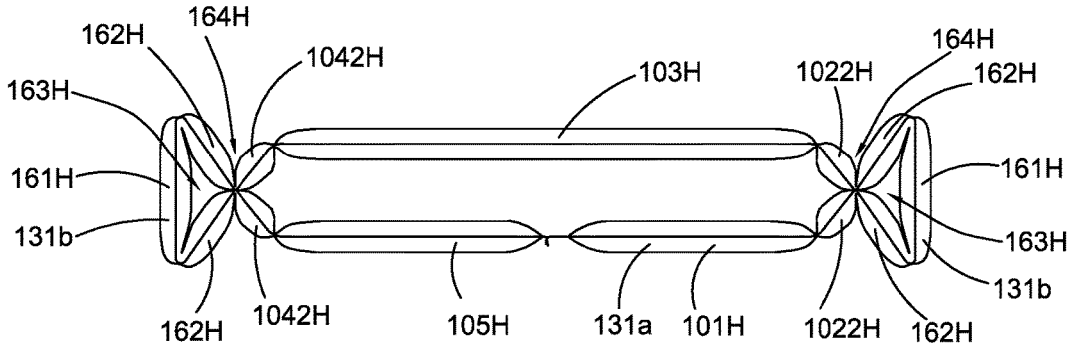
FIG. 25 is a sectional view of the inflated air-filling packaging apparatus according to the above fourth preferred embodiment of the present invention.
Figure 26:
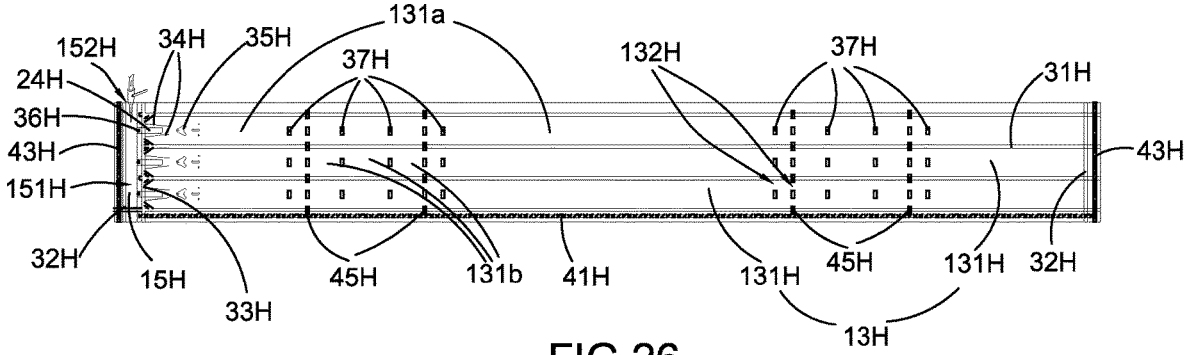
FIG. 26 is a perspective view illustrating the uninflated air-filling packaging apparatus being expanded in a plane manner according to the above fourth preferred embodiment of the present invention.

FIGS. 24-26 illustrate the air-filling packaging apparatus according to a fourth preferred embodiment of the present invention. According to the this preferred embodiment, the air-filling packaging apparatus comprises at least an air cushion body 10H. Namely, either one of the air cushion body 10H forms a 3D packaging bag or a plurality of the air cushion bodies 10H form the 3D packaging bag through heat-sealing connecting, such as adhesive bonding, heat-sealing, and etc. The embodiment illustrated in FIGS. 24-26 is formed by one air cushion body 10H. More specifically, referring to FIG. 71A, the air cushion body 10H comprises at least two air chamber films 11 and 12 forming the 3D packaging bag comprising one or more interconnected air-storing units 13H through a series of 2D heat-sealing seams 30H and 3D heat-sealing seams 40H, wherein each of the air-storing units 13H forms an air storage chamber 14 that is able to store gas therein, which is similar with it in the above first embodiment.

Person skilled in the art should be able to understand that the 2D heat-sealing seams 30H are for heat sealing the multiple films into a 2D cushion material, as is illustrated in FIG. 26. The 3D heat-sealing seams 40H are additional heat-sealing on the above 2D cushion material to make the air-filling packaging apparatus into a 3D packaging device that has a 3D structure and can accommodate the object, as FIG. 24 illustrate. The 2D heat-sealing seams 30H and the 3D heat-sealing seams 40H can connect multiple layers of films together through adhesive bonding, heat-sealedly connection, and etc. Preferably, according to this embodiment, the 2D heat-sealing seams 30H and the 3D heat-sealing seams 40H are both formed through heat-sealing technology.

More specifically, the 2D heat-sealing seams 30H comprise a plurality of dividing seams 31H dividing the two air chamber films 11 and 12 into a plurality of the air-storing units 13H. Preferably, each row of the dividing seams 31H is formed by heat-sealing technology that heat-sealedly connects two layers of the air chamber films 11 and 12 so as to form a row of the dividing seam 31H between two adjacent air-storing units 13H. The dividing seam 31H may be an continuous heat-sealed line so as to have a plurality of the air-storing units 13H be independent to one another. It is understandable that the dividing seam 31H on the top side and the bottom side can respectively become a top side boundary seam and a bottom side boundary seam of the air cushion body 10H, as FIG. 26 illustrate. The dividing seam 31H may also be an intermittent heat-sealed line so as to have a plurality of the air-storing units 13H be interconnected. The air-storing unit 13H can be in various shape, such as linear, circular, polygon, irregular, and etc. Referring to FIGS. 24-26, the air cushion body 10H according to the present invention may comprise a plurality of air-storing pillars abreast arranged, but the present invention shall not be limited thereto.

According to this preferred embodiment, referring to FIG. 71A, the air cushion body 10H further comprises an inflation valve 20 formed by at least two valve films 21 and 22. The two valve films 21 and 22 of the inflation valve 20 and the air chamber films 11 and 12 are overlappedly arranged. Besides, an air inlet channel 23 is formed between the valve films 21 and 22 for inflating to the air storage chamber 14. It is understandable that the lengths of the valve films 21 and 22 are shorter than the lengths of the air chamber films 11 and 12. When the air storage chamber 14 is inflated via the air inlet channel 23 and the air pressure in the air storage chamber 14 has attained the predetermined required value, the air pressure in the air storage chamber 14 will act on the valve films 21 and 22 so as to attach the valve films 21 and 22 on one of the air chamber film, which closes the air inlet channel 23 and makes the inflation valve 20 serve as a one-way valve. When each air-storing unit 13H has at least an air inlet channel 23 formed therein and each of the air-storing units 13H is independent to one another, even if one of the air-storing units 13H is damaged and leaks, the rest of the air-storing units 13H will not be affected, but still serve to provide the air cushion performance.

It is understandable that the air chamber films 11 and 12 of the air cushion body 10H and the valve films 21 and 22 of the inflation valve 20 can respectively be made of various suitable membrane materials, such as polyethylene film, polypropylene film, polyvinyl chloride film, polyester film, polystyrene film, composite film, and etc, wherein the present invention shall not be limited thereto, as long as suitable flexible films is utilized. It is worth mentioning that in order to enhance the one-way sealing function, the valve films 21 and 22 of the inflation valve 20 can also be self-adhesive films acquired by adding chemical composition to the above films.

The air cushion body 10H further comprises a main channel unit 15H connected with each of the air-storing units 13H or, preferably, integrally extended from each of the air-storing units 13H. More specifically, according to this preferred embodiment, the extending directions of the main channel unit 15H and the air-storing unit 13H are perpendicular to each other. For example, according to this embodiment, each the air-storing unit 13H is extended along a transverse and horizontal direction, while the main channel unit 15H is extended along a longitudinal direction. The main channel unit 15H forms a main channel 151H that has an inflation inlet 152H. When the inflation inlet 152H has an inflation nozzle arranged thereat for conducting an inflation process, gas will enter the main channel 151H from the inflation inlet 152H along a longitudinal direction, and enter each the air-storing unit 13H along a transverse direction. Then, when the air pressure of each the air storage chamber 14 reaches a predetermined value, the valve films 21 and 22 of the inflation valve 20 will attached on one of the air chamber films 11 and 12, so as to self-seal and prevent the inflated gas from reversing into the main channel 151H.

It is worth mentioning that, it is understandable that the main channel unit 15H can be formed by two layers of the air chamber films 11 and 12, two layers of the valve films 21 and 22, or either one layer of the air chamber films 11 and 12 and either one layer of the valve films 21 and 22.

Referring to FIG. 26, the 2D heat-sealing seams 30H further comprise a continuously sealed edge sealing seam 32H respectively on the left and right sides and a continuously sealed main channel sealing seam 33H on the left side of the air cushion body 10H, wherein the main channel 151H is formed between the left edge sealing seam 32H and the main channel sealing seam 33H. It is understandable that the edge sealing seam 32H is formed through heat-sealing technology, such as adhesive bonding, heat-sealing, and etc., to sealingly connect the two air chamber films 11 and 12. The main channel sealing seam 33H is formed through heat-sealing technology, such as adhesive bonding, heat-sealing, and etc., to sealedly connect the two air chamber films 11 and 12 and the two valve films 21 and 22 respectively, as FIG. 71A illustrate. For example, the main channel sealing seam 33H on the up and down sides that was formed through a first heat-sealing technology respectively heat-sealedly connects the air chamber film 11 and the valve film 21 and heat-sealedly connects the air chamber film 12 and the valve film 22.

Referring to FIG. 26, each the air-storing unit 13H comprises two spaced gas duct seams 34H adjacent to the main channel 151H and formed through heat-sealedly connecting the air chamber films 11 and 12 and the valve films 21 and 22. The air inlet channel 23 formed by the valve films 21 and 22 are arranged between the two gas duct seams 34H.

Referring to FIG. 71A, the valve films 21 and 22 are further heat-sealedly connected with the air chamber film 11 through a plurality of connecting seams 35H, such that when the air pressure in the air storage chamber 14 attained a predetermined value, the air pressure will act on the valve films 21 and 22 and because of the arrangement of the connecting seams 35H, the valve films will be pushed toward the air chamber film 11 and eventually be attached on the air chamber film 11, so as to close the air inlet channel 23. That is to say, the connecting seam 35H heat-sealedly connects the two valve films 21 and 22 and the air chamber film 11. Besides, referring to FIG. 26, the shape of each the connecting seam 35H allows it to further prevent the air from backflow. In other words, when the air in the air storage chamber 14 is going to flow back, it will be obstructed by the connecting seam 35H and cannot return into the main channel 151H easily.

In addition, when the 2D heat-sealing seams 30H are being formed through heat-sealing, the air inlet channel 23 of the valve films 21 and 22 of the inflation valve 20 can be formed through the arrangement of a heatproof barrier device. Then the heatproof barrier device can be removed after the heat-sealing process. According to this embodiment, referring to FIGS. 26 and 71A, a heatproof layer 24 is arranged between the valve films 21 and 22 of the inflation valve 20 and attached with the inner surface of one of the valve films 21 and 22. The heatproof layer 24 can be embodied as thermostable inks and etc. As a result, when the main channel sealing seam 33H is formed through heat-sealing, the two valve films 21 and 22 will not be heat-sealedly connected, such that the air inlet channel 23 can be connected with the main channel 151H and the access thereof will not be closed due to the heat-sealing.

According to this preferred embodiment, the main channel 151H is formed by the two air chamber films 11 and 12, the heatproof layer 24 and the valve films 21 and 22 respectively have extending section extended into the main channel 151, and the 2D heat-sealing seams 30 further comprise a joint seam 36H longitudinally and spacingly arranged at the position corresponding to the extending section of the heatproof layer 24. Because of the arrangement of the heatproof layer 24, the joint seam 36H respectively connects the two air chamber films 11 and 12 and the two valve films 21 and 22, while the two valve films 21 and 22 are not heat-sealedly connected with each other. The arrangement of the joint seam 36H allows adjacent valve films 21 and 22 and the correspondingly connected air chamber films 11 and 12 to be expanded together to open the corresponding air inlet channel 23 when air enters the main channel 151H during the inflation of the air cushion body 10.

The 2D heat-sealing seams 30H further comprise a plurality intermittent bending seams 37H, wherein the inflated air cushion body 10H is adaptable for bending along the bending seams 37H, such that the air cushion body 10H can form a plurality of side walls. More specifically, the bending seam 37H divides each the air-storing unit 13 into a plurality of sub-air-storing units 131H. The bending seam can be arranged in the middle of the air-storing unit 13H and respectively form a connecting channel 132H on the two sides thereof, such that the adjacent sub-air-storing units 131H can be interconnected and communicated, as FIG. 26 illustrated. It is understandable that the bending seam 37H can also be arranged on the two sides of the air-storing units 13H, while the connecting channel 132H is arranged in the middle of the air-storing units 13H. Correspondingly, it is understandable that each the bending seam 37H heat-sealedly connects two layers of the air chamber films 11 and 12.

Further, according to the embodiment illustrated in FIGS. 24-26, the 2D heat-sealing seams 30H comprise eight rows of the bending seams 37H, such that the air cushion body 10H is adaptable for being bent along the eight bending seams 37H to form the right front side wall 101H, right side wall 102H, rear side wall 103H, left side wall 104H, and left front side wall 105H. The above mentioned side walls 101-105H are bent to form a cavity 106H with an opening 107H on the top side thereof. Namely, the side walls 101-105H are surroundingly arranged and the air-storing units 13H respectively form a ringlike air-storing pillar.

Correspondingly, referring to FIGS. 24 and 26, the 3D heat-sealing seams 40H comprises a transverse heat-sealing seam 41H on the bottom side heat-sealing and connecting the bottom sides the front side walls 101H and 105H and the rear side wall 103H, so as to seal off the bottom side of the multistage cushioning air-filling packaging apparatus. The 3D heat-sealing seams 40H further comprise a longitudinal end sealing seam 43H heat-sealedly connecting the right front side wall 101H and the left front side wall 105H along the longitudinal direction which means the air cushion body 10H is circularly arranged and the head and tail thereof are connected. Thus, the air cushion body 10H is able to form a 3D packaging bag having the cavity 106H through the transverse and horizontal heat-sealing seam 41H and the end sealing seam 43H that heat-sealedly connect multiple layers of films, as FIG. 24 illustrate.

According to this preferred embodiment of the present invention, the 3D heat-sealing seams 40H further comprise a section sealing seam 45H respectively formed on the two sides of the air cushion body 10H, which are respectively embodied as an intermittent heat-sealed seam, so as to form a flank cushion portion 16H respectively on the two sides of the multistage cushioning air-filling packaging apparatus. Referring to FIG. 24, the sub-air-storing unit 131H in the middle forms a packaging body 17H having the flank cushion portion 16H respectively integrally extended from the two sides thereof, where air may flow thereamong. The packaging body 17H forms the cavity 106H for packaging the object, while the flank cushion portions 16H on the two sides are for enhancing side cushioning function. In other words, the flank cushion portion 16H provides a first cushioning function on a side and the packaging body 17H provides another level of air cushioning function, such that the 3D packaging bag formed by the air cushion body 10 according to this preferred embodiment of the present invention can provide cushioning function in a multistage manner.

When the air cushion body 10H is formed by two layers of the air chamber films 11 and 12, the section sealing seam 45H heat-sealedly connects four layers of the films respectively, which means that it heat-sealedly connects two of the air chamber films 11 and 12 of the front and back sides respectively along a longitudinal direction, as FIGS. 24 and 26 illustrate. It is understandable that the section sealing seam 45H is embodied as an intermittent heat-sealed seam, so as to allow air communication between the flank cushion portion 16H and the packaging body 17H or, in other words, form the connecting channel 132H therebetween, such that the flank cushion portion 16H and the packaging body 17H can be inflated together in an inflation process. Besides, it is worth mentioning that the section sealing seam 45H can be arranged either in the middle portion of the air-storing unit 13H or the two sides thereof and integrally connected with the dividing seams 31H of the two sides, where the present invention shall not be limited here.

Moreover, it should be noted that though FIG. 26 illustrated the 2D cushion material formed through heat-sealing of the 2D heat-sealing seams 30H, it also illustrates the position of the 3D heat-sealing seams 40H, such that one may understand the forming process of the 3D packaging bag more easily.

It is worth mentioning that the transverse heat-sealing seam 41H can be located at the dividing seam 31 on the bottom side of the air cushion body 10H or be formed with the dividing seam 31H through a first heat-sealing process at the same time. According to the embodiment illustrated in FIG. 26, the heat-sealing seams 41H can be independent heat-sealed seams respectively formed on the bottom and top edges of the air cushion body 10H instead of being arranged at the dividing seam 31 of the bottom side. The longitudinal end sealing seam 43 can be arranged near by the edge sealing seam 32H of the main channel 151H or be formed with the edge sealing seam 32H of the end sealing seam 43H at once through a first heat-sealing. Alternatively, it can also be an independent heat-sealed seam arranged on the outer edge of the edge sealing seam 32H. When it was arranged in the inner side of the edge sealing seam 32H, the main channel 151H will be formed between the end sealing seam 43H and the main channel sealing seam 33H. Alternatively, the longitudinal end sealing seam 43 can be arranged at the position of or near by the main channel sealing seam 33H. The present invention shall not be limited here, as long as the head and tail of the air cushion body 10 is connected. Besides, the sealing seam can either be continuous or spaced.

More specifically, referring to FIGS. 24 and 26, according to this preferred embodiment, the right side wall 102H comprises two sub-right side walls 1022H, while the left side wall 104H also comprises two sub-left side walls 1042H. Referring to FIG. 26, it is described from the left to the right as follows for the convenience of description. The sub-air-storing unit 131H in the left of the first row of the bending seam 37H is for forming the right front side wall 101H. One the sub-right side wall 1022H is respectively formed between the first row and fourth row of the bending seams 37H and the first row of the section sealing seam 45H. According to the stretch-out view as is illustrated in FIG. 26, the first row of the section sealing seam 45H is expanded and divided into two rows, where the flank cushion portion 16H of the right side is formed between the two rows. The rear side wall 103H is formed between the fourth row and the fifth row of the bending seams 37H. One the sub-left side wall 1042H is formed between the fifth row and eighth row of the bending seams and the second row of the section sealing seam 45H respectively. Moreover, the second row of the section sealing seam 45H, according to the stretch-out view as FIG. 26 illustrated, is expanded and divided into two rows, where the flank cushion portion 16H of the left side is formed between the two rows and the left front side wall 105 is formed by the right side of the eighth row of the bending seam.

It is understandable that the side walls 101-105H are respectively formed by the sub-air-storing units 131H integrally extended from the air-storing unit 13H along the length direction thereof. It is understandable that the quantity of the bending seam 37H can be determined based on the needs. According to other embodiments, it is possible to have no bending seam 37H, more bending seams 37H, or less bending seams 37H arranged. According to this preferred embodiment of the present invention, a plurality of packaging body main air-storing units 131*a* and a plurality of flank air-storing units 131*b* are formed by a plurality of sub-air-storing units 131H arranged along the length direction. According to this preferred embodiment, each the air-storing unit is divided into seven of the packaging body main air-storing units 131*a* and six of the flank air-storing units 131*b* along the length direction.

Referring to FIG. 25, according to this embodiment of the present invention, each the flank cushion portion 16H is formed by three flank air-storing units 131*b*, so as to respectively form a cushion base 161H and two cushion waists 162H integrally extended from the two sides of the cushion base 161H, such that the cross section of each the flank cushion portion 16H is mostly triangular, so as to enhance the cushioning performance. Besides, a buffer gap 163H is formed between the cushion base 161H and the two cushion waists 162H and a buffer space 164H is respectively formed between the left and right side walls of the packaging body 17H and the flank cushion portion 16H based on the arrangement of the section sealing seams 45H between the flank cushion portion 16H and the packaging body 17H. In other words, the arrangement of the buffer gap 163H and the buffer space 164H provides deformation space for the flank cushion portion 16H, so as to enhance the elastic restitution performance of the flank cushion portion, instead of have it transfer the impact force received on the side to the object in the inside. Besides, it is understandable that the buffer gap 163H may also be utilized for accommodating the accessories of the object. For instance, if the object is a laptop, the buffer gap 163H can be utilized for accommodating its accessories, such as power core, mouse, and etc.

It is understandable that when the lengths of the left side wall 104H and right side wall 102H are shorter, they can be hidden among the front and rear side walls 101H and 105H and 103H and the flank cushion portion 16H, such that the left side wall 104H and right side wall 102H will not have to bear external impacts. As a result, the cushioning performance of the multistage cushioning air-filling packaging apparatus can be further enhanced.

It is worth mentioning that the flank cushion portion 16H shall not be limited in a triangle shape illustrated in FIGS. 24-35. Rather, it may also be embodied into other shapes. For instance, if there is no dividing seam 37H, it can be in mostly an arc shape. If there are three bending seams 37H arranged, the cross section thereof may have some polygon structure. Alternatively, it may have an irregular heat-sealed seam arranged thereon so as to form other irregular shape, as long as it can form an inflatable structure to provide air cushioning function.

Referring to FIG. 24, when utilizing the multistage cushioning air-filling packaging apparatus according to this embodiment of the present invention, an inflation nozzle of an air pump has to be put in the inflation inlet 152H of the top side to conduct the inflation process. The air will enter the main channel 151H, proceed rightward to respectively and successively enter the sub-air-storing unit 131*a* of the right front side wall 101H, the sub-air-storing unit 131*a* of the sub-right side wall 1022H, and the sub-air-storing unit 131*b* of the flank cushion portion 17H of the right, turn backward to respectively and successively enter the sub-air-storing unit 131*a* of the sub-right side wall 1022H of the back side, the sub-air-storing unit 131*a* of the rear side wall 103H, the sub-air-storing unit 131*a* of the sub-left side wall 1042H of the back side, and the sub-air-storing unit 131*b* of the flank cushion portion 17H of the left side, and enter the sub-air-storing units 131*a* of the left front side wall 105H and the sub-left side wall 1042H of the front side, so as to finish the inflation. The self-sealing function can keep the air stored in each the air-storing unit 13H, so as to make an inflated 3D packaging bag. The object can be put into the cavity 106H via the opening 107H, such that the 3D packaging bag can provide air cushioning function for the object.

FIGS. 27-31 illustrate a multistage cushioning air-filling packaging apparatus according to a fifth preferred embodiment of the present invention, which has a similar structure with the above fourth preferred embodiment. Nonetheless, the differences include that the air cushion body 10I forms an inner bag portion 10*b* and an outer bag portion 10*a*, wherein the inner bag portion 10*b* is suitable for being arranged in the outer bag portion 10*a*, such that the inner bag portion 10*b* and the outer bag portion 10*a* can provide cushioning function in a multistage manner.

More specifically, the air cushion body 10I is divided into a plurality of transverse extended air-storing units 13I through a series of transverse extended dividing seams 31I, wherein each the air-storing unit 13I is divided along its length direction into a plurality of sub-air-storing units 131I through a plurality of bending seams 37I.

Figure 27:
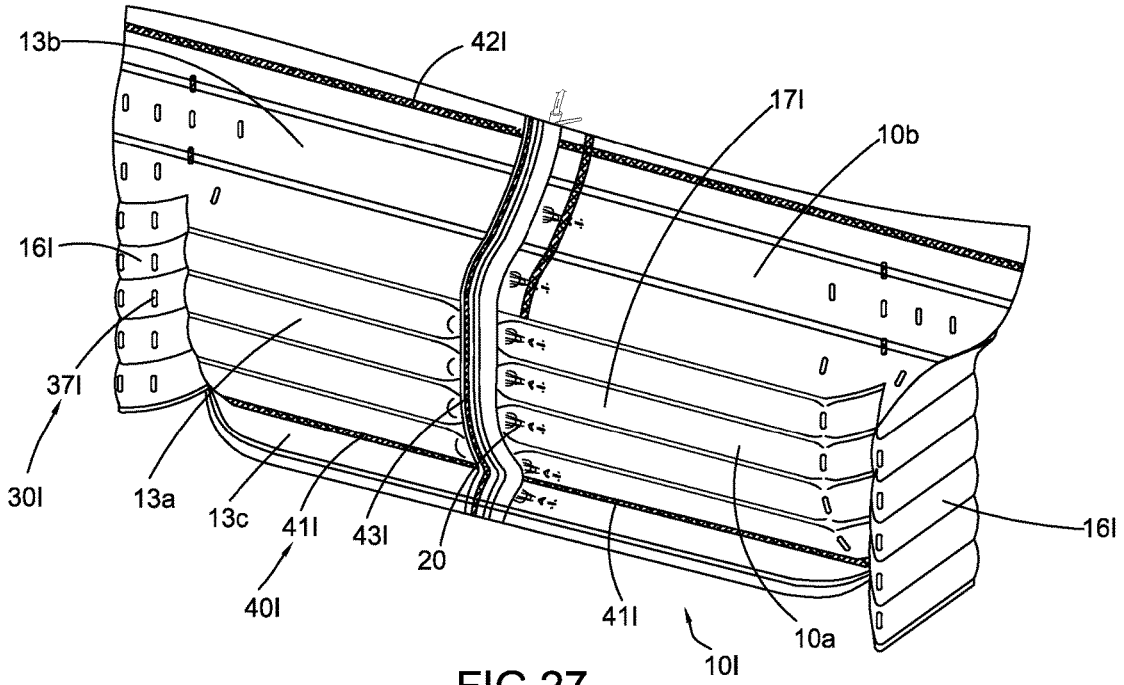
FIG. 27 is a 3D perspective view of the air-filling packaging apparatus according to a fifth preferred embodiment of the present invention.
Figure 29:
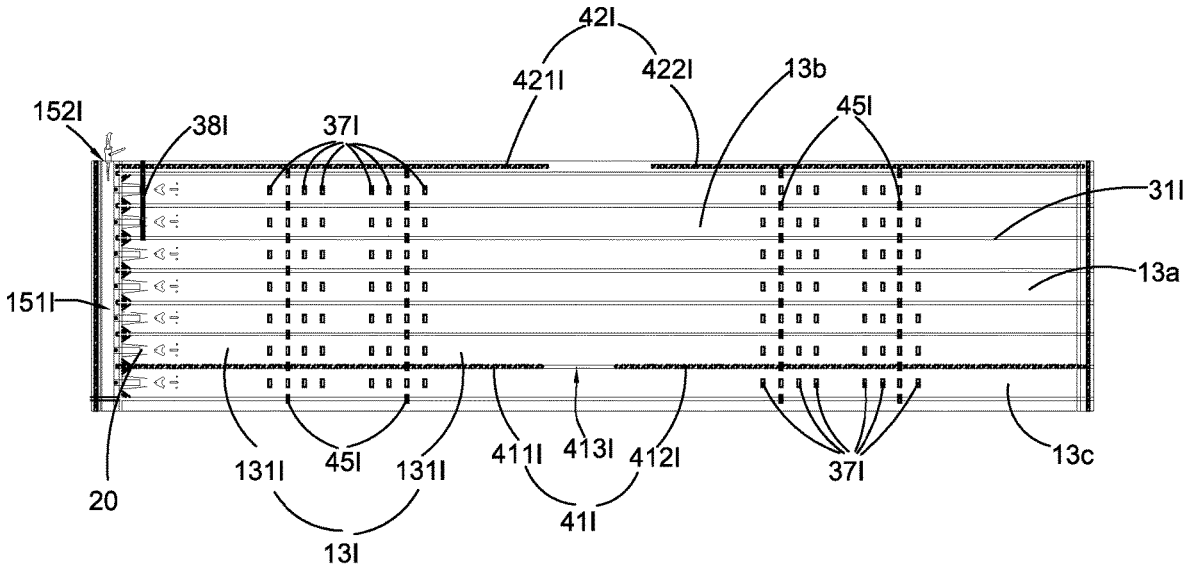
FIG. 29 is a perspective view illustrating the uninflated air-filling packaging apparatus being expanded in a plane manner according to the above fifth preferred embodiment of the present invention.

Referring to FIGS. 27 and 29, the 2D heat-sealing seams 30I further comprises a choke seam 38I sealing off the air inlet channel of the two air-storing units 13I, as the figure illustrate, of the air-storing units 13I on the top side of the air cushion body 10I. Namely, the choke seam can be arranged adjacent to the tail of the air inlet channel 23 to heat-sealedly connect the two air chamber films 11 and 12 and the two valve films 21 and 22, so as to make each the air-storing unit 13I uninflatable and form non-inflated air-storing pillar.

Correspondingly, the arrangement of the choke seam 38I can divide a plurality of transversely extended air-storing units 13 into a plurality of inflatable air-storing units 13*a* and a plurality of uninflatable air-storing units 13*b* arranged longitudinally. For instance, referring to FIG. 29, the two air-storing units on the top side are uninflatable, which are, according to this embodiment of the present invention, to form an inner bag portion 10*b*, while the four inflation units 13*a* on the bottom side are inflatable, so as to form an outer bag portion 10*a*. In other words, according to this preferred embodiment of the present invention, it provides cushioning function in a multistage manner through the inflatable outer bag portion 10*a* and the non-inflated inner bag portion 10*b*.

Figure 28:
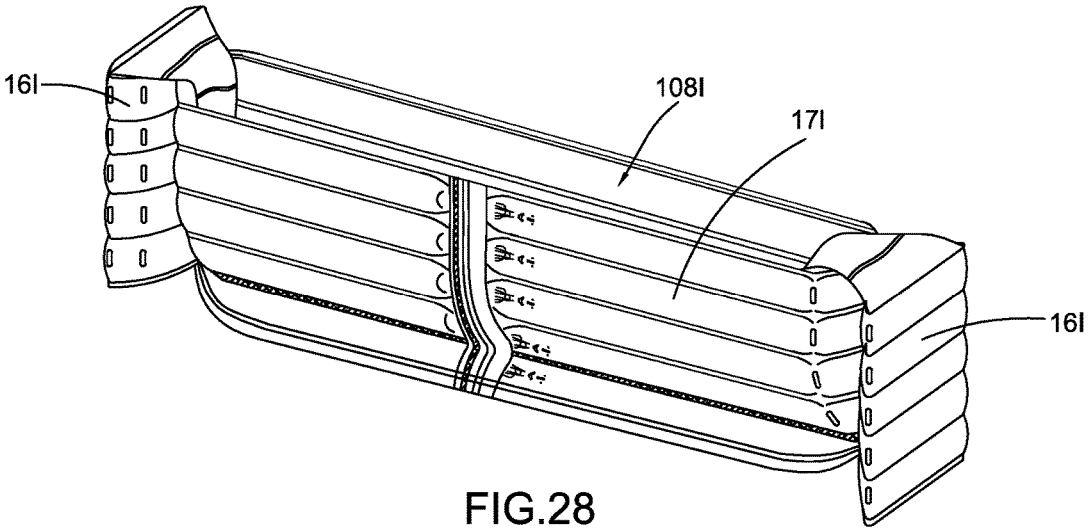
FIG. 28 is a perspective view of the air-filling packaging apparatus according to the above fifth preferred embodiment of the present invention, where the inner bag portion is tucked into the outer bag portion.
Figure 30:
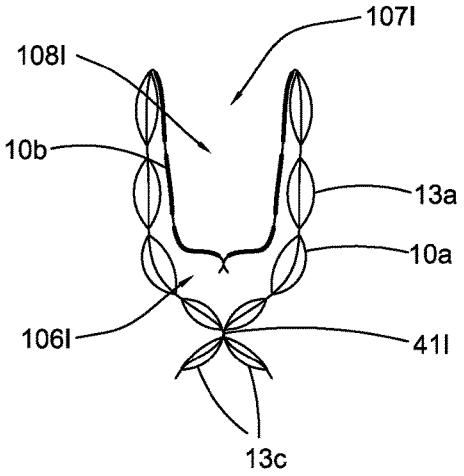
FIG. 30 is a side sectional view of the inflated air-filling packaging apparatus according to the above fifth preferred embodiment of the present invention.
Figure 31:
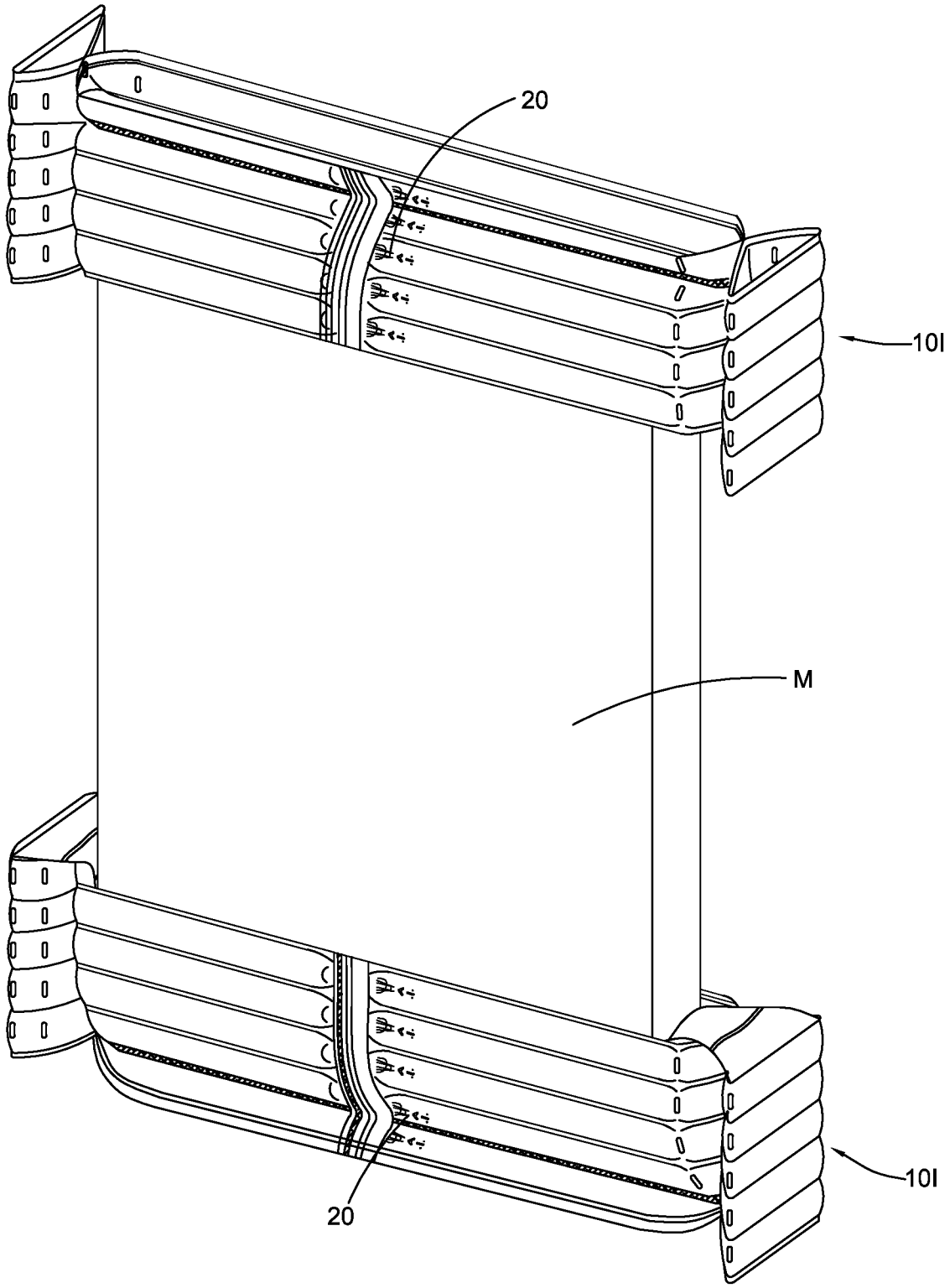
FIG. 31 is a perspective view of the air-filling packaging apparatus being utilized to package a object according to a fifth preferred embodiment of the present invention.

The inner bag portion 10*b* is adaptable to be tucked into the cavity 106I of the outer bag portion 10*a* so as to form an accommodating chamber 108I, as FIGS. 28 and 30 illustrate. Thus, the inner bag portion 10*b* is adapted for accommodating the object M. Then the inner bag portion 10*b* that accommodates the object therein is further put in the cavity 106I of the outer bag portion 10*a*, such that the outer bag portion 10*a* can provide a level of cushioning function through air cushioning, while the inner bag portion 10*b* can provide another level of cushioning function. Therefore, impact or shock acting on the outer bag portion 10*a* cannot be directly transferred to the object M and shaking and impact of the object M will not be directly transferred to the outer bag portion 10*a* to damage the outer bag portion 10*a*. That is to say, the outer bag portion 10*a* and the inner bag portion 10*b* are coupled to provide cushioning function in a multistage manner.

It is worth mentioning that when the inner bag portion 10*b* is utilized for loading the object, after the outer bag portion 10*a* is inflated, the external surface of the inner bag portion 10*b* may or may not attach with the inner surface of the outer bag portion 10*a*. Preferably, according to this embodiment, the inner bag portion 10*b* is suspended in the cavity of the outer bag portion 10*a*. In other words, there is a buffer gap between the inner bag portion 10*b* and the outer bag portion 10*a*, which further enhances the cushioning performance. In other words, when the air-storing units 13 of the outer bag portion 10*a* are collided or impacted from the outside, the buffer gap can provide a deformation space for the air-storing units 13I, so as to prevent the impact force that acts on the air-storing units 13I from being directly transferred to the object.

Further, the outer bag portion 10*a* and the inner bag portion 10*b* can be heat-sealedly connected. Preferably, according to this embodiment, the outer bag portion 10*a* and the inner bag portion 10*b* are integrally formed. That is to say, they are both formed by integrally extending the same air chamber films and valve films. The outer bag portion 10*a* and the inner bag portion 10*b* are longitudinally arranged and the inner bag portion 10*b* can be tucked into the outer bag portion 10*a*, such that the inner bag portion 10*b* in the outer bag portion 10*a* not only serves to package the object, but also further enhance the cushioning function. When there are external impact and shock acting on the outer bag portion 10*a*, the inner bag portion 10*b* can prevent the object from shaking and stress concentration due to being stuck at a corner.

Similarly, the 3D heat-sealing seams 40I further comprises two intermittent section sealing seams 45I arranged on the two sides of the air cushion body 10I and connecting the front and back sides thereof, so as to turn the air cushion body 10I of the ringlike arranged air-storing units 13I into a packaging body 17I and two flank cushion portion 16I. According to this preferred embodiment, each flank cushion portion 16I comprises four bending seams 37I arranged thereon, such that the part of each the air-storing unit 13I here is divided into five sub-air-storing units 131I. Namely, the cushion waist of the above embodiment is further divided into a plurality of cushion side walls.

In addition, according to this preferred embodiment, the transverse heat-sealing seam 41I of the bottom side of the 3D heat-sealing seams 40I is arranged between two the adjacent air-storing units 13I on the bottom side, so as to respectively form the air-storing unit 13*a* and the reinforcing cushion unit 13*c* on the two sides of the transverse heat-sealing seam 41I. The reinforcing cushion unit 13*c* provides reinforced cushioning function on the bottom side.

It is understandable that because the transverse heat-sealing seam 41I heat-sealedly connects the front and rear side walls, a buffer space is formed among the adjacent air-storing units 13*a* on the left and right sides and the reinforcing cushion unit 13*c*, such that the reinforcing cushion unit 13*c* gain a deformation space based on the establishment of the buffer space, which enhances the cushioning function on the bottom side. Further, when the reinforcing cushion unit 13*c* is a relatively large diameter air chamber unit and the adjacent air-storing unit 13*a* is a relatively small diameter air chamber unit, the buffer space will be increased, so as to provide more deformation space for the reinforcing cushion unit 13*c*.

In addition, when the bottom side of the packaging body formed by the air-storing units 13*a* is a small diameter air chamber unit, which means what next by the transverse heat-sealing seam 41I and in the inner side thereof is a small diameter air chamber unit and what in the two sides of the small diameter air chamber unit are large diameter air chamber units, due to the tautening of connection between the front and back side walls by the transverse heat-sealing seam 41I, the small diameter air chamber unit will be hidden between the large diameter air chamber units on the two sides thereof. Therefore, the small diameter air chamber unit will not be affected by external impact or shock, so as to further enhance the cushioning performance on the bottom side of the 3D packaging bag formed by the multistage cushioning air-filling packaging apparatus.

It is understandable that the transverse heat-sealing seam 41I can be arranged on the dividing seam 31 between the corresponding air-storing unit 13*a* and the reinforcing cushion unit 13*c* or be formed on the bottom side with dividing seam 31I on the bottom side at the same time through a first heat-sealing process. It is understandable that the transverse heat-sealing seam 41I can be a continuous sealing seam or an intermittent sealing seam. Besides, when the transverse heat-sealing seam 41I and the dividing seam 31I on the bottom side are formed at once through a first heat-sealing process and the transverse heat-sealing seam 41I is a intermittent sealing seam, the air-storing units 13*a* and the reinforcing cushion unit 13*c* on the bottom side can communicate with each other, so as to provide a reinforced cushioning function on the bottom side through the flow and distribution of the air between the air-storing unit 13*a* and the reinforcing cushion unit 13*c* of the bottom side.

Besides, according to this embodiment of the present invention, the transverse heat-sealing seam 41I on the bottom side is not extended to the position of the main channel 151I, such that it will not close the main channel 151I. Referring to FIG. 29, the inflation inlet 151I can be arranged on the top side, while according to other embodiments, it can certainly be arranged on the bottom side as well. The 3D heat-sealing seams 40 further comprise a transverse heat-sealing seam 42I on the top side to connect the front and rear parts of the top side of the uninflatable inner bag portion 10*b*, such that after the entire non-inflated inner bag portion 10*b* is tucked into the outer bag portion 10*a*, the bottom side thereof is closed, but there is an opening on the top side thereof. Correspondingly, the transverse heat-sealing seam 42I comprises two heat-sealing sections 421I and 422I to form the gap at the position corresponding to the main channel 151I, where no heat-sealing connection is formed, such that the inflation inlet 152I will not be closed. Similarly, the transverse heat-sealing seam 41I on the bottom side comprises heat-sealing sections 411I and 412I to form the gap at the position corresponding to the main channel 151I, where no heat-sealing connection is formed, such that the main channel 151I will not be closed. Correspondingly, it is understandable that each of the above mentioned heat-sealing sections 411I, 412I, 421I, and 422I can be a continuous sealing seam or an intermittent sealing seam.

It is worth mentioning that the multistage cushioning air-filling packaging apparatus of the present invention can be utilized to accommodate the object M in the accommodating chamber 108I of the outer bag portion 10*b*. For example, a multistage cushioning air-filling packaging apparatus can be utilized to accommodate an object M in the inside thereof and match with other packing case or packaging box to store or transport the object M. According to the application of this preferred embodiment to illustrated in FIG. 31, the object M can be packaged by coupling two of the multistage cushioning air-filling packaging apparatuses. In other words, the present invention provides a packaging assembly, which comprises two of the multistage cushioning air-filling packaging apparatuses, wherein two extremities of the object M are respectively accommodated in an accommodating chamber 108I of the outer bag portion 10*b* of the multistage cushioning air-filling packaging apparatus, wherein the entire package is put in other packing case or packaging box for storing or transporting the object M. Besides, the structure of the multistage cushioning air-filling packaging apparatus according to the present invention can significantly enhance the cushioning performance in all sides, so as to prevent the object M from being damaged by external impact or shock.

Figure 32:
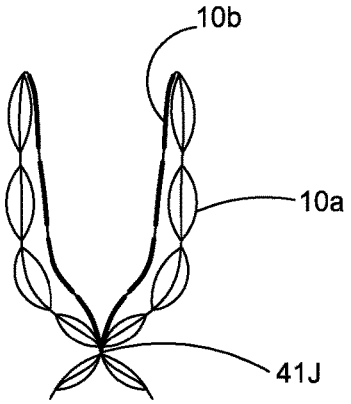
FIG. 32 is a sectional view of the air-filling packaging apparatus being inflated according to the above alternative mode of the above fifth preferred embodiment of the present invention.

FIG. 32 is a sectional view of the air-filling packaging apparatus being inflated according to the above alternative mode of the above fifth preferred embodiment of the present invention. The non-inflated outer bag portion 10*b* is formed by an extended part of monolayer film, such as air chamber film, valve film, and etc., and the inner bag portion 10*b* is further affixedly connected in the outer bag portion 10*a* through the transverse heat-sealing seam 41J on the bottom side, such that it is not required to tuck the inner bag portion 10*b* into the outer bag portion 10*a* on the packaging site.

Figure 33:
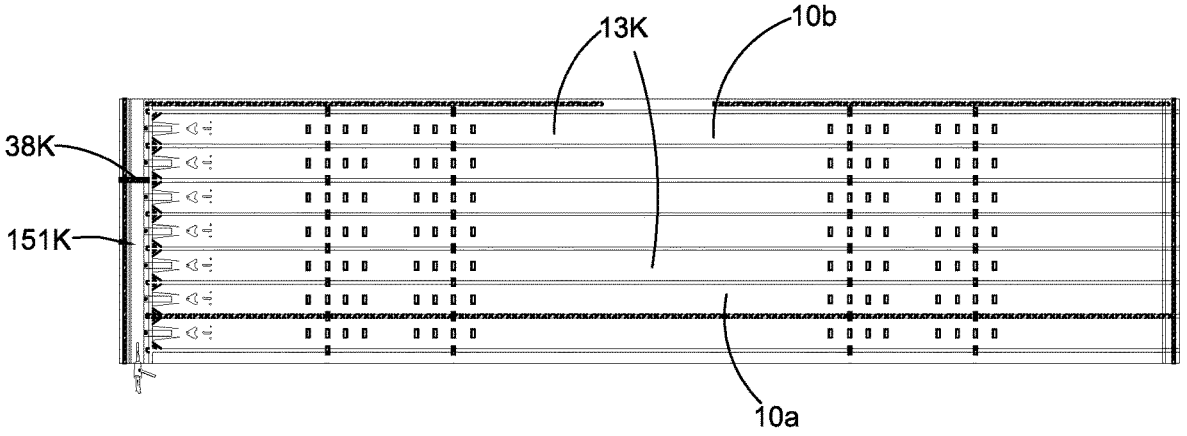
FIG. 33 is a perspective view illustrating the uninflated air-filling packaging apparatus being expanded in a plane manner according to another alternative mode of the above fifth preferred embodiment of the present invention.

FIG. 33 is a perspective view illustrating the uninflated air-filling packaging apparatus being expanded in a plane manner according to another alternative mode of the above fifth preferred embodiment of the present invention. According to this embodiment, the choke seam 38K is arranged at a suitable position of the main channel 151K in order to make a plurality of the air-storing units 13K on the top side uninflatable, which are utilized to form the inner bag portion 10*b*.

Figure 34:
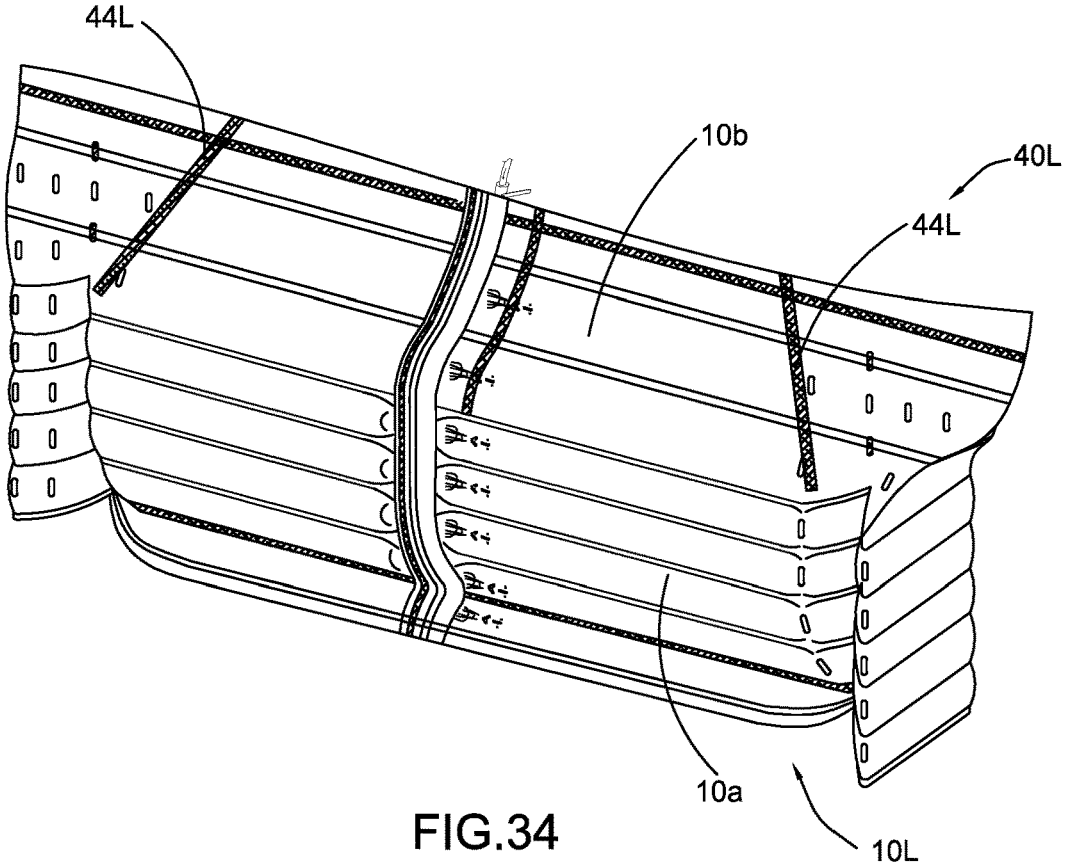
FIG. 34 is a 3D perspective view of the air-filling packaging apparatus according to another alternative mode of the above fifth preferred embodiment of the present invention.

FIG. 34 is a 3D perspective view of the air-filling packaging apparatus according to another alternative mode of the above fifth preferred embodiment of the present invention. The 3D heat-sealing seams 40L of the air-filling packaging apparatus further comprises a stopping seam 44L respectively formed on each of the two sides of the inner bag portion 10*b* heat-sealedly connecting the front and back sides of the inner bag portion 10*b*. Each stopping seam 44L can be embodied as a heat-sealed seam inclinedly extended from one fringe of the two sides toward the center. Therefore, when the object is accommodated in the accommodating chamber formed by the inner bag portion 10*b* again, it will be retained between the two stopping seams 44L. Then, there will be reserved space between the two sides of the object and the inner surfaces of the right side wall and the left side wall, such that when the two sides of the 3D packaging bag formed by the air cushion body 10L receive external shock or impact, the impact force will not be directly transferred to the two sides of the object. Hence, the side cushion performance of the air-filling packaging apparatus can be enhanced.

Figure 35:
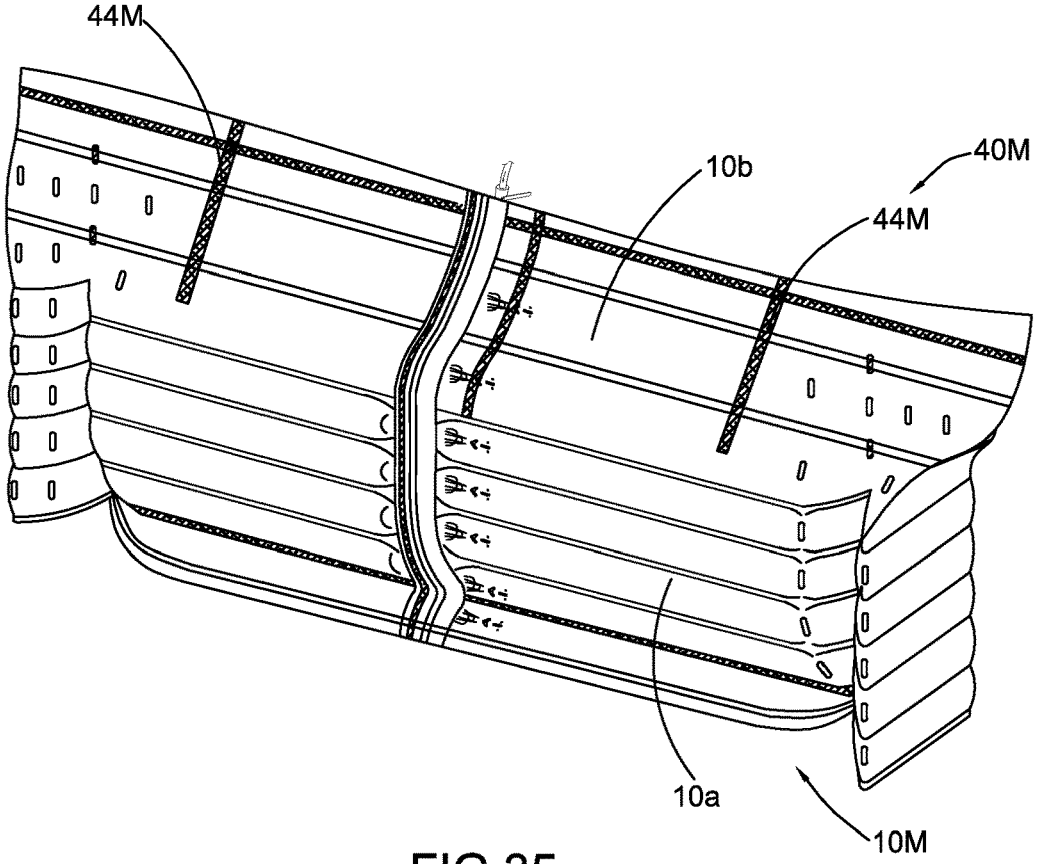
FIG. 35 is a 3D perspective view of the air-filling packaging apparatus according to another alternative mode of the above fifth preferred embodiment of the present invention.

FIG. 35 illustrate a perspective view of the air-filling packaging apparatus according to another alternative mode of the above fifth preferred embodiment of the present invention, which is similar with the embodiment illustrated in FIG. 34, wherein the differences include that the stopping seam 44M can be embodied as a longitudinally extended sealing seam. Moreover, when the object is then accommodated in the accommodating chamber formed in the inner bag portion 10*b*, it will be retained and limited between the two stopping seams 44M. It is worth mentioning that the stopping seams 44L and 44M mentioned above can be continuous sealing seams or intermittent sealing seams.

FIG. 36-40 illustrate the air-filling packaging apparatus according to a sixth preferred embodiment of the present invention, which has an inflatable structure so as to be inflated and provide air cushioning function for various packaged contents, such as electronic products, food, medical products, chemical products, biological materials, plastics and ceramics, fast moving consumer goods, and etc. The air-filling packaging apparatus can be easily stored and transported in a non-inflated state before use, while it can then be inflated on site, which is convenient to use.

According to this preferred embodiment of the present invention, the air-filling packaging apparatus can be embodied as an air cushion substance which is filled with air for example. Nevertheless, person skilled in the art should be able to understand that it can also be filled with other gas based on the application and needs. According to this preferred embodiment, it can form a 3D packaging bag after being inflated, so as to provide air cushioning function for object.

According to this preferred embodiment, the air-filling packaging apparatus comprises at least an air cushion body 10N. Namely, either one of the air cushion body 10N forms a 3D packaging bag or a plurality of the air cushion bodies 10N form the 3D packaging bag through heat-sealing connecting, such as adhesive bonding, heat-sealing, and etc. The embodiment illustrated in FIGS. 36-40 is formed by one air cushion body 10N. More specifically, referring to FIG. 71A, the air cushion body 10N comprises at least two air chamber films 11N and 12N forming the 3D packaging bag comprising one or more interconnected air-storing units 13N through a series of 2D heat-sealing seams 30N and 3D heat-sealing seams 40N, wherein each the air-storing unit 13N forms a air storage chamber 14N that is able to store gas therein.

Figure 36:
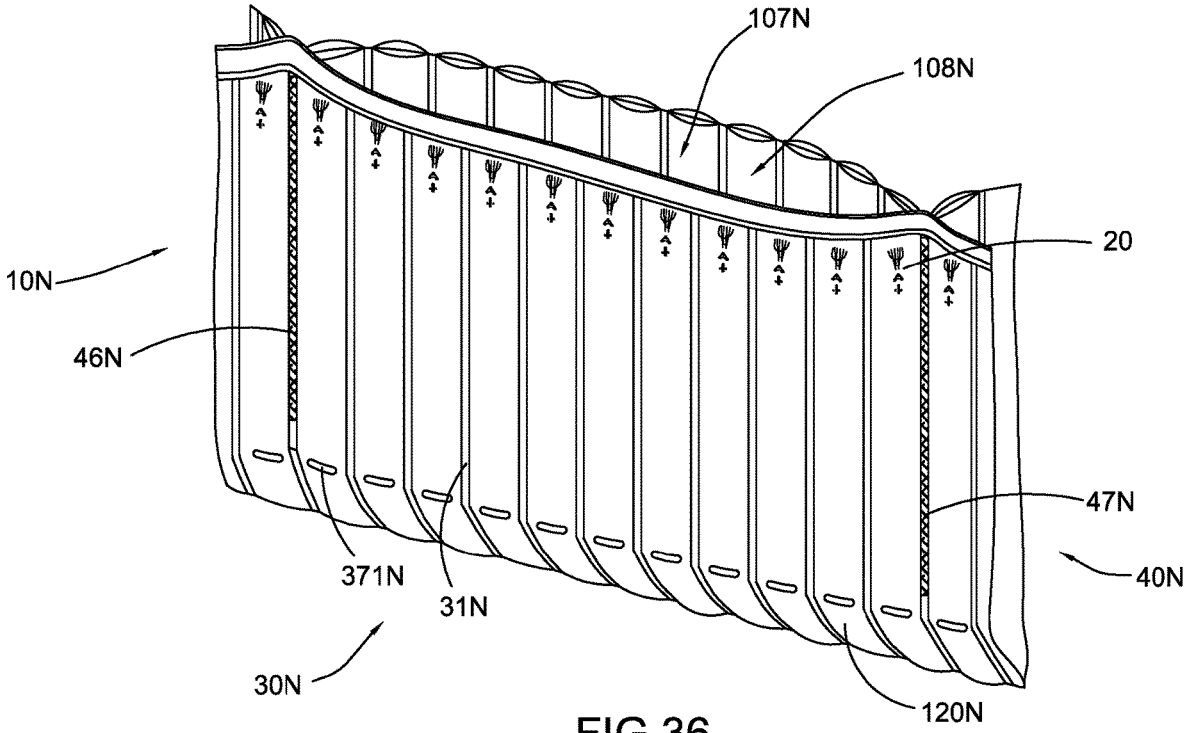
FIG. 36 is a 3D perspective view of the air-filling packaging apparatus according to a sixth preferred embodiment of the present invention.

Person skilled in the art should be able to understand that the 2D heat-sealing seams 30N is for heat-sealing the multiple films into a 2D cushion material, as FIG. 36 illustrate. The 3D heat-sealing seams 40N is additional heat-sealing on the above 2D cushion material to make the air-filling packaging apparatus into a 3D packaging device that has a 3D structure and can accommodate the object, as is illustrated in FIG. 36. The 2D heat-sealing seams 30N and the 3D heat-sealing seams 40N can connect multiple layers of films together through adhesive bonding, heat-sealedly connect, and etc. Preferably, according to this embodiment, the 2D heat-sealing seams 30N and the 3D heat-sealing seams 40N are both formed through heat-sealing technology.

Figure 48:
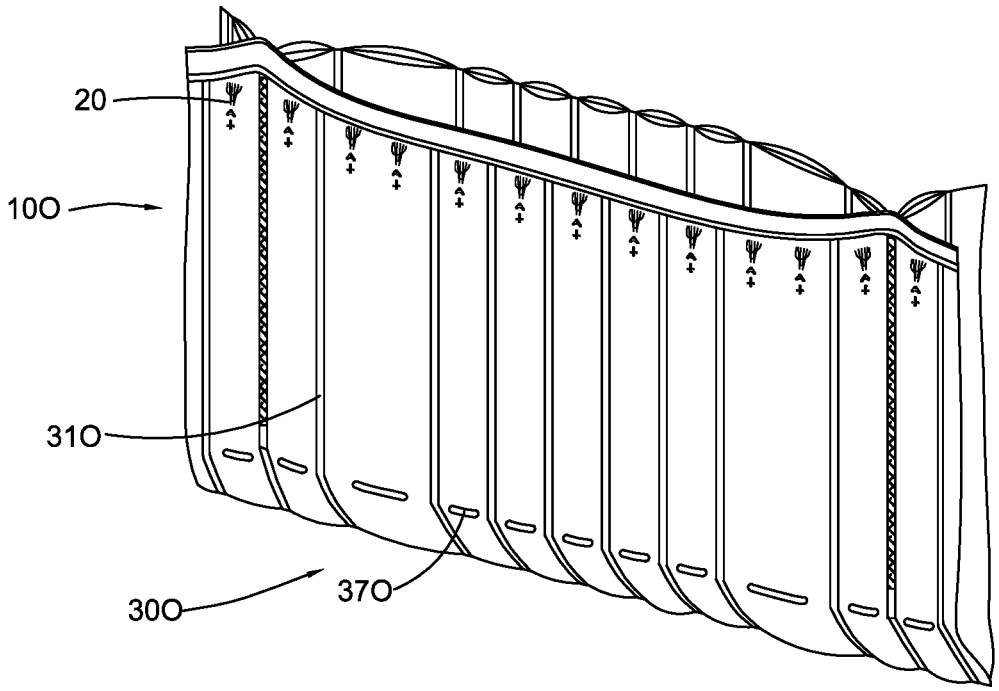
FIG. 48 is a 3D perspective view of the air-filling packaging apparatus according to an alternative mode of the above sixth, seventh, and eighth preferred embodiments of the present invention, illustrating another shape and arrangement of the air-storing units.

More specifically, the 2D heat-sealing seams 30N comprise a plurality of dividing seams 31N dividing the two air chamber films 11N and 12N into a plurality of the air-storing units 13N. Preferably, each row of the dividing seams 31N is formed by heat-sealing technology that heat-sealedly connects two layers of the air chamber films 11N and 12N so as to form a row of the dividing seam 31N between two adjacent air-storing units 13N. The dividing seam 31N may be a continuous heat-sealed line so as to have a plurality of the air-storing units 13N be independent to one another. It is understandable that the dividing seam 31N on the top side and the bottom side can respectively become a top side boundary seam and a bottom side boundary seam of the to air cushion body 10N, as FIG. 36 illustrates. The dividing seam 31N may also be an intermittent heat-sealed line so as to have a plurality of the air-storing units 13N be interconnected. The air-storing unit 13N can be in various shape, such as linear, circular, polygon, irregular, and etc. Referring to FIGS. 36-40, the air cushion body 10N according to the present invention may comprise a plurality of air-storing pillars of the same size abreast arranged, while referring to FIG. 48, the air cushion body according to the present invention may also comprise a plurality of air-storing pillars of different sizes abreast arranged. In addition, the arrangements of the large or small air-storing pillars can be diverse, such as in an alternate manner, having only small air-storing pillars regionally, and etc., while the present invention shall not be limited thereto.

According to this preferred embodiment, referring to FIG. 71A, the air-filling packaging apparatus further comprises an inflation valve 20 formed by at least two valve films 21 and 22. The two valve films 21 and 22 of the inflation valve 20 and the air chamber films 11N and 12N are overlappedly arranged. Besides, an air inlet channel 23 is formed between the valve films 21 and 22 for inflating to the air storage chamber 14N. It is understandable that the lengths of the valve films 21 and 22 are shorter than the lengths of the air chamber films 11N and 12N. When the air storage chamber 14N is inflated via the air inlet channel 23 and the air pressure in the air storage chamber 14N has attained the predetermined required value, the air pressure in the air storage chamber 14N will act on the valve films 21 and 22 so as to attach the valve films 21 and 22 on one of the air chamber film, which closes the air inlet channel 23 and makes the inflation valve 20 serve as a one-way valve. When each air-storing unit 13N has at least an air inlet channel 23 formed therein and each of the air-storing units 13N is independent to one another, even if one of the air-storing units 13N is damaged and leaks, the rest of the air-storing units 13N will not be affected, but still serve as air cushions.

It is understandable that the air chamber films 11N and 12N of the air cushion body 10N and the valve films 21 and 22 of the inflation valve 20 can respectively be made of various suitable membrane materials, such as polyethylene film, polypropylene film, polyvinyl chloride film, polyester film, polystyrene film, composite film, and etc, wherein the present invention shall not be limited thereto, as long as suitable flexible films are utilized. It is worth mentioning that in order to enhance the one-way sealing function, the valve films 21 and 22 of the inflation valve 20 can also be self-adhesive films acquired by adding chemical composition to the above films.

The air cushion body 10H further comprises a main channel unit 15N connected with each of the air-storing units 13N or, preferably, integrally extended from each of the air-storing units 13N. More specifically, according to this preferred embodiment, the extending directions of the main channel unit 15N and the air-storing unit 13N are perpendicular to each other. For example, according to this embodiment, each the air-storing unit 13N is extended along a longitudinal direction, while the main channel unit 15N is extended along a transverse direction. The main channel unit 15N forms a main channel 151N that has an inflation inlet 152N. When the inflation inlet 152N has an inflation nozzle arranged thereat for conducting an inflation process, gas will enter the main channel 151N from the inflation inlet 152N along a transverse direction, and enter each the air-storing unit 13N along a longitudinal direction. Then, when the air pressure of each the air storage chamber 14N reaches a predetermined value, the valve films 21 and 22 of the inflation valve 20 will attached on one of the air chamber films 11N and 12N, so as to self-seal and prevent the inflated gas from reversing into the main channel 151N.

It is worth mentioning that, it is understandable that the main channel unit 15N can be formed by two layers of the air chamber films 11N and 12N, two layers of the valve films 21 and 22, or either one layer of the air chamber films 11N and 12N and either one layer of the valve films 21 and 22.

Figure 37:
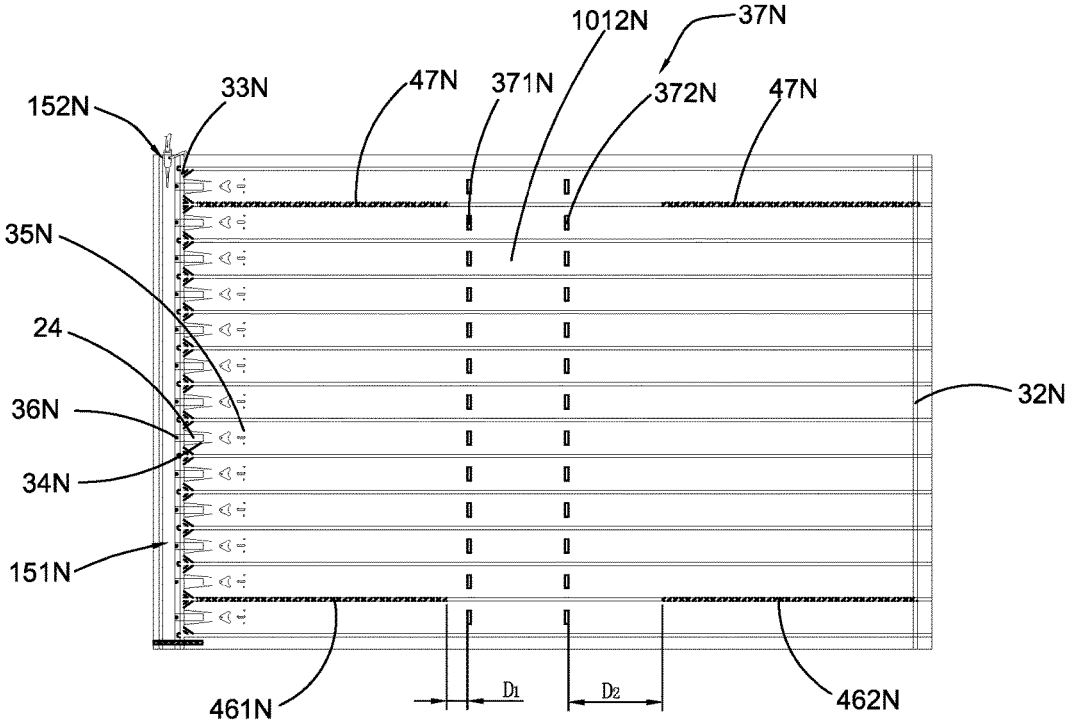
FIG. 37 is a perspective view illustrating the uninflated air-filling packaging apparatus being expanded in a plane manner according to the above sixth preferred embodiment of the present invention.

Referring to FIG. 37, the 2D heat-sealing seams 30N further comprise a continuously sealed edge sealing seam 32N respectively on the left and right sides and a continuously sealed main channel sealing seam 33N on the left side of the air cushion body 10N, wherein the main channel 151N is formed between the left edge sealing seam 32N and the main channel sealing seam 33N. It is understandable that the edge sealing seam 32N is formed through heat-sealing technology, such as adhesive bonding, heat-sealing, and etc., to sealedly connect the two air chamber films 11N and 12N. The main channel sealing seam 33N is formed through heat-sealing technology, such as adhesive bonding, heat-sealing, and etc., to sealedly connect the two air chamber films 11N and 12N and the two valve films 21 and 22 respectively, as FIG. 37 illustrated. For example, the main channel sealing seam 33N on the up and down sides that was formed through a first heat-sealing technology respectively heat-sealedly connects the air chamber film 11N and the valve film 21 at the position corresponding to the air inlet channel 23, heat-sealedly connects the air chamber film 12N and the valve film 22, and integrally heat-sealedly connects multiple layers of films at the rest places, which also divides the air cushion body 10N into the main channel unit 15N and the air-storing unit 13N.

Referring to FIG. 37, each the air-storing unit 13N comprises two spaced gas duct seams 34N adjacent to the main channel 151N and formed through heat-sealedly connecting the air chamber films 11N and 12N and the valve films 21 and 22. The air inlet channel 23 formed by the valve films 21 and 22 are arranged between the two gas duct seams 34N.

Referring to FIG. 71A, the valve films 21 and 22 are further heat-sealedly connected with the air chamber film 11N through a plurality of connecting seams 35N, such that when the air pressure in the air storage chamber 14N attained a predetermined value, the air pressure will act on the valve films 21 and 22 and because of the arrangement of the connecting seams 35N, the valve films will be pushed toward the air chamber film 11N and eventually be attached on the air chamber film 11N, so as to close the air inlet channel 23. That is to say, the connecting seam 35N heat-sealedly connects the two valve films 21 and 22 and the air chamber film 11N. Besides, referring to FIG. 37, the shape of each the connecting seam 35N allows it to further prevent the air from backflow. In other words, when the air in the air storage chamber 14N is going to flow back, it will be obstructed by the connecting seam 35N and cannot return into the main channel 151N easily.

In addition, when the 2D heat-sealing seams 30N are being formed through heat-sealing, the air inlet channel 23 of the valve films 21 and 22 of the inflation valve 20 can be formed through the arrangement a heatproof barrier device. Then the heatproof barrier device can be removed after the heat-sealing process. According to this embodiment, referring to FIGS. 37 and 71A, a heatproof layer 24 is arranged between the valve films 21 and 22 of the inflation valve 20 and attached with the inner surface of one of the valve films 21 and 22. The heatproof layer 24 can be embodied as thermostable inks and etc. As a result, when the main channel sealing seam 33N is formed through heat-sealing, the two valve films 21 and 22 will not be heat-sealedly connected, such that the air inlet channel 23 can be connected with the main channel 151N and the access thereof will not be closed due to the heat-sealing.

According to this preferred embodiment, the main channel 151N is formed by the two air chamber films 11N and 12N, the heatproof layer 24 and the valve films 21 and 22 respectively have extending section extended into the main channel 151N, and the 2D heat-sealing seams 30N further comprises a joint seam 36N longitudinally and spacingly arranged at the position corresponding to the extending section of the heatproof layer 24. Because of the arrangement of the heatproof layer 24, the joint seam 36N respectively connects the two air chamber films 11N and 12N and the two valve films 21 and 22, while the two valve films 21 and 22 are not heat-sealedly connected with each other. The arrangement of the joint seam 36N allows adjacent valve films 21 and 22 and the correspondingly connected air chamber films 11N and 12N to be expanded together to open the corresponding air inlet channel 23 when air enters the main channel 151N during the inflation of the air cushion body 10N.

The 2D heat-sealing seams 30N further comprise a plurality intermittent bending seams 37N, wherein the inflated air cushion body 10N is adaptable for bending along the bending seams 37N, such that the air cushion body 10N can form a plurality of side walls. More specifically, the bending seams 37N divide each the air-storing unit 13N into a plurality of sub-air-storing units 131N. The bending seams can be arranged in the middle of the air-storing units 13N and respectively form a connecting channel 132N on the two sides thereof, such that the adjacent sub-air-storing units 131N can be interconnected and communicated, as FIG. 37 illustrated. It is understandable that the bending seams 37N can also be arranged on the two sides of the air-storing units 13N, while the connecting channel 132N is arranged in the middle of the air-storing units 13N. Correspondingly, it is understandable that each the bending seams 37N heat-sealedly connects two layers of the air chamber films 11N and 12N.

Further, referring to FIGS. 36-40, according to a sixth preferred embodiment of the present invention, the bending seam 37N comprises a intermittently heat-sealed first bending seam 371N, such as the front bending seam 371N, and an intermittently heat-sealed second bending seam 372N, such as the rear bending seam 372N, such that the air cushion body 10N is adapted to form a front side wall 1011N, a bottom connecting portion 1012N, and a rear side wall 1013N along the front bending seam 371N and the rear bending seam 372N, wherein the bottom connecting portion 1012N is embodied as a sloping cushion portion 1012N according to the present invention. Correspondingly, referring to FIGS. 36-39, the 3D heat-sealing seams 40N comprise a left 3D heat-sealing seam 46N on the left side and a right 3D heat-sealing seam 47N on the right side of the air cushion body 10N, which heat-seal the left sides of the front side wall 1011N and the rear side wall 1013N, which, in other words, have the left side of the air cushion body 10N sealed. The right 3D heat-sealing seam 47N heat-seals the right sides of the front side wall 1011N and the rear side wall 1013N, so as to achieve the sealing of the right side of the air cushion body 10N.

The above-mentioned front side wall 1011N, rear side wall 1013N, and sloping cushion portion 1012N are bent and second heat-sealed through the 3D heat-sealing seams 40N to form an accommodating chamber 108N having an opening 107N on the top side thereof. Namely, the air-storing units 13N respectively form a ringlike air-storing pillar. That is, as FIG. 37 illustrate, the left part of the front bending seam 371N is utilized to form the front side wall 1011N, the sloping cushion portion 1012N is formed between the front bending seam 371N and the rear bending seam 372N, and the rear side wall 1013N is formed in the right side of the rear bending seam 372N. It is understandable that the side walls 101N and 103N and the sloping cushion portion 1012N are respectively formed by the sub-air-storing units 131N integrally extended from the air-storing unit 13N along the length direction thereof.

It is worth mentioning that because the lengths of the front side wall 1011N and the rear side wall 1013N are different, the connecting portion of the sloping cushion portion 1012N will be in a sloping state. That is, the bottom connecting portion 1012N and the rear side wall 1013N will form a buffer gap 1002N to thicken the cushion, so as to avoid the object from touching the bottom. In other words, the sloping cushion portion 1012N is inclinedly extended between the front side wall 1011N and the rear side wall 1013N.

According to the embodiment illustrated in FIG. 36, the length of the front side wall 1011N is shorter than the length of the rear side wall 1013N, such that the sloping cushion portion 1012N can be inclinedly extended to form the buffer gap 1002N between the rear side wall 1013N and itself. Certainly, it is understandable that as an alternative mode, the length of the front side wall 1011N may also be longer than the length of the rear side wall 1013N. Moreover, it should be noted that though FIG. 37 illustrated the plane cushion substance formed through heat-sealing of the 2D heat-sealing seams 30N, it also illustrated the position of the 3D heat-sealing seams 40N, such that one may understand the forming process of the 3D packaging bag more easily.

Figure 38:
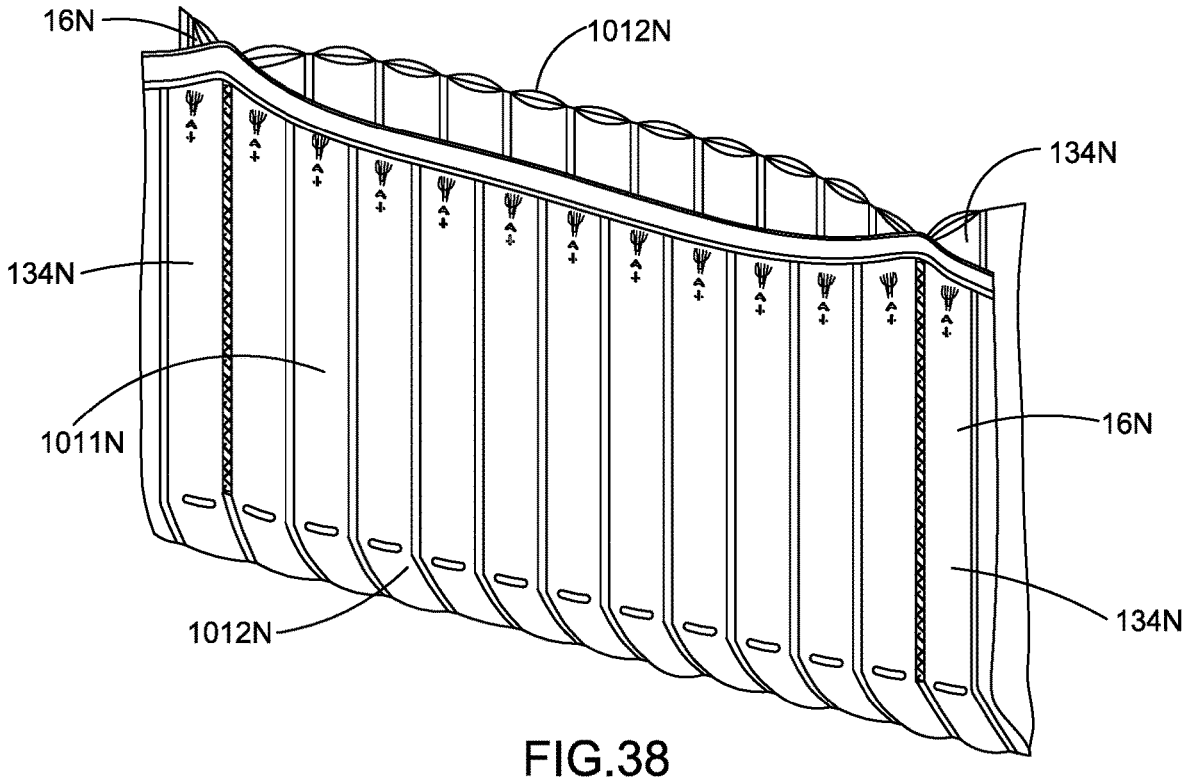
FIG. 38 is a 3D perspective view of the air-filling packaging apparatus according to the above sixth preferred embodiment of the present invention.
Figure 39:
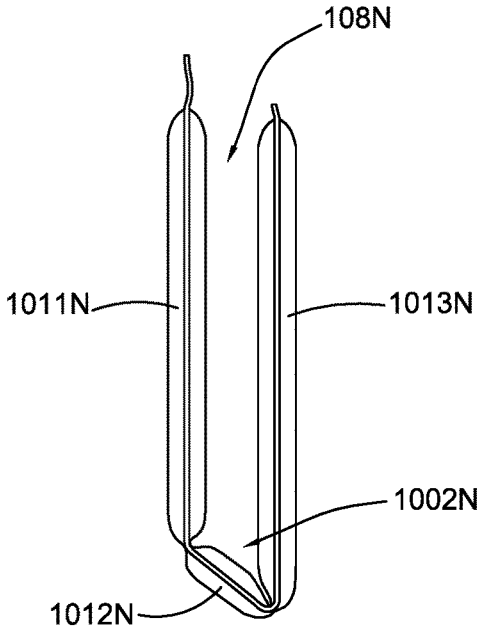
FIG. 39 is a side sectional view of the air-filling packaging apparatus according to the above sixth preferred embodiment of the present invention.

It is worth mentioning that according to this preferred embodiment of the present invention, the left 3D heat-sealing seam 46N and the right 3D heat-sealing seam 47N respectively form a flank cushion portion 16N on the two sides of the air-filling packaging apparatus. The 3D heat-sealing seam 46N and 47N are respectively arranged between the two adjacent air-storing units 13N on the left and right sides, so as to respectively turn one or more of the air-storing units on the outermost left and right sides into the flank cushion portions 16N. Referring to FIG. 38, a left flank air-storing unit 134N on the left side of the air cushion body 10N bent through the bending seam 37N and heat-sealed through the left 3D heat-sealing seam 46N to form a left flank cushion portion 16N that has a buffer space. A right flank air-storing unit 134N on the right side of the air cushion body 10N are bent through the bending seam 37N and heat-sealed through the right heat-sealing seam 47N to form a right flank cushion portion 16N that has a buffer space. Hence, the flank cushion portions 16N on the two sides of the air cushion body 10N are to reinforce the side cushioning function. In other words, the flank cushion portion 16N provides cushioning function on the side.

Referring to FIGS. 36-40, according to this preferred embodiment, the air cushion body 10N is adapted for accommodating the object. The object accommodated in the accommodating chamber can touch the front side wall 1011N and the rear side wall 1013N. The front side wall 1011N and the rear side wall 1013N provide cushioning function for the object. The flank cushion portion 16N provides cushioning function for the object on the side. Nonetheless, the object does not directly contact the sloping cushion portion 1012N. In other words, the object may not be extended into the buffer gap 1002N, such that the sloping cushion portion 1012N can provide cushioning function in a multistage manner for the object. That is, when there is external impact acting on the outside of the sloping cushion portion 1012N, each air-storing unit 13N of the sloping cushion portion 1012N will provide a level of cushioning function or a first cushioning function. Further, the buffer gap 1002N will provide another level of cushioning function or a second cushioning function to prevent the force that acts on the air-storing unit 13N from being transferred to the object. In other words, when the air-storing units 13N of the sloping cushion portion 1012N are collided or impacted from the outside, the buffer gap 1002N can provide a deformation space for the air-storing units 13N, such that the external collision or impact force acted on the sloping cushion portion 1012N will not be directly transferred to the object. That is to say, the sloping cushion portion thickens the cushion and provides cushioning function in a multistage manner, so as to prevent the object from touching the bottom.

It is worth mentioning that when the air cushion body 10N is utilized to bear the object and is inflated, the inner surfaces of the front side wall 1011N and the rear side wall 1013N may or may not attach the outer surface of the object. For example, one may also add a packing bag to wrap the object. Preferably, according to this embodiment, the object is, for instance, a laptop M. The laptop M can be partially or fully put in the accommodating chamber 108N. When part of the laptop M, or any side thereof, is put into the accommodating chamber 108N, that side of the laptop M does not directly contact the sloping cushion portion 1012N. In other words, the laptop M may not be extended into the buffer gaps 1002N, such that the sloping cushion portion can thicken the cushion and provide better cushioning function for the laptop M.

Figure 40:
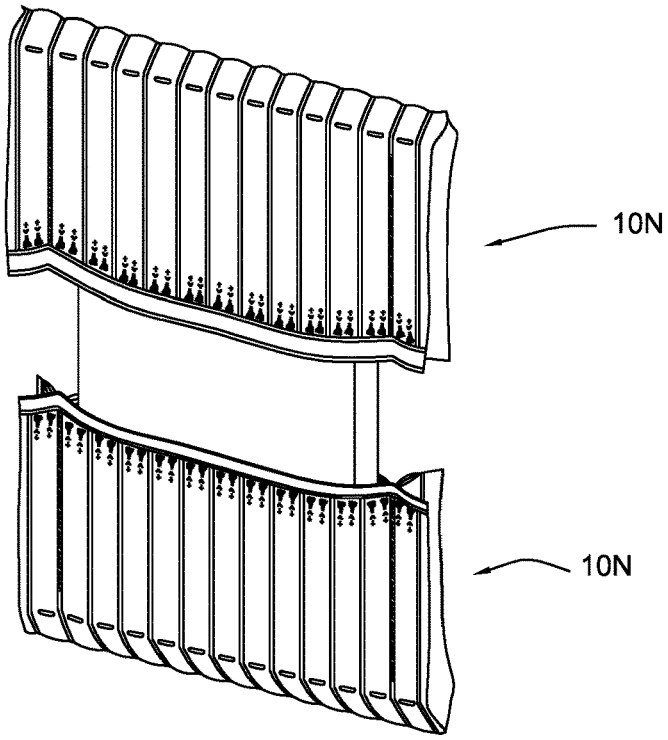
FIG. 40 is a perspective view of the air-filling packaging apparatus being utilized to package a object according to the above sixth preferred embodiment of the present invention.

In addition, referring to FIG. 40, in order to retain the laptop M and prevent it from sliding during transportation, there is one of the air cushion bodies 10N respectively arranged on the two sides of the laptop M. That is to say, the object M can also be packaged through coupling two of the air-filling packaging apparatuses. Namely, the present invention provides a packaging assembly, which comprises two of the air-filling packaging apparatuses, wherein two extremities of the object M are respectively accommodated in two accommodating chambers 108N of the air-filling packaging apparatuses, wherein the entire package is put in other packing case or packaging box so as for storing or transporting the laptop M. That is, the laptop M has one of the buffer gap 1002N on each of the two sides and does not have to reach or extend into the buffer gaps 1002N, such that the two sloping cushion portions of the air cushion body 10N thicken the cushion for the laptop M. Besides, the structure of the air-filling packaging apparatus according to the present invention can significantly enhance the cushioning performance in all sides, so as to prevent the object M from being damaged by external impact or shock.

Correspondingly, when the flank cushion portion 16N receives external shock or impact, the external shock or impact will not directly pass through the flank cushion portion 16N to the object, which means the flank air-storing unit 134N of the flank cushion portion 16N provides a cushion so as to achieve the cushioning function.

It is worth mentioning that the 3D heat-sealing seams 40N can be continuous heat-sealed seams or intermittent heat-sealed seams. The left and right 3D heat-sealing seams 46N and 47N can be respectively located at the dividing seam 31N on the sides of the air cushion body 10N or be formed with the dividing seam 31N through a first heat-sealing process at the same time. According to the above preferred embodiment, the left and right 3D heat-sealing seams 46N and 47N can respectively be an independent heat-sealed seam formed on the left or right edge of the air cushion body 10N.

According to this embodiment of the present invention, referring to FIGS. 36-37, the left 3D heat-sealing seam 46N, for example, comprises a first heat-sealing section 461N and a second heat-sealing section 462N that are integrally heat-sealedly connected, equally long, and formed at the same time in the first heat-sealing process on the front and back sides of the air cushion body. Referring to FIG. 37, the first heat-sealing section 461N and the second heat-sealing section 462N are spaced, rather than integrally formed. Moreover, the distance between the first heat-sealing section 461N and the front bending seam 371N is shorter than the distance between the second heat-sealing section 462N and the rear bending seam 372N, such that the sub-air-storing units 131N between the front bending seam 371N and the rear bending seam 372N can form the sloping cushion portion 1012N. That is to say, there is a first distance D1 between the left 3D heat-sealing seam 46N and the front bending seam 371N in the front side, while there is a second distance D2 between the left 3D heat-sealing seam 46N and the rear bending seam 372N in the back side, wherein the first distance D1 is shorter than the second distance D2, such that the sub-air-storing units 131N between the front bending seam 371N and the rear bending seam 372N are inclinedly extended. Similar, the right 3D heat-sealing seam 47N has similar structure to the left 3D heat-sealing seam 46N.

Figure 41:
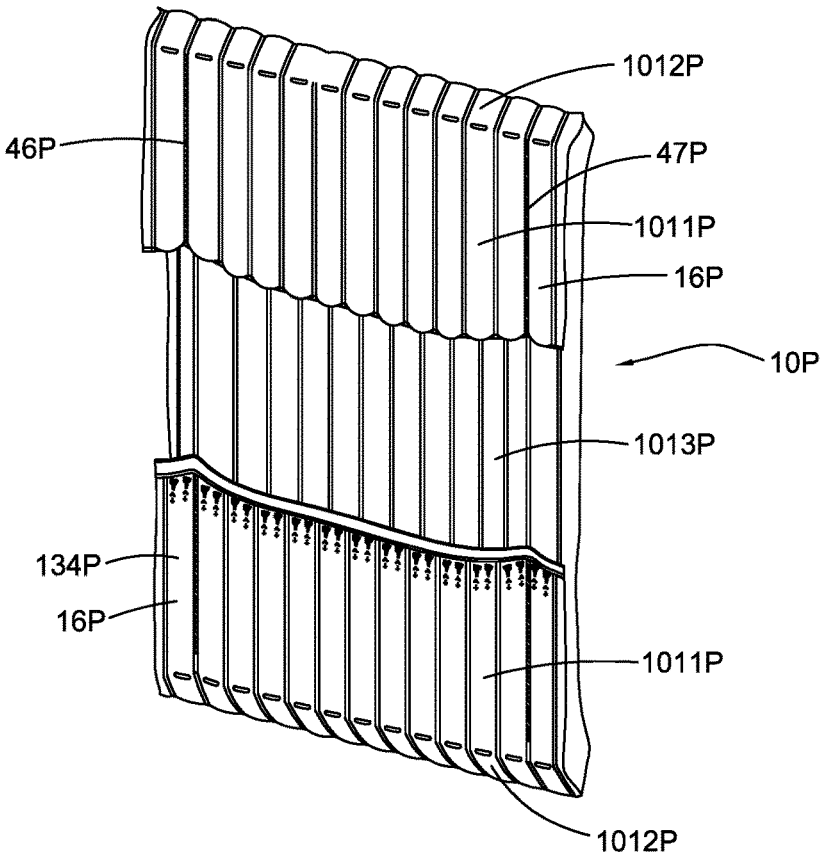
FIG. 41 is a perspective view of the air-filling packaging apparatus being utilized to package a object according to a seventh preferred embodiment of the present invention.
Figure 42:
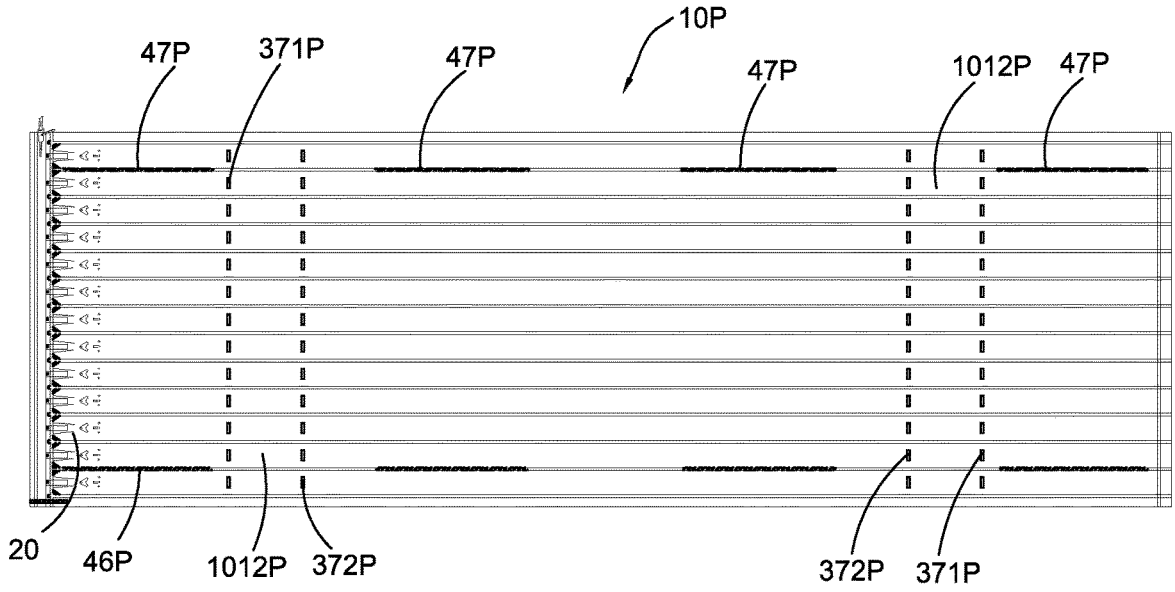
FIG. 42 is a perspective view illustrating the uninflated air-filling packaging apparatus being expanded in a plane manner according to the above seventh preferred embodiment of the present invention.
Figure 43:
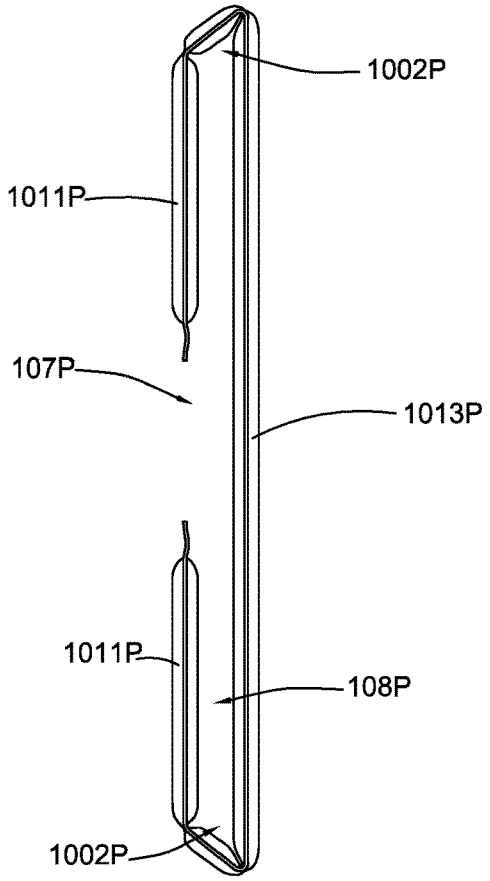
FIG. 43 is a side sectional view of the air-filling packaging apparatus according to the above seventh preferred embodiment of the present invention.
Figure 44:
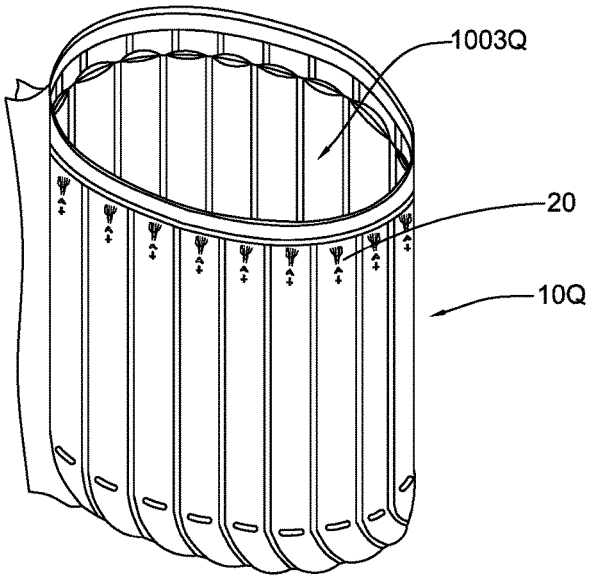
FIG. 44 is a sectional view of the inflated air-filling packaging apparatus according to an eighth preferred embodiment of the present invention.
Figure 45:
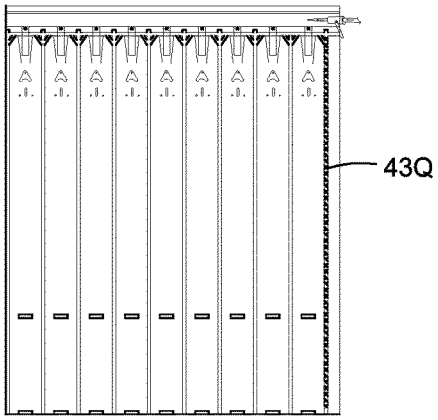
FIG. 45 is a perspective view illustrating the uninflated air-filling packaging apparatus being through a second heat-sealing according to the above eighth preferred embodiment of the present invention.

FIGS. 41-43 illustrate perspective views of the air-filling packaging apparatus according to a seventh preferred embodiment of the present invention, which is also an alternative mode of the above sixth preferred embodiment of the present invention. Similarly, according to this preferred embodiment, the object is, for instance, a laptop M.

The bending seams 37N comprise two intermittently heat-sealed front bending seams 371P and two intermittently heat-sealed rear bending seams 372P, such that the air cushion body 10P is adaptable for forming two front side walls 1011P, two sloping cushion portions 1012P, and a rear side wall 1013P along the two front bending seams 371P and the two rear bending seams 372P. Correspondingly, referring to FIG. 42, the 3D heat-sealing seams 40P comprise a left 3D heat-sealing seam 46P on the left side and a right 3D heat-sealing seam 47P on the right side, which respectively heat-seal the left sides of the front side wall 1011P and the rear side wall 1013P, which, in other words, have the left side of the air cushion body 10P sealed. The right 3D heat-sealing seam 47P heat-seals the right sides of the front side wall 1011P and the rear side wall 1013P, so as to achieve the sealing of the right side of the air cushion body 10P.

The above-mentioned front side wall 1011P, the rear side wall 1013P, and the sloping cushion portion 1012P are bent and second heat-sealed through the 3D heat-sealing seams 40P to form an accommodating chamber 108P having an opening 107P. That is, as FIG. 41 illustrated, the left or right parts of the two front bending seams 371P form two the front side walls 1011P respectively, each the sloping cushion portion 1012P is formed between each the front bending seam 371P and each the rear bending seam 372P, and the rear side wall 1013P is formed between the two rear bending seams 372P. It is understandable that the side walls 101A and 103A and the sloping cushion portion 1012P are respectively formed by the sub-air-storing units 131P integrally extended from the air-storing unit 13A along the length direction thereof.

It is worth mentioning that because the lengths of the two front side walls 1011P and the rear side wall 1013P are different, the connecting portions on the bottom side will be in a sloping state. That is, the two bottom connecting portions 1012P and the rear side wall 1013P will respectively form two buffer gaps 1002P to thicken the cushion, so as to avoid the object from touching the bottom. In other words, two of the sloping cushion portions 1012P are inclinedly extended between the two front side walls 1011P and the rear side wall 1013P.

According to the embodiment illustrated in FIG. 41, the sum of the lengths of the two front side walls 1011P is shorter than the length of the rear side wall 1013P, the gap therebetween is for forming the opening 107P for picking and placing object and making the two sloping cushion portions 1012P be inclinedly extended to form the buffer gap 1002P between the rear side wall 1013P and themselves.

Moreover, it should be noted that FIG. 42 illustrates the 3D cushion material formed through heat-sealing of the 2D heat-sealing seams 30P, it also illustrates the position of the 3D heat-sealing seams 40P, such that one may understand the forming process of the 3D packaging bag more easily.

It is worth mentioning that according to this preferred embodiment of the present invention, the left 3D heat-sealing seam 46P and the right 3D heat-sealing seam 47P respectively form a flank cushion portion 16P on the two sides of the air-filling packaging apparatus. Referring to FIG. 41, a left flank air-storing unit 134P on the left side of the air cushion body 10P are bent through the bending seam 37P and heat-sealed through the left heat-sealing seam 41A to form a left flank cushion portion 16P that has a buffer space. A right flank air-storing unit 134P on the right side of the air cushion body 10P are bent through the bending seam 37P and heat-sealed through the right heat-sealing seam 47P to form a right flank cushion portion 16P that has a buffer space. Hence, the flank cushion portions 16P on the two sides of the air cushion body 10P are to reinforce the side cushioning function. In other words, the flank cushion portion 16P provides cushioning function on the side.

Referring to FIGS. 41-43, according to this preferred embodiment, the air cushion body 10P is adapted for accommodating the object. The object accommodated in the accommodating chamber 108P can touch the front side walls 1011P and 101A and the rear side wall 1013P. The front side wall 1011P and the rear side wall 1013P provide cushioning function for the object. The flank cushion portion 16P provides side cushioning function for the object. Nonetheless, the two sides of the object do not directly contact the two sloping cushion portions 1012P. In other words, the object may not be extended into the buffer gap 1002P, such that the sloping cushion portion 1012P can provide cushioning function in a multistage manner for the object. That is, when there is external impact acting on the outside of the sloping cushion portion 1012P, each air-storing unit 13P of the sloping cushion portion 1012P will provide a level of cushioning function or a first cushioning function. Further, the buffer gap 1002P will provide another level of cushioning function or a second cushioning function to prevent the force that acts on the air-storing unit 13P from being transferred to the object. In other words, when the air-storing units 13P of the sloping cushion portion 1012P are collided or impacted from the outside, the buffer gap 1002P can provide a deformation space for the air-storing units 13P, such that the external collision or impact force acted on the sloping cushion portion 1012P will not be directly transferred to the object. That is to say, the sloping cushion portion thickens the cushion and provides cushioning function in a multistage manner, so as to prevent the object from touching the bottom.

It is worth mentioning that when the air cushion body 10P is utilized to bear the object and is inflated, the inner surfaces of the front side wall 1011P and the rear side wall 1013P may or may not attach the outer surface of the object. For example, one may also add a packing bag to wrap the object. Preferably, according to this embodiment, the object is, for instance, a laptop M. The laptop M can be put in the accommodating chamber 108P. The front side wall 1011P and the rear side wall 1013P provide cushioning function for the front and back sides of the laptop M, while the flank cushion portions 16P provide cushioning function for the left and right sides of the laptop M. The rest two sides of the laptop M does not directly contact the two sloping cushion portions 1012P. In other words, the laptop M may not be extended into the buffer gaps 1002P, such that the sloping cushion portions can thicken the cushion and provide better cushioning function for the top and bottom sides of the laptop.

It is worth mentioning that the 3D heat-sealing seams 40P can be continuous heat-sealed seams or intermittent heat-sealed seams. The heat-sealing seams 46P and 47P can be respectively located at the dividing seam 31P on the sides of the air cushion body 10P or be formed with the dividing seam 31P through a first heat-sealing process at the same time. According to the above preferred embodiment, the heat-sealing seams 46P and 47P can respectively be an independent heat-sealed seam formed on the left or right edge of the air cushion body 10P.

FIGS. 44-47 illustrate perspective views of the air-filling packaging apparatus according to an eighth preferred embodiment of the present invention, which is also an alternative mode of the above sixth preferred embodiment of the present invention and is formed by connecting head portion of the sixth preferred embodiment. Similarly, according to this preferred embodiment, the air-filling packaging apparatus comprises at least an air cushion body 10Q and an inflation valve 20 serving as a self-sealing one-way air inlet. It forms one or more interconnected air-storing units 13Q through a series of 2D heat-sealing seams 30Q and 3D heat-sealing seams 40Q, wherein the air-storing units are circularly arranged to surroundingly form a ringlike accommodating chamber 108Q, a bottom inclinedly arranged buffer gap 1002Q, and a packaging chamber 1003Q therein. When it is utilized, a ringlike object is suitable for being packaging in the ringlike accommodating chamber 108Q. The packaging chamber 1003Q may also be utilized for packaging the object.

According to this preferred embodiment of the present invention, the 3D heat-sealing seams 40Q further comprises a longitudinal end sealing seam 43Q heat-sealedly connecting the front side wall 1011Q and the rear side wall 1013Q along the longitudinal direction, which means the air cushion body 10Q is circularly arranged and the head and tail thereof are connected. The head portions of the front side wall 1011Q and the rear side wall 1013Q are connected to respectively form an inner side wall 1014Q and an outer side wall 1015Q, so as to form a sloping cushion portion 1012Q to provide cushion for the object. Thus, the air cushion body 10Q is able to form an inflatable 3D packaging bag having the bottom ringlike reinforced sloping cushion portion 1012Q through the transverse heat-sealing seams 46Q and 47Q and the end sealing seam 43Q that heat-sealedly connect multiple layers of films. Besides, the object is suitable for being packaged in the packaging chamber 1003Q. Besides, when the object is packaged in the packaging chamber 1003Q, because the inner and outer side walls are overlapped, surrounded, and heat-sealed into the predetermined structure, the air-filling packaging apparatus can form a multilayer structure, so as to provide a reinforced cushioning function for the object. In addition, because the sloping cushion portion 1012Q is sloped outside-in, it will decrease the inside diameter of the air-filling packaging apparatus, such that it becomes more suitable for holding the object stably.

Figure 46:
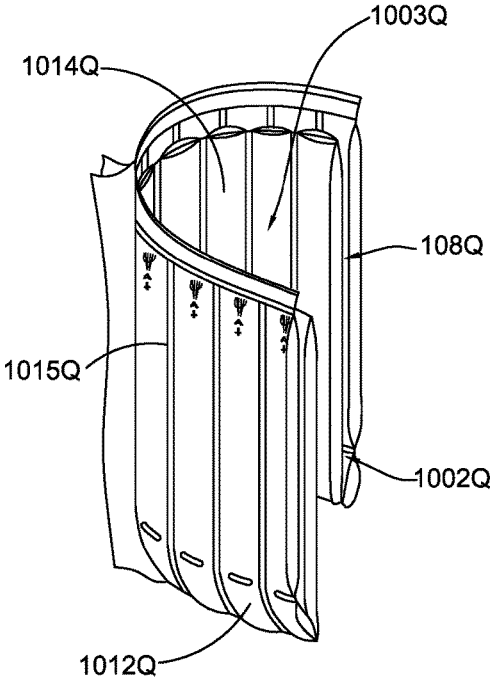
FIG. 46 is a side sectional view of the inflated air-filling packaging apparatus according to the above eighth preferred embodiment of the present invention.
Figure 47:
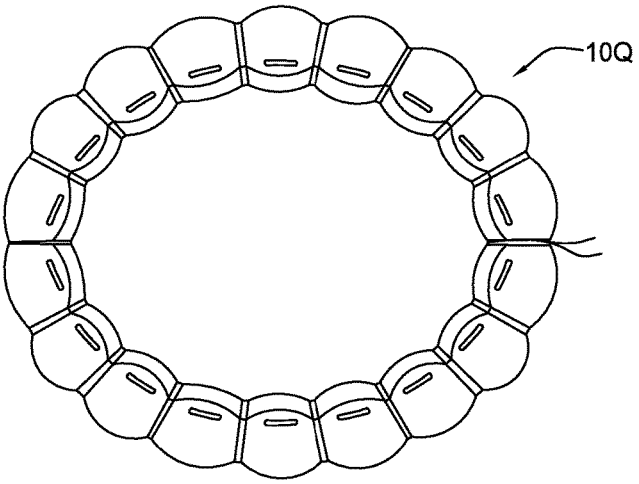
FIG. 47 is a bottom view of the inflated air-filling packaging apparatus according to the above eighth preferred embodiment of the present invention.

More specifically, referring to FIGS. 46-47, because the head and tail of the sloping cushion portion 1012Q is connected through the end sealing seam 43Q, it forms the bottom reinforced sloping cushion portion 1012Q. The bottom reinforced sloping cushion portion 1012Q forms the ringlike bottom inclinedly arranged buffer gap 1002Q. The bottom inclinedly arranged buffer gap 1002Q further thickens the cushion on the basis of the sixth preferred embodiment of the present invention.

It is understandable that, according to the preferred embodiment illustrated in FIGS. 44-47, the air cushion body 10Q is adapted for accommodating the object, wherein the object is accommodated in the accommodating chamber 108Q. The sloping cushion portion 1012Q forms a surrounding side wall. The surrounding side wall provides a cushioning function for the object. Because the surrounding side wall is formed by heat-sealedly connecting the front side wall 1011Q and the rear side wall 1013Q through the end sealing seam 43Q as the above first embodiment and it respectively forms an outer side wall 1015Q and an inner side wall 1014Q in a circularly manner, when external impact acts on the surrounding side wall, the outer side wall 1015Q, the inner side wall 1014Q, and the buffer space between the outer side wall 1015Q and the inner side wall 1014Q can provide three levels of the cushioning functions for the object. Namely, the surrounding side wall provides a cushioning function for the object. Nonetheless, the object does not directly contact the bottom sloping cushion portion 1012Q. In other words, the object may not be extended into the bottom inclinedly arranged buffer gap 1002Q, such that the bottom sloping cushion portion 1012Q can provide cushioning function in a multistage manner for the object. That is, when there is external impact acting on the outside of the bottom sloping cushion portion 1012Q, each sub-air-storing unit 131Q of the bottom sloping cushion portion 1012Q will provide a level of cushioning function or a first cushioning function. Further, the inclinedly arranged buffer gap 1002Q on the bottom will provide a deformation space for the air-storing unit, so as to provide another level of cushioning function or a second cushioning function to prevent the force that acts on the air-storing unit 13Q from being transferred to the object. In other words, when the air-storing units 13Q of the bottom sloping cushion portion 1012Q are collided or impacted from the outside, the inclinedly arranged buffer gap 1002Q can provide a deformation space for the air-storing units 13Q, such that the external collision or impact force acted on the bottom sloping cushion portion 1012Q will not be directly transferred to the object. That is to say, the sloping cushion portion thickens the cushion, so as to prevent the object from touching the bottom.

It is understandable that, referring to FIG. 46, when the object M is packaged in the air-filling packaging apparatus, the bottom sloping cushion portion 1012Q provides air cushioning function on the bottom side thereof, which thicken the cushion on the bottom side. In other words, this structural design strengthens its overall cushioning performance, especially on the bottom side.

Besides, according to this embodiment, the end sealing seam 43Q of the 3D heat-sealing seams 40Q can also be formed at the positions corresponding to the heat-sealing seams 46Q and 47Q. Alternatively, the heat-sealing seams 46Q and 47Q and the end sealing seam 43Q can be formed at once in the first heat-sealing process, so as to connect the head and tail of the air cushion body 10Q. Similarly, according to this embodiment, the end sealing seam 43Q can be formed at each the edge sealing seam 32Q of the flank cushion portion 16Q.

Figure 49:
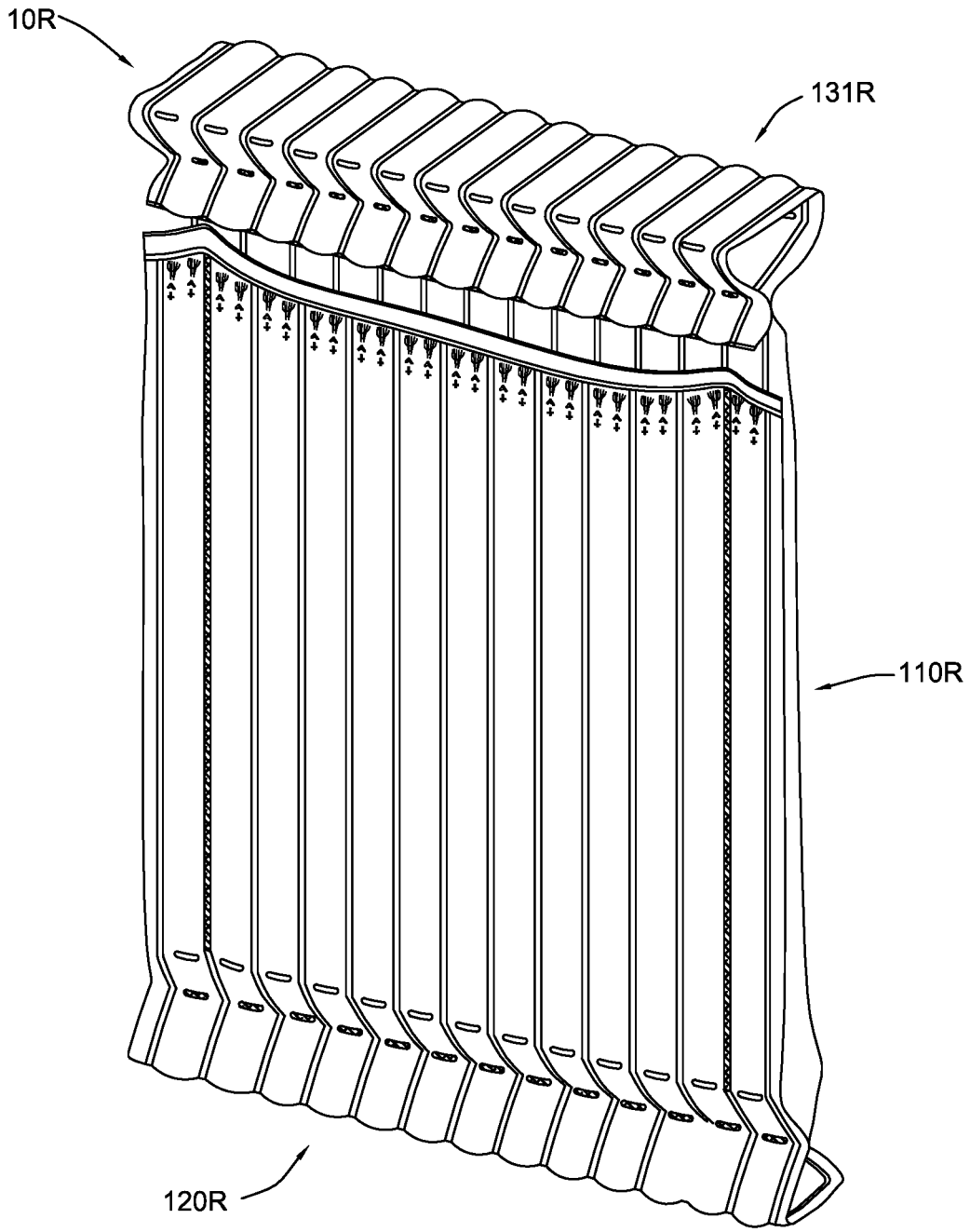
FIG. 49 is a 3D perspective view of the air-filling packaging apparatus according to a ninth preferred embodiment of the present invention.
Figure 50:
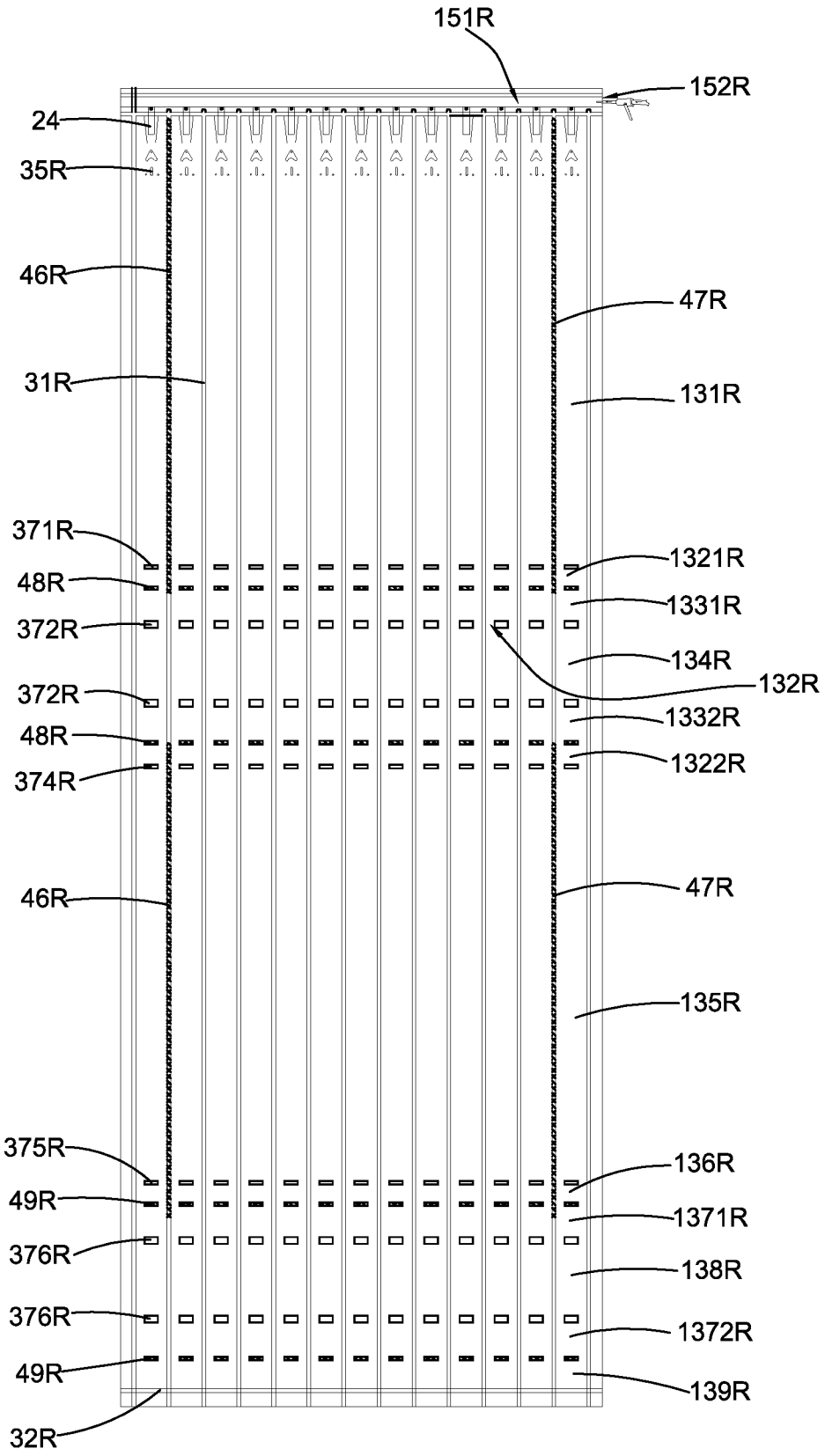
FIG. 50 is a perspective view illustrating the uninflated air-filling packaging apparatus being expanded in a plane manner according to the above ninth preferred embodiment of the present invention.
Figure 51:
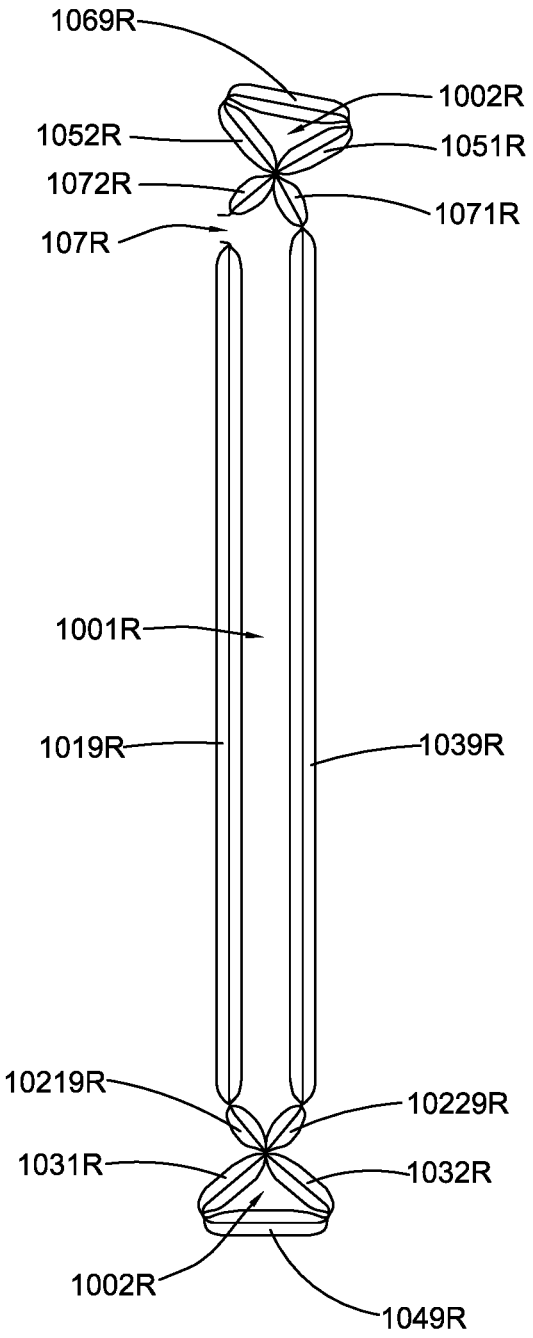
FIG. 51 is a sectional view of the inflated air-filling packaging apparatus according to the above ninth preferred embodiment of the present invention.

FIG. 49-51 illustrate the air-filling packaging apparatus according to a ninth preferred embodiment of the present invention, which has an inflatable body structure, wherein the air-filling packaging apparatus has an accommodating portion and a subsidiary portion. After inflation, the accommodating portion will have an accommodating chamber for providing air cushioning function for the main body of various packaged contents, such as electronic products, food, medical products, chemical products, biological materials, plastics and ceramics, fast moving consumer goods, and etc. The air-filling packaging apparatus can be easily stored and transported in a non-inflated state before use, while it can be inflated on site, which is convenient to use. The subsidiary portion is utilized to provide further cushioning function for the object and is able to accommodate the accessory of the object, so as to avoid loss and damage caused by packaging the accessories and main body of the object having more accessories together. For instance, the air-filling packaging apparatus can be utilized for packaging a laptop, wherein the accommodating chamber of the accommodating portion is for packaging the laptop and is able to completely accommodate the laptop therein. The subsidiary portion can both be a side cushion component to provide cushioning function and accommodate the accessory of the laptop. Person skilled in the art should be able to understand that the above mentioned object could not be limited to the above mentioned examples. Instead, the air-filling packaging apparatus of the present invention may also be suitable for packaging other article(s).

It is worth mentioning that the medium for the air-filling packaging apparatus according to the present invention to provide cushioning function is fluid, such as gas, liquid, and etc.

According to the above ninth preferred embodiment, the air-filling packaging apparatus can be embodied as an air cushion substance which is filled with air for example. Certainly, person skilled in the art should be able to understand that it can be other gas according to the needs of the application. According to the above ninth preferred embodiment, it can form a 3D packaging bag after being inflated, so as to provide air cushioning function for object.

Specifically, according to the above ninth preferred embodiment, the air-filling packaging apparatus comprises at least an air cushion body 10R. Namely, one the air cushion body 10R forms the 3D packaging bag through heat-sealing connecting, such as adhesive bonding, heat-sealing, and etc. The embodiment illustrated in FIGS. 49-51 is formed by one air cushion body 10R. More specifically, referring to FIGS. 49, 50, and 71A, the air cushion body 10R comprises at least two air chamber films 11R and 12R forming the 3D packaging bag comprising one or more interconnected air-storing units 13R through a series of 2D heat-sealing seams 30R and 3D heat-sealing seams 40R, wherein each the air-storing unit 13R forms a air storage chamber 14R that is able to store gas therein.

Person skilled in the art should be able to understand that the 2D heat-sealing seams 30R are for making multiple films form a 2D cushion material, as FIG. 50 illustrates, through heat-sealing. The 3D heat-sealing seams 40R are additional heat-sealing on the above 2D cushion material to turn the air-filling packaging apparatus into a 3D packaging device that has a 3D structure and can accommodate the object, as FIG. 51 illustrates. The 2D heat-sealing seams 30R and the 3D heat-sealing seams 40R can connect multiple layers of films together through adhesive bonding, heat-sealedly connect, and etc. Preferably, according to the above ninth preferred embodiment, the 2D heat-sealing seams 30R and the 3D heat-sealing seams 40R are both formed through heat-sealing technology.

More specifically, referring to FIG. 50, the 2D heat-sealing seams 30R comprises a plurality of dividing seams 31R dividing the two air chamber films 11R and 12R into a plurality of the air-storing units 13R. Preferably, each row of the dividing seams 31R is formed by heat-sealing technology that heat-sealedly connects two layers of the air chamber films 11R and 12R so as to form a row of the dividing seam 31R between two adjacent air-storing units 13R. The dividing seam 31R may be a continuous heat-sealed line so as to have a plurality of the air-storing units 13R be independent to one another. Therefore, when one of the air-storing units 13R was damaged to leak, the rest of the air-storing units 13R will not be affected. Certainly, it is worth mentioning that the air-storing units 13R can also be interconnected, such that it requires only one inflation valve 20 to fill gas into all air-storing units 13R. In other words, the air-filling packaging apparatus according to the present invention can form a plurality of the air-storing units 13R through heat-sealing the first air chamber layer 11 and the second air chamber layer 12.

It is understandable that the dividing seam 31R on the top side and the bottom side can respectively become a top side boundary seam and a bottom side boundary seam of the air cushion body 10R, as FIG. 49 illustrates. It is worth mentioning that the top side and bottom side mentioned here are relative concepts defined based on the relative positions to the air-filling packaging apparatus and the transverse. In other words, when the dividing seam 31R of the air-filling packaging apparatus is perpendicular to the transverse, a top side and a bottom side will be defined. On the other hand, when the dividing seam 31R of the air-filling packaging apparatus is parallel to the transverse, a left side and a right side will be defined. The dividing seam 31R may also be an intermittent heat-sealed line so as to have a plurality of the air-storing units 13R be interconnected. The air-storing unit 13R may have various shapes, such as linear shape, circular shape, polygonal shape, irregular shape, and etc. Referring to FIGS. 49-51, the air cushion body 10R according to the present invention may comprise a plurality of air-storing pillars of the same size abreast arranged or a plurality of air-storing pillars of different sizes abreast arranged, which are, for example, all arranged longitudinally. In addition, the arrangements of the large or small air-storing pillars can be diverse, such as in an alternate manner, having only small air-storing pillars regionally, and etc., while the present invention shall not be limited thereto.

Figure 71B:
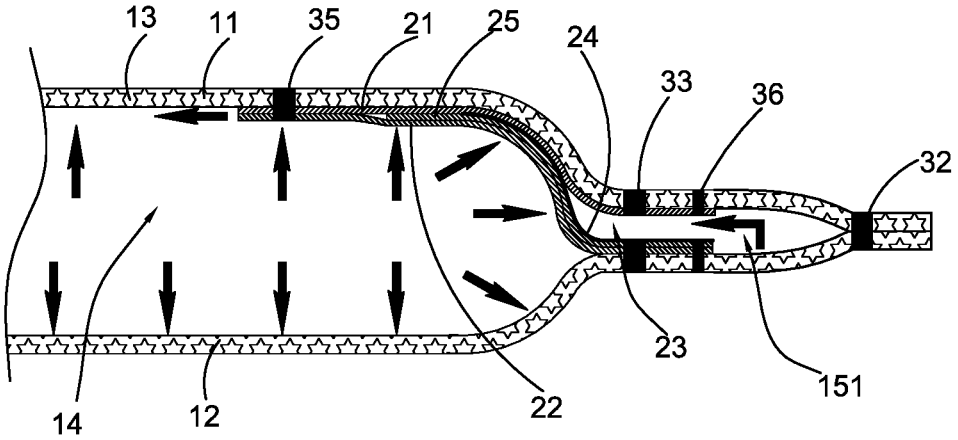
FIG. 71B is a perspective view of the one-way inflation valve for the air-filling packaging apparatus according to the above embodiment of the present invention.
Figure 71C:
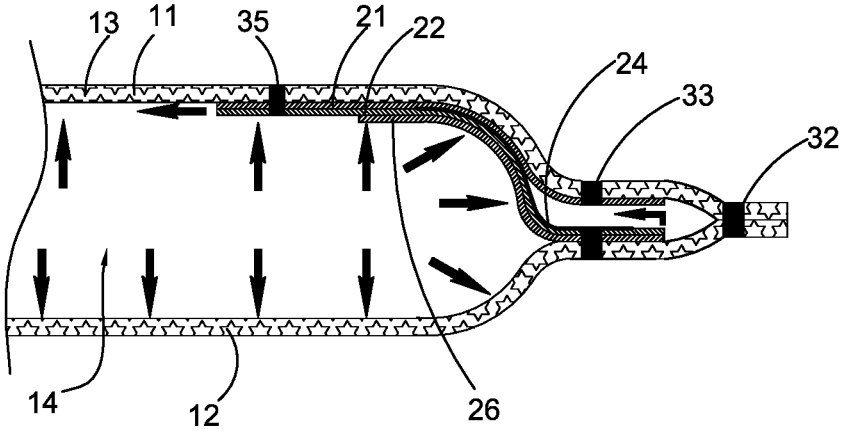
FIG. 71C is a perspective view of the one-way inflation valve for the air-filling packaging apparatus according to the above embodiment of the present invention.

According to the above ninth preferred embodiment, FIGS. 71A-71C illustrated perspective views of the inflation valve 20 according to the present invention. Referring to FIG. 71A, the air-filling packaging apparatus further comprises an inflation valve 20 formed by at least two valve films 21 and 22. The two valve films 21 and 22 of the inflation valve 20 and the air chamber films 11R and 12R are overlappedly arranged. Besides, an air inlet channel 23 is formed between the valve films 21 and 22 for inflating to the air storage chamber 14R. It is understandable that the lengths of the valve films 21 and 22 are shorter than the lengths of the air chamber films 11R and 12R. When the air storage chamber 14R is inflated via the air inlet channel 23 and the air pressure in the air storage chamber 14R has attained the predetermined required value, the air pressure in the air storage chamber 14R will act on the valve films 21 and 22 so as to attach the valve films 21 and 22 on one of the air chamber film, which closes the air inlet channel 23 and makes the inflation valve 20 serve as a one-way valve. When each air-storing unit 13R has at least an air inlet channel 23 formed therein and each of the air-storing units 13R is independent to one another, even if one of the air-storing units 13R is damaged and leaks, the rest of the air-storing units 13R will not be affected, but still serve as air cushions. Referring to FIG. 71B, the inflation valve 20 can further comprise an additional layer of valve film 25 between the two valve films 21 and 22 so as to enhance the sealing property. Referring to FIG. 71C, the inflation valve 20 can further comprise a layer of valve film 26 arranged between the air chamber film 12 and the valve film 22, which is to be arranged on the outer side of the two valve films 21 and 22, so as to prevent the junction between the valve film 22 and the air chamber film 12R from being torn, such that the connection can be strengthened and stabilized. It is understandable that the specific structures of the inflation valve 20 are just examples, rather than limits to the scope of the present invention.

It is understandable that the air chamber films 11R and 12R of the air cushion body 10R and the valve films 21 and 22 of the inflation valve 20 can respectively be made of various suitable membrane materials, such as polyethylene film, polypropylene film, polyvinyl chloride film, polyester film, polystyrene film, and composite film, wherein the present invention shall not be limited thereto, as long as suitable flexible films are utilized. It is worth mentioning that in order to enhance the one-way sealing function, the valve films 21 and 22 of the inflation valve 20 can also be self-adhesive films acquired by adding chemical composition to the above films.

The air cushion body 10H further comprises a main channel unit 15R connected with each of the air-storing units 13R or, preferably, integrally extended from each of the air-storing units 13R. More specifically, according to an embodiment, the extending directions of the main channel unit 15R and the air-storing unit 13R are perpendicular to each other. For example, according to an embodiment, each the air-storing unit 13R is extended along a longitudinal direction, while the main channel unit 15R is extended along a transverse direction. The main channel unit 15R forms a main channel 151R that has an inflation inlet 152R. When the inflation inlet 152R has an inflation nozzle arranged thereat for conducting an inflation process, gas will enter the main channel 151 from the inflation inlet 152 along a transverse direction, and enter each the air-storing unit 13R along a longitudinal direction. Then, when the air pressure of each the air storage chamber 14R reaches a predetermined value, the valve films 21 and 22 of the inflation valve 20 will attached on one of the air chamber films 11R and 12R, so as to self-seal and prevent the inflated gas from reversing into the main channel 151R.

It is understandable that the main channel unit 15R can be formed by two layers of the air chamber films 11R and 12R, two layers of the valve films 21 and 22, or either one layer of the air chamber films 11R and 12R and either one layer of the valve films 21 and 22.

Referring to FIG. 50, the 2D heat-sealing seams 30R further comprise a continuously sealed edge sealing seam 32R respectively on the left and right sides and a continuously sealed main channel sealing seam 33R on the left side of the air cushion body 10R, wherein the main channel 151R is formed between the left edge sealing seam 32R and the main channel sealing seam 33R. It is understandable that the edge sealing seam 32R is formed through heat-sealing technology, such as adhesive bonding, heat-sealing, and etc., to sealingly connect the two air chamber films 11R and 12R. The main channel sealing seam 33R is formed through heat-sealing technology, such as adhesive bonding, heat-sealing, and etc., to sealingly connect the two air chamber films 11R and 12R and the two valve films 21 and 22 respectively, as the figure illustrated. For example, the main channel sealing seam 33R on the up and down sides that was formed through a first heat-sealing technology respectively heat-sealedly connects the air chamber film 11 and the valve film 21 at the position corresponding to the air inlet channel 23, heat-sealedly connects the air chamber film 12 and the valve film 22, and integrally heat-sealedly connects multiple layers of films at the rest places, which also divides the air cushion body 10R into the main channel unit 15R and the air-storing unit 13R.

Referring to FIG. 71A-71C, each the air-storing unit 13R is arranged near the main channel 151R, wherein the valve films 21 and 22 are further heat-sealedly connected with the air chamber film 11 through a plurality of connecting seams 35R, such that when the air pressure in the air storage chamber 14R attained a predetermined value, the air pressure will act on the valve films 21 and 22 and because of the arrangement of the connecting seams 35R, the valve films will be pushed toward the air chamber film 11 and eventually be attached on the air chamber film 11, so as to close the air inlet channel 23. That is to say, the connecting seam 35R heat-sealedly connects the two valve films 21 and 22 and the air chamber film 11R. Besides, referring to FIG. 71A-71C, the shape of each the connecting seam 35R allows it to further prevent the air from backflow. In other words, when the air in the air storage chamber 14R is going to flow back, it will be obstructed by the connecting seam 35R and cannot return into the main channel 151R easily. In addition, when the 2D heat-sealing seams 30R are being formed through heat-sealing, the air inlet channel 23 of the valve films 21 and 22 of the inflation valve 20 can be formed through the arrangement a heatproof barrier device. Then the heatproof barrier device can be removed after the heat-sealing process. According to an embodiment, referring to FIGS. 71A-71C, a heatproof layer 24 is arranged between the valve films 21 and 22 of the inflation valve 20 and connected with the main channel 151R, so as to prevent the access from being closed by heat-sealing. The heatproof layer 24 can be embodied as thermostable inks and etc. According to an embodiment, the main channel 151R is formed by the two air chamber films 11R and 12R, the heatproof layer 24 and the valve films 21 and 22 respectively have extending section extended into the main channel 151R, and the 2D heat-sealing seams 30R further comprise a joint seam 36R longitudinally and spacingly arranged at the position corresponding to the extending section of the heatproof layer 24. Because of the arrangement of the heatproof layer 24, the joint seam 36R respectively connects the two air chamber films 11R and 12R and the two valve films 21 and 22, while the two valve films 21 and 22 are not heat-sealedly connected with each other. The arrangement of the joint seam 36R allows adjacent valve films 21 and 22 and the correspondingly connected air chamber films 11R and 12R to be expanded together to open the corresponding air inlet channel 23 when air enters the main channel 151R during the inflation of the air cushion body 10R.

The 2D heat-sealing seams 30R further comprise a plurality intermittent bending seams 37R, wherein the inflated air cushion body 10R is adaptable for bending along the bending seams 37R, such that the air cushion body 10R can form a plurality of side walls. More specifically, the bending seams 37R divides each of the air-storing units into a plurality of sub-air-storing units 131R. The bending seams 37R can be arranged in the middle of the air-storing units 13R and respectively form a connecting channel 132R on the two sides thereof such that the adjacent sub-air-storing units 131R can be interconnected and communicated, as FIG. 50 illustrated. It is understandable that the bending seams 37R can also be arranged on the two sides of the air-storing units 13R, while the connecting channel 132R is arranged in the middle of the air-storing units 13R. Correspondingly, it is understandable that each the bending seam 37R heat-sealedly connects two layers of the air chamber films 11R and 12R.

Further, referring to FIGS. 49-51, according to the above ninth preferred embodiment of the present invention, the bending seams 37R comprise intermittently heat-sealed first bending seam 371R, two second bending seam 372R and third bending seam 373R, fourth bending seam 374R, fifth bending seam 375R, and sixth bending seam 376R. Each the bending seam divides each the air-storing unit 13R into a plurality of sub-air-storing units 131R, 1321R, 1322R, 1331R, 1332R, 134R, 135R, 136R, 1371R, 1372R, 138R, and 139R. Because each the connecting channel 132R can communicate adjacent air-storing units 13R, each adjacent sub-air-storing units 131R, 1321R, 1322R, 1331R, 1332R, 134R, 135R, 136R, 1371R, 1372R, 138R, and 139R can all be communicated and interconnected. Hence, the air cushion body 10R is adapted for being bent along the bending seams 37R so as to form a plurality of side walls of the air-filling packaging apparatus. Specifically, the first bending seams 371R, two second bending seams 372R and third bending seam 373R, a fourth bending seam 374R, a fifth bending seam 375R, and a sixth bending seam 376R are bent to form a first side wall 1019R, a second side wall 1039R, a first connecting wall 10219R, a second connecting wall 10229R, a third connecting wall 1071R, a first subsidiary side wall 1031R, a second subsidiary side wall 1032R, a third subsidiary side wall 1049R, a fourth subsidiary side wall 1051R, a fifth subsidiary side wall 1052R, a sixth subsidiary side wall 1069R, and an end wall 1072R of the air-filling packaging apparatus. Correspondingly, referring to FIGS. 49-51, the 3D heat-sealing seams 40R comprise a left 3D heat-sealing seam 46R on the left side of the air cushion body 10R, a right 3D heat-sealing seam 47R on the right side of the air cushion body 10R, a first main accessory 3D heat-sealing seam 48R, and a second main accessory 3D heat-sealing seam 49R. The left 3D heat-sealing seam 46R heat-seals the left sides of each first side wall 1019R and each second side wall 1039R. The right 3D heat-sealing seam 47R heat-seals the right sides of each first side wall 1019R and each second side wall 1039R. The first main accessory 3D heat-sealing seam 48R heat-seals the first connecting wall 10219R and the second connecting wall 10229R. The second main accessory 3D heat-sealing seam 49R heat-seals the fourth subsidiary side wall 1051R and the fifth subsidiary side wall 1052R.

Hence, the air cushion body 10R obtains a main accommodating portion 110R, a subsidiary portion 120R, and a lid portion 130R through the above-mentioned plane heat-sealing and 3D heat-sealing. In other words, the first side wall 1019R, the second side wall 1039R, the first connecting wall 10219R, and the second connecting wall 10229R form the main accommodating portion 110R, the first subsidiary side wall 1031R, a second subsidiary side wall 1032R, a third subsidiary side wall 1049R form the subsidiary portion 120R, and the fourth subsidiary side wall 1051R, the fifth subsidiary side wall 1052R, the sixth subsidiary side wall 1069R, the third connecting wall 1071R, and the end wall 1072R form the lid portion 130R all through a series of the 2D heat-sealing seams 30R and the second heat-sealing of the 3D heat-sealing seams 40R. In other words, the sub-air-storing units 131R, 135R, 1321R, and 1322R are arranged in a ringlike manner so as to form the main accommodating portion 110R. The sub-air-storing units 1331R, 1332R, and 134R are arranged in a ringlike manner so as to form the subsidiary portion 120R. The sub-air-storing units 136R, 1371R, 1372R, 138R, and 139R are arranged in a ringlike manner so as to form the lid portion 130R.

The main accommodating portion 110R has an opening 107R and a main accommodating chamber 1001R. The main accommodating portion 110R is utilized for packaging the main body of the object. The main body of the object is put into the main accommodating chamber 1001R through the opening 107R. The first connecting wall 10219R and the second connecting wall 10229R can be utilized as the bottom portion of the main accommodating portion 110R to provide cushioning function.

It is worth mentioning that because the main accommodating portion 110R has the opening 107R, when the object is put into the main accommodating chamber 1001R, the lid portion 130R will be connected to a side of the opening 107R of the main accommodating portion 110R in order to avoid the object from sliding and dropping from the main accommodating chamber 1001R. The lid portion 130R and the main accommodating portion 110R are integrally heat-sealed, but they may also be separately made and connected according to other embodiment of the present invention. When the lid portion 130R of the air-filling packaging apparatus is opened, the second side wall 1039R and the third connecting wall 1071R will be bent along the second main accessory 3D heat-sealing seam 49R. When the object is put into the main accommodating chamber 1001R, the lid portion 130R will close the opening 107R, while the third connecting wall 1071R and the end wall 1072R can serve as the top of the main accommodating portion 110R. In addition, the lid portion 130R has another buffer gap 1002R to provide cushioning function.

It is worth mentioning that, according to this embodiment of the present invention, when the lid portion 130R of the air-filling packaging apparatus is opened, the lid portion 130R will have a springback force due to the influence of the air in the air cushion body 10R. Thus, when the object is put in the main accommodating chamber 1001R, the lid portion 130R will automatically spring back to turn the air-filling packaging apparatus into the closed state. Because there is the springback force, the object will not slide out from the main accommodating chamber 1001R easily. In other words, the object can have cushion protection in all directions.

The subsidiary portion 120R serves to reinforce the side cushioning function provided by connecting the first connecting wall 10219R and the second connecting wall 10229R of the main accommodating portion 110R. The subsidiary portion 120R has a buffer gap 1002R. The subsidiary portion 120R is connected to a side of the main accommodating portion 110R and formed by being integrally heat-sealed with the main accommodating portion 110R. Nevertheless, they may also be separately made and connected according to other embodiment of the present invention. The subsidiary portion 120R provides a second cushioning function for the object.

It is worth mentioning that when the lengths of the three subsidiary side walls 1031R, 1032R, and 1049R of the subsidiary portion 120R are increased or, in other words, when the space of the buffer gap 1002R is enlarged, the subsidiary portion 120R may also be considered an accessory accommodating portion for packaging the accessory of the object to avoid damage of the object caused by collision between the main body and the accessory of the object both being put in the main accommodating chamber 1001R.

It is worth mentioning that the length of the first side wall 1019R and the length of the second side wall 1039R can be the same or different. Similarly, the length of the first connecting wall 10219R and the length of the second connecting wall 10229R can be the same or different. The length of the third connecting wall 1071R and the length of the end wall 1072R can be the same or different. The length of the fourth subsidiary side wall 1051R and the length of the fifth subsidiary side wall 1052R can be the same or different.

For instance, according to this preferred embodiment, preferably, the length of the first side wall 1019R and the length of the second side wall 1039R are the same; the length of the first connecting wall 10219R and the length of the second connecting wall 10229R are the same; the length of the third connecting wall 1071R and the length of the end wall 1072R are the same; and the length of the fourth subsidiary side wall 1051R and the length of the fifth subsidiary side wall 1052R are the same. Certainly, it is understandable that there could also be other reasonable alternative modes.

It is worth mentioning that, according to this preferred embodiment of the present invention, it is to reinforce the cushioning function in all directions. The left 3D heat-sealing seam 46R and the right 3D heat-sealing seam 47R respectively form a flank cushion portion on the two sides of the main accommodating portion 110R of the air-filling packaging apparatus. The 3D heat-sealing seam 41R and 42R are respectively arranged between the two adjacent air-storing units 13R on the left and right sides, so as to respectively turn one or more of the air-storing units on the outermost left and right sides into the flank cushion portions. For instance, the leftmost sub-air-storing units 131R and 135 of the main accommodating portion 110R of the air cushion body 10R are bent through the bending seam 37R and heat-sealed through the left 3D heat-sealing seam 46R to form a left flank cushion portion that has a buffer gap. The rightmost sub-air-storing units 131R and 135R of the air cushion body 10R are bent through the bending seam 37R and heat-sealed through the right heat-sealing seam 42R to form a right flank cushion portion that has a buffer gap. Hence, the flank cushion portions on the two sides of the main accommodating portion 110R of the air cushion body 10R are to reinforce the side cushioning function. In other words, the flank cushion portion provides cushioning function on the side of the main accommodating portion 110R. When the flank cushion portion receives external shock or impact, the external shock or impact will not directly pass through the flank cushion portion to the object, which means the flank cushion portion provides a cushion so as to achieve the cushioning function.

Hence, according to the above ninth preferred embodiment of the present invention, the main accommodating portion 110R of the air cushion body 10R is adapted for accommodating the object. The object accommodated in the main accommodating chamber 1001R can touch the first side wall 1019R and the second side wall 1039R. The first side wall 1019R and the second side wall 1039R provide cushioning function for the object. The first connecting wall 10219R and the second connecting wall 10229R provide cushioning function for the object on the bottom side and increase the cushion thickness between the subsidiary portion 120R and the main accommodating portion 110R. The flank cushion portions on the two sides of the main accommodating portion 110 provide side cushioning functions for the object. The buffer gap 1002R of the lid portion 130R provides deformation space. After the lid portion 130R close the opening 107R, the third connecting wall 1071R and the end wall 1072R can increase the cushion thickness between the lid portion 130R and the main accommodating portion 110R. The buffer gap 1002 of the subsidiary portion 120R also enhances the cushioning function for the object on the bottom. It is worth mentioning that the subsidiary portion 120R of the air cushion body 10R may also be utilized for accommodating the accessory of the object. It avoids the main body and accessory of the object from contacting and colliding each other and provides accommodation and buffer gap for the accessory of the object, so as to prevent the object from being damaged when the accessory of the object is accommodated in the buffer gap 1002. For example, when the object is a laptop, it can be put in the main accommodating chamber 1001R and the lid portion 130R and the subsidiary portion 120R can provide cushioning function in all directions for the laptop. The accessory of the laptop, such as mouse and etc., can be put in the buffer gap 1002, so as to damage of the laptop caused by collision between the laptop and the accessory both being put in the main accommodating chamber 1001R. Hence, when the laptop M was impacted or shocked due to external factors, the air-filling packaging apparatus can provide cushion for the laptop M, such that the main body of the laptop M will not directly collide with the accessory, which reduce the risk of damage of the laptop M.

It is worth mentioning that when the air cushion body 10R is utilized to bear the object and is inflated with gas, the inner surfaces of the first side wall 1019R and the second side wall 1039R may or may not attach the outer surface of the object. For example, one may also add a packing bag to wrap the object. It is worth mentioning that the 3D heat-sealing seams 40R can be a continuous heat-sealed seam or an intermittent heat-sealed seam. The left and right 3D heat-sealing seams 41R and 42R can be respectively located at the dividing seam 31R on the sides of the air cushion body 10R or be formed with the dividing seam 31R through a first heat-sealing process at the same time. According to the above preferred embodiment, the left and right 3D heat-sealing seams 41R and 42R can respectively be an independent heat-sealed seam formed on the left or right edge of the air cushion body 10R.

It is worth mentioning that, according to other alternative modes of the present embodiment, the main accommodating portion 110R can form a large diameter air chamber structure, small diameter air chamber structure, or combination of large and small diameter air chamber structures. Similarly, the subsidiary portion 120R can form a large diameter air chamber structure, small diameter air chamber structure, or combination of large and small diameter air chamber structures. Corresponding, the lid portion 130R can form a large diameter air chamber structure, small diameter air chamber structure, or combination of large and small diameter air chamber structures. The present invention shall not be limited thereto. Therefore, the main accommodating portion 110R, the subsidiary portion 120R, and the lid portion 130R can form an arrangement having multilayer air chamber structure, where the each layer of the air chamber can provide a different level of cushioning function.

Figure 52:
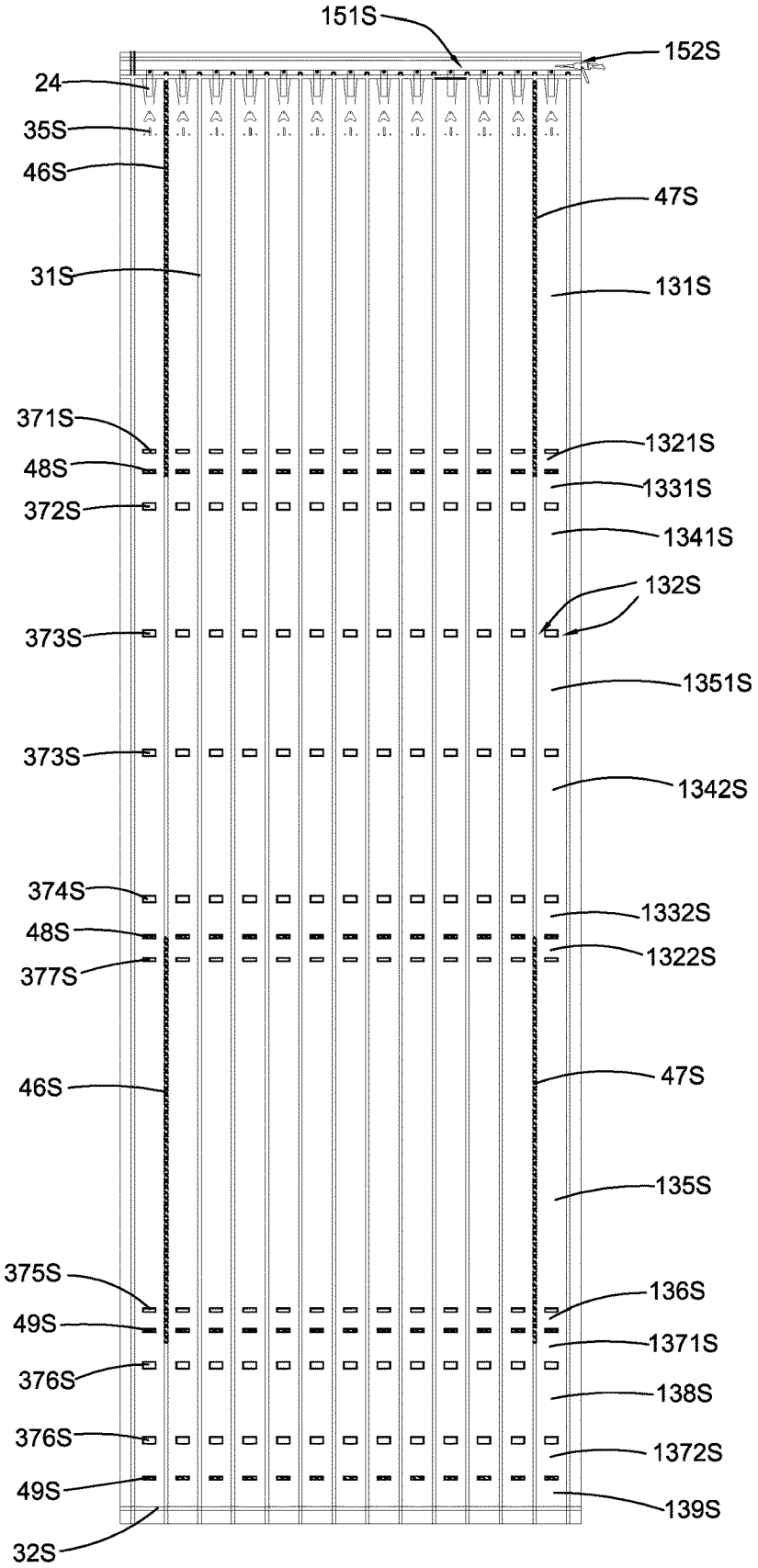
FIG. 52 is a perspective view illustrating the uninflated air-filling packaging apparatus being expanded in a plane manner according to a 10th preferred embodiment of the present invention.
Figure 53:
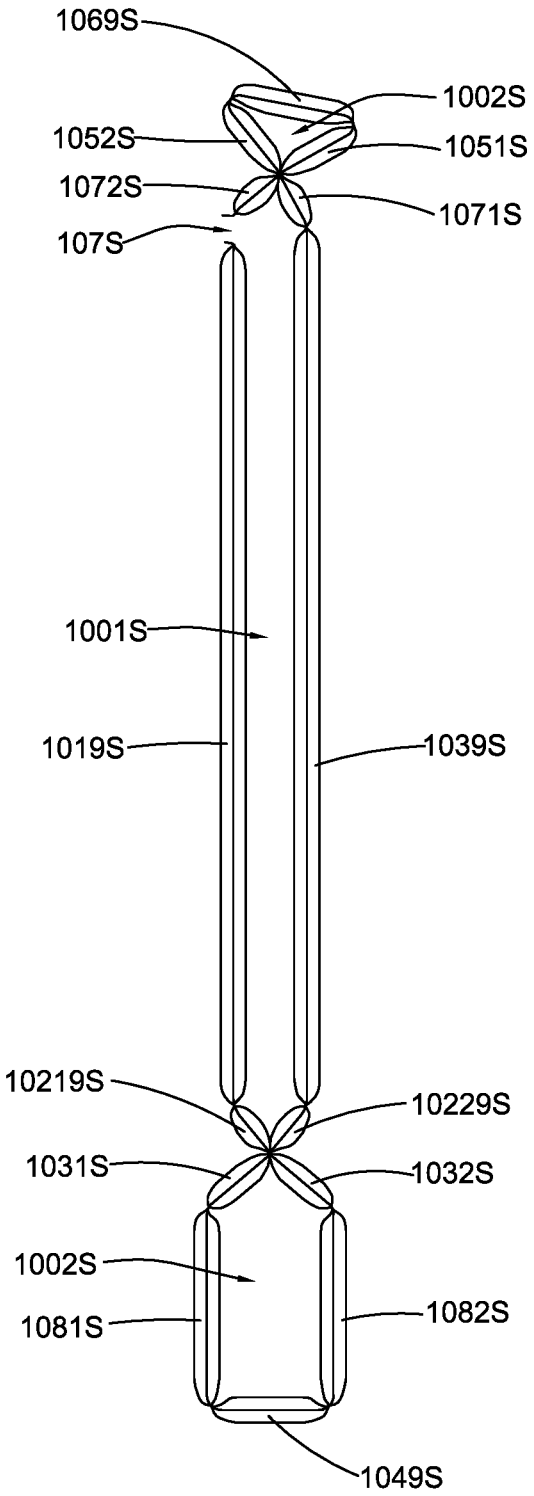
FIG. 53 is a sectional view of the inflated air-filling packaging apparatus according to the above 10th preferred embodiment of the present invention.

FIGS. 52-53 illustrated a 10th preferred embodiment of the present invention, which is also an alternative mode of the above preferred embodiment of the present to invention, while the main differences include the structure of the subsidiary portion 120R.

Specifically, referring to FIGS. 52-53, the air-filling packaging apparatus comprises a main accommodating portion 110S, a subsidiary portion 120S, and a lid portion 130S. The bending seam 37S comprises intermittently heat-sealed first bending seam 371S, two second bending seam 372S and third bending seam 373S, fourth bending seam 374S, fifth bending seam 375S, sixth bending seam 376S, and seventh bending seam 377S. Each the bending seam divides each the air-storing unit 13S into a plurality of sub-air-storing units 131S, 1321S, 1322S, 1331S, 1332S, 1341S, 1342S, 135S, 1351S, 136S, 1371S, 1372S, 138S, and 139S. Because each the connecting channel 132S can communicate adjacent air-storing units 13S, each adjacent sub-air-storing units 131S, 1321S, 1322S, 1331S, 1332S, 1341S, 1342S, 135S, 1351S, 136S, 1371S, 1372S, 138S, and 139S can all be communicated and interconnected. Hence, the air cushion body 10S is adapted for being bent along the bending seam 37S so as to form a plurality of side walls of the air-filling packaging apparatus. Specifically, the first bending seams 371S, two second bending seams 372S and third bending seams 373S, a fourth bending seam 374S, a fifth bending seam 375S, and a sixth bending seam 376S are bent to form a first side wall 1019S, a second side wall 1039S, a first connecting wall 10219S, a second connecting wall 10229S, a third connecting wall 1071S, a first subsidiary side wall 1031S, a second subsidiary side wall 1032S, a third subsidiary side wall 1049S, a fourth subsidiary side wall 1051S, a fifth subsidiary side wall 1052S, a sixth subsidiary side wall 1069S, a seventh subsidiary side wall 1081S, an eighth subsidiary side wall 1082S, and an end wall 1072S of the air-filling packaging apparatus.

In other words, the first side wall 1019S, the second side wall 1039S, the first connecting wall 10219S, and the second connecting wall 10229R form the main accommodating portion 110S, the first subsidiary side wall 1031S, a second subsidiary side wall 1032S, a third subsidiary side wall 1049S, the sixth subsidiary side wall 1069S, and the seventh subsidiary side wall 1081S form the subsidiary portion 120S, and the fourth subsidiary side wall 1051S, the fifth subsidiary side wall 1052S, the sixth subsidiary side wall 1069S, the third connecting wall 1071S, and the end wall 1072S form the lid portion 130S all through a series of the 2D heat-sealing seams 30S and the second heat-sealing of the 3D heat-sealing seams 40S. In other words, the sub-air-storing units 131S, 135S, 1321S, and 1322S are arranged in a ringlike manner so as to form the main accommodating portion 110S. The sub-air-storing units 1331S, 1332S, and 1342S are arranged in a ringlike manner so as to form the subsidiary portion 120S. The sub-air-storing units 136S, 1371S, 1372S, 138S, and 139S are arranged in a ringlike manner so as to form the lid portion 130S.

Hence, according to the embodiment of the present invention, the object to be packaged is, for example, a laptop, wherein the main accommodating portion 110S of the air cushion body 10S is adapted for accommodating the laptop. The laptop is completely accommodated in the main accommodating chamber 1001S and may touch the first side wall 1019S and the second side wall 1039S. The first side wall 1019S and the second side wall 1039S provide cushioning function for the laptop. The first connecting wall 10219S and the second connecting wall 10229S provide cushioning function for the object on the bottom side and increase the cushion thickness between the subsidiary portion 120S and the main accommodating portion 110S. The flank cushion portions on the two sides of the main accommodating portion 110S provide cushioning function for the laptop on the sides. The buffer gap 1002S of the lid portion 130S provides deformation space. After the lid portion 130S close the opening 107S, the third connecting wall 1071S and the end wall 1072S can increase the cushion thickness between the lid portion 130S and the main accommodating portion 110S. The buffer gap 1002S of the subsidiary portion 120S also enhances the cushioning function for the laptop on the bottom. It is worth mentioning that because the seventh subsidiary side wall 1081S and the eighth subsidiary side wall 1082S enlarge the space of the buffer gap 1002S, the subsidiary portion 120S of the air cushion body 10S may also be suitable for accommodating the accessory of the laptop. It avoids the main body and accessory of the laptop from contacting and colliding each other and provides accommodation and buffer gap for the accessory of the laptop, so as to prevent the laptop from being damaged when the accessory of the laptop is accommodated in the buffer gap 1002S.

Figure 54:
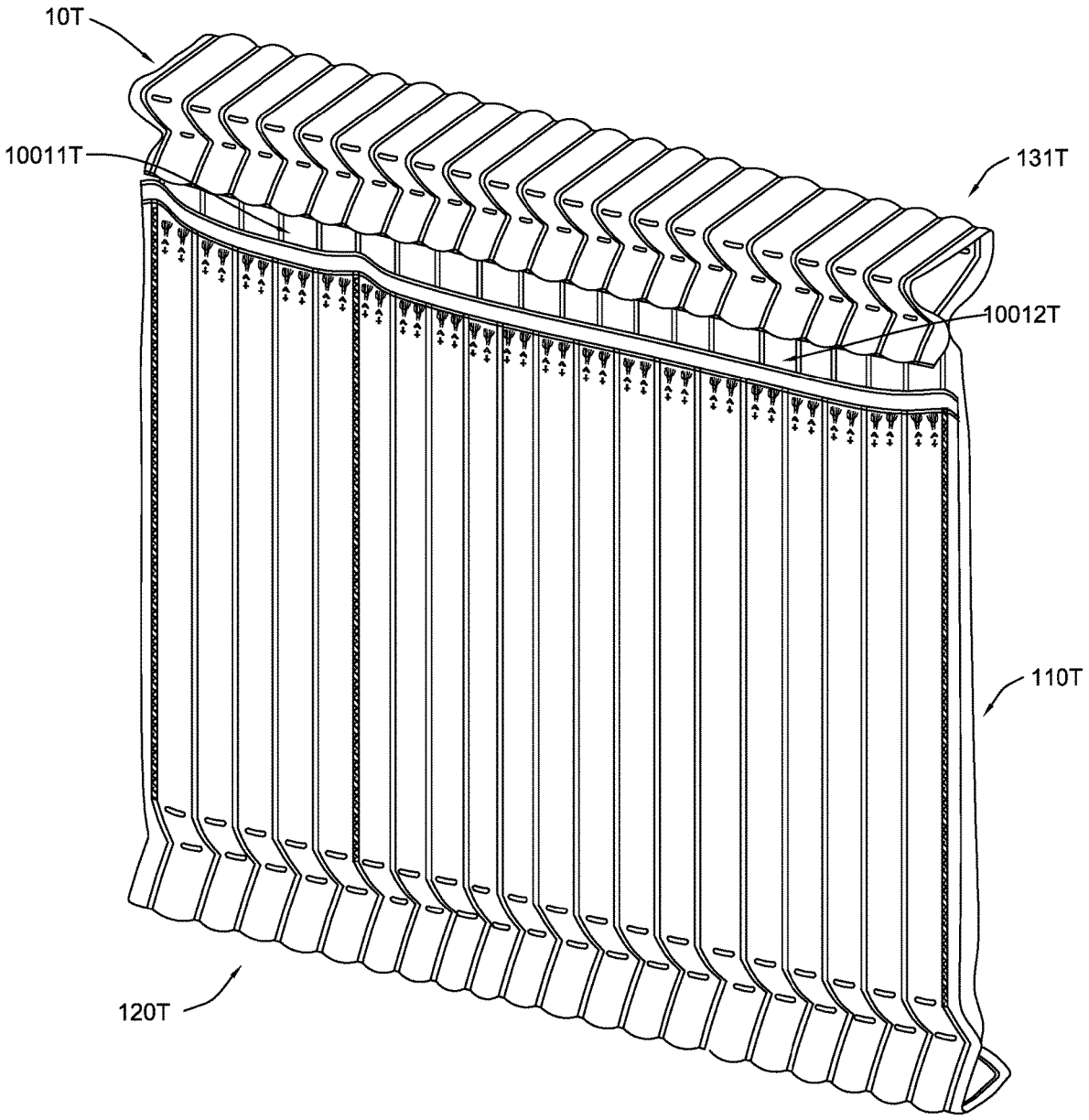
FIG. 54 is a 3D perspective view of the air-filling packaging apparatus according to a 11th preferred embodiment of the present invention.
Figure 55:
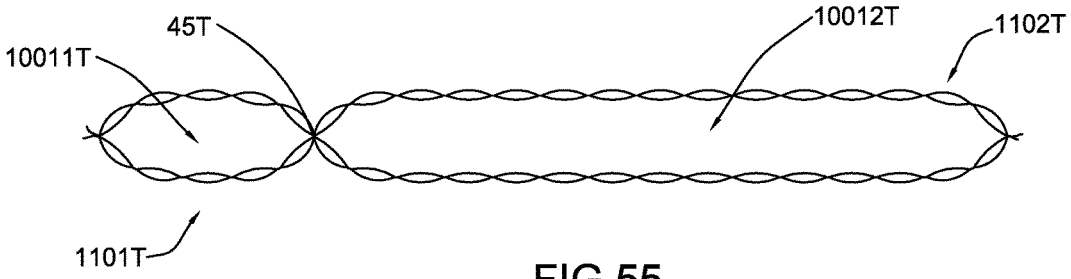
FIG. 55 is a sectional view of the inflated air-filling packaging apparatus according to the above 11th preferred embodiment of the present invention.
Figure 56:
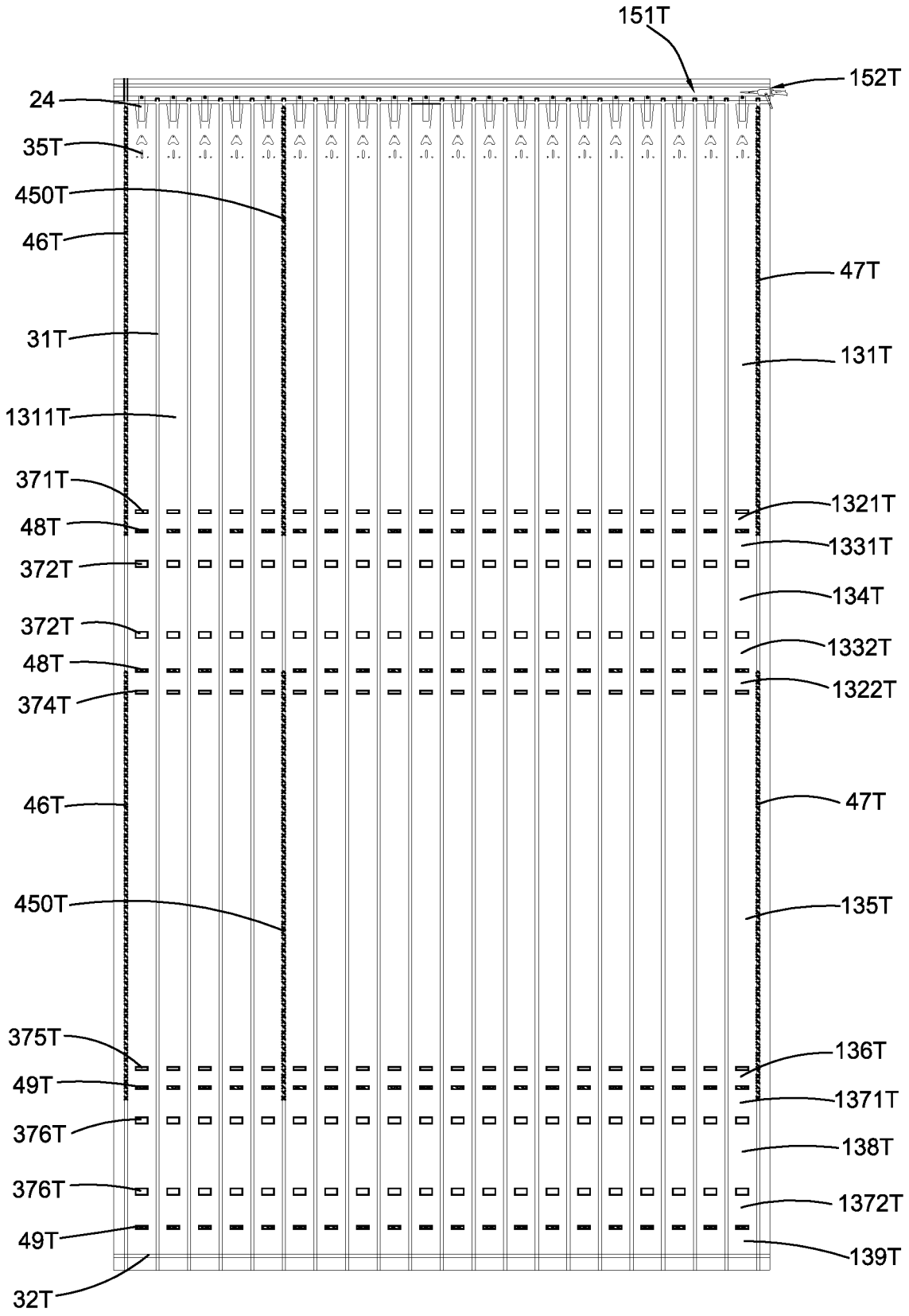
FIG. 56 is a perspective view illustrating the uninflated air-filling packaging apparatus being expanded in a plane manner according to the above 11th preferred embodiment of the present invention.

According to another aspect of the present invention, FIGS. 54-56 illustrate a 11th preferred embodiment of the present invention. The differences between the above ninth preferred embodiment and the above 10th preferred embodiment include that the main accommodating chamber 1001R is divided into two accommodating chambers, wherein one of the accommodating chambers is for accommodating the main body of the object, the other accommodating chamber is for accommodating the accessory of the object. In other words, the air-filling packaging apparatus according to the above third preferred embodiment of the present invention comprises a main accommodating portion 110T, a subsidiary portion 120T, and a lid portion 130T after being bent, heat-sealed, and inflated. The main accommodating portion 110T has a first main accommodating chamber 10011T and a second main accommodating chamber 10012T.

Specifically, referring to FIG. 56, the bending seam 37T comprises intermittently heat-sealed first bending seam 371T, two second bending seam 372T, third bending seam 373T, fourth bending seam 374T, fifth bending seam 375T, and sixth bending seam 376T. Each the bending seam divides each the air-storing unit 13T into a plurality of sub-air-storing units 131T, 1311T, 1321T, 1322T, 1331T, 1332T, 134T, 135T, 1351T, 136T, 1371T, 1372T, 138T, and 139T. Because each the connecting channel 132T can communicate adjacent air-storing units 13T, each adjacent sub-air-storing units 131T, 1311T, 1321T, 1322T, 1331T, 1332T, 134T, 135T, 1351T, 136T, 1371T, 1372T, 138T, and 139T can all be communicated and interconnected.

The 3D heat-sealing seams 40T comprise a left 3D heat-sealing seam 46T on the left side of the air cushion body 10T, a right 3D heat-sealing seam 47T on the right side of the air cushion body 10R, a first main accessory 3D heat-sealing seam 48T, a second main accessory 3D heat-sealing seam 49T, and a chamber 3D heat-sealing seam 450T. According to this embodiment of the present invention, the first main accessory 3D heat-sealing seam 48T and the second main accessory 3D heat-sealing seam 49T are arranged parallelly to the bending seam 37T, while the left 3D heat-sealing seam 46T, the right 3D heat-sealing seam 47T, and the chamber 3D heat-sealing seam 450T are arranged parallelly to the dividing seams 31T.

In other words, the air cushion body 10T obtains the main accommodating portion 110T, the subsidiary portion 120T, and the lid portion 130T through the above-mentioned plane heat-sealing and 3D heat-sealing. Specifically, the sub-air-storing units 131T, 1311T, 135T, 1351T, 1321T, and 1322T are arranged in a ringlike manner so as to form the main accommodating portion 110T through a second heat-sealing of the 3D heat-sealing seams 40T and a series of the 2D heat-sealing seams 30T. The sub-air-storing units 1331T, 1332T, and 134T are arranged in a ringlike manner so as to form the subsidiary portion 120T. The sub-air-storing units 136T, 1371T, 1372T, 138T, and 139T are arranged in a ringlike manner so as to form the lid portion 130T.

It is worth mentioning that the heat-sealing of the chamber 3D heat-sealing seam 450T divided the main accommodating chamber 1001T of the main accommodating portion 110T into a first accommodating portion 1101T and a second accommodating portion 1102T. Namely, the main accommodating portion 110T has two accommodating chambers, which are respectively a first accommodating chamber 10011T and a second accommodating chamber 10012T. In other words, the sub-air-storing units 131T, 135T, 1321T, and 1322T are arranged in a ringlike manner so as to form the first accommodating portion 1101T. The sub-air-storing units 1311T and 1351T are surroundingly arranged so as to form the second accommodating portion 1102T.

According to this embodiment of the present invention, the first accommodating chamber 10011T is spatially smaller than the second accommodating chamber 10012T. Hence, the first accommodating chamber 10011T can be utilized to package the accessory of the object, while the second accommodating chamber 10012T can be utilized to package the main body of the object. For instance, if the object is a laptop, the second accommodating chamber 10012T can be utilized to package the main body of the laptop, while the first accommodating chamber 10011T can be utilized to package the accessory of the laptop, such as mouse, and power adapter. Thus, it can avoid damage of the laptop caused by collision between the main body and the accessory of the laptop during the transportation. Besides, it also provides cushion protection in all directions for the laptop. Of course, person skilled in the art should be able to understand that the sizes of the first accommodating chamber and the second accommodating chamber in this embodiment of the present invention shall not be limited thereto, but may change based on the object and the needs.

FIG. 57-60 illustrate the air-filling packaging apparatus according to a 12th preferred embodiment of the present invention, which has an inflatable body structure, wherein after the air-filling packaging apparatus was inflated, it will have a main accommodating chamber and an accessory chamber. The inflated main accommodating chamber is for providing air cushioning function for various packaged contents, such as electronic products, food, medical products, chemical products, biological materials, plastics and ceramics, fast moving consumer goods, and etc. The accessory chamber is for providing air cushioning function for the accessories of the object as well as providing a second cushioning function for the object. The air-filling packaging apparatus can be easily stored and transported in a non-inflated state before use, while it can then be inflated on site, which is convenient to use. For instance, the air-filling packaging apparatus can be utilized for packaging a laptop, wherein the main accommodating chamber is for packaging the main body of the laptop, while the accessory chamber is for packaging the accessory, such as power adapter, mouse, and etc., of the laptop. Because the air packaging bag has an air cushioning function, so as to be suitable for providing air cushioning effect for the object. Person skilled in the art should be able to understand that the above mentioned object could not be limited to the above mentioned examples. Instead, the air-filling packaging apparatus of the present invention may also be suitable for packaging other article(s).

It is worth mentioning that the medium for the air-filling packaging apparatus according to the present invention to provide cushioning function is fluid, such as gas and liquid.

According to this preferred embodiment, the air-filling packaging apparatus can be embodied as an air cushion substance which is filled with air for example. Certainly, person skilled in the art should be able to understand that it can be other gas according to the needs of the application. According to this preferred embodiment, it can form a 3D packaging bag after being inflated, so as to provide air cushioning function for object.

Specifically, according to the above preferred embodiment, the air-filling packaging apparatus comprises at least an air cushion body 10U. Namely, either one of the air cushion body 10U forms a 3D packaging bag or a plurality of the air cushion bodies 10U form the 3D packaging bag through heat-sealing connecting, such as adhesive bonding, heat-sealing, and etc. The embodiment illustrated in FIGS. 57-60 is formed by one air cushion body 10U. More specifically, referring to FIGS. 57, 59, and 71A, the air cushion body 10U comprises at least two air chamber films 11U and 12U forming the 3D packaging bag comprising one or more interconnected air-storing units 13U through a series of 2D heat-sealing seams 30U and 3D heat-sealing seams 40U, wherein each the air-storing unit 13U forms a air storage chamber 14U that is able to store gas therein.

Figure 59:
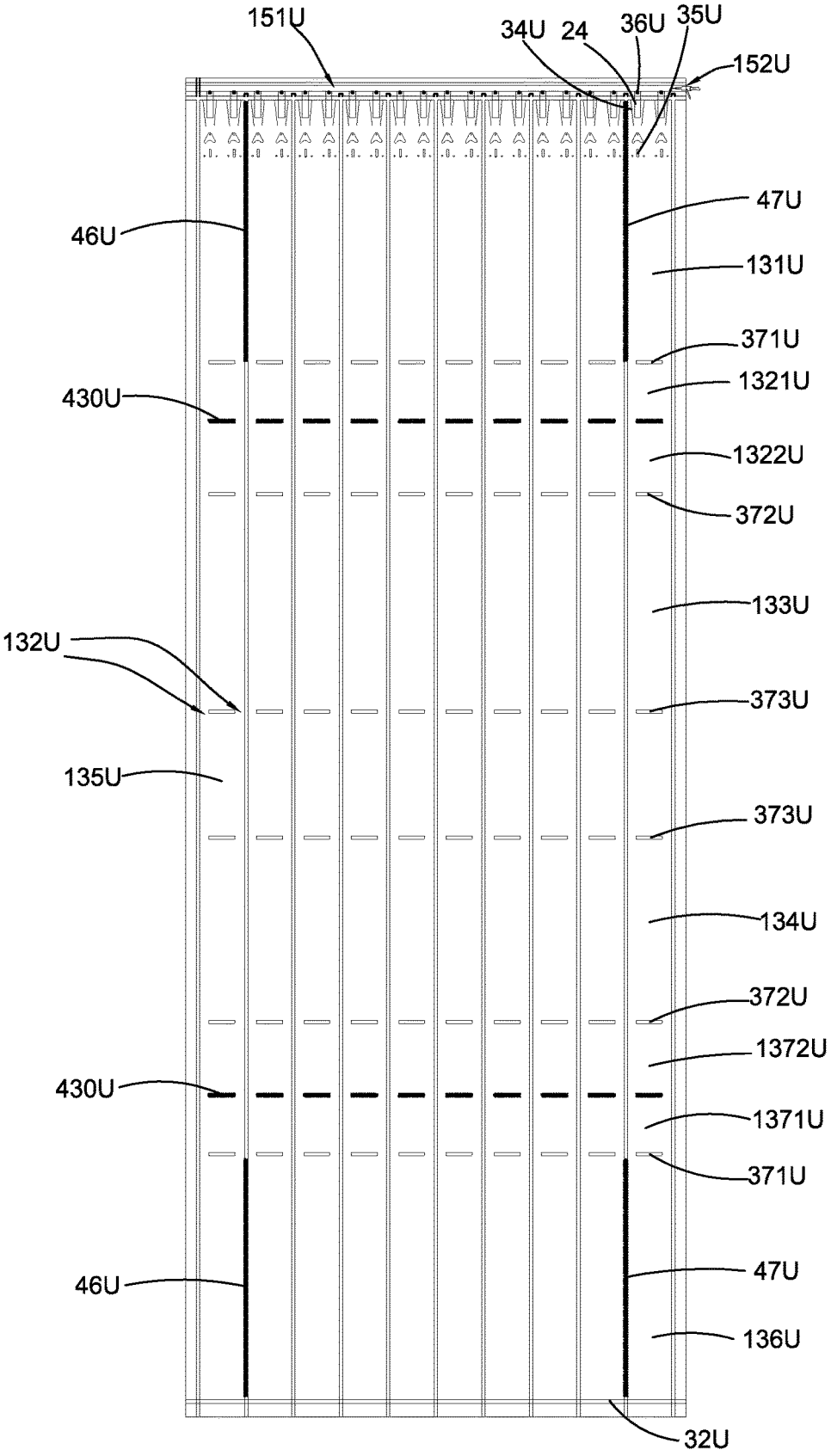
FIG. 59 is a perspective view illustrating the uninflated air-filling packaging apparatus being expanded in a plane manner according to the above 12th preferred embodiment of the present invention.
Figure 60:
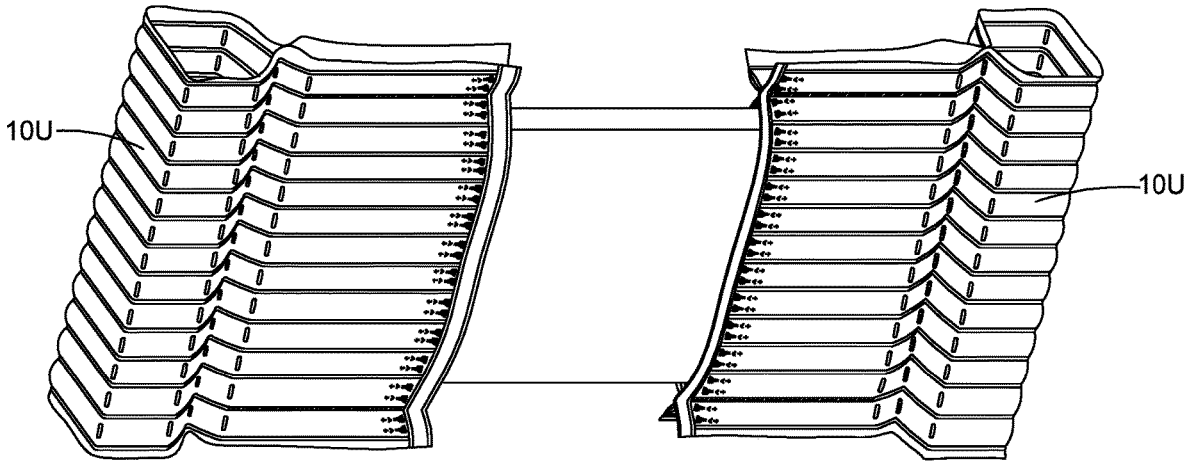
FIG. 60 is a perspective view of the air-filling packaging apparatus being utilized to package a object according to the above 12th preferred embodiment of the present invention.

Person skilled in the art should be able to understand that the 2D heat-sealing seams 30U is for making the multiple films into a 2D cushion material, as FIG. 59 illustrates, through heat-sealing. The 3D heat-sealing seams 40U is additional heat-sealing on the above 2D cushion material to turn the air-filling packaging apparatus into a 3D packaging device that has a 3D structure and can accommodate the object, as FIG. 59 illustrated. The 2D heat-sealing seams 30U and the 3D heat-sealing seams 40U can connect multiple layers of films together through adhesive bonding, heat-sealedly connect, and etc. Preferably, according to this preferred embodiment, the 2D heat-sealing seams 30U and the 3D heat-sealing seams 40U are both formed through heat-sealing technology.

More specifically, referring to FIG. 59, the 2D heat-sealing seams 30U comprises a plurality of dividing seams 31U dividing the two air chamber films 11U and 12U into a plurality of the air-storing units 13U. Preferably, each row of the dividing seams 31U is formed by heat-sealing technology that heat-sealedly connects two layers of the air chamber films 11U and 12U so as to form a row of the dividing seam 31U between two adjacent air-storing units 13U. The dividing seam 31U may be an continuous heat-sealed line so as to have a plurality of the air-storing units 13U be independent to one another. Therefore, when one of the air-storing units 13U was damaged to leak, the rest of the air-storing units 13U will not be affected. Certainly, it is worth mentioning that the air-storing units 13U can also be interconnected, such that it requires only one inflation valve 20 to fill gas into all air-storing units 13U. In other words, the air-filling packaging apparatus according to the present invention can form a plurality of the air-storing units 13U through heat-sealing the first air chamber layer 11U and the second air chamber layer 12U.

Figure 57:
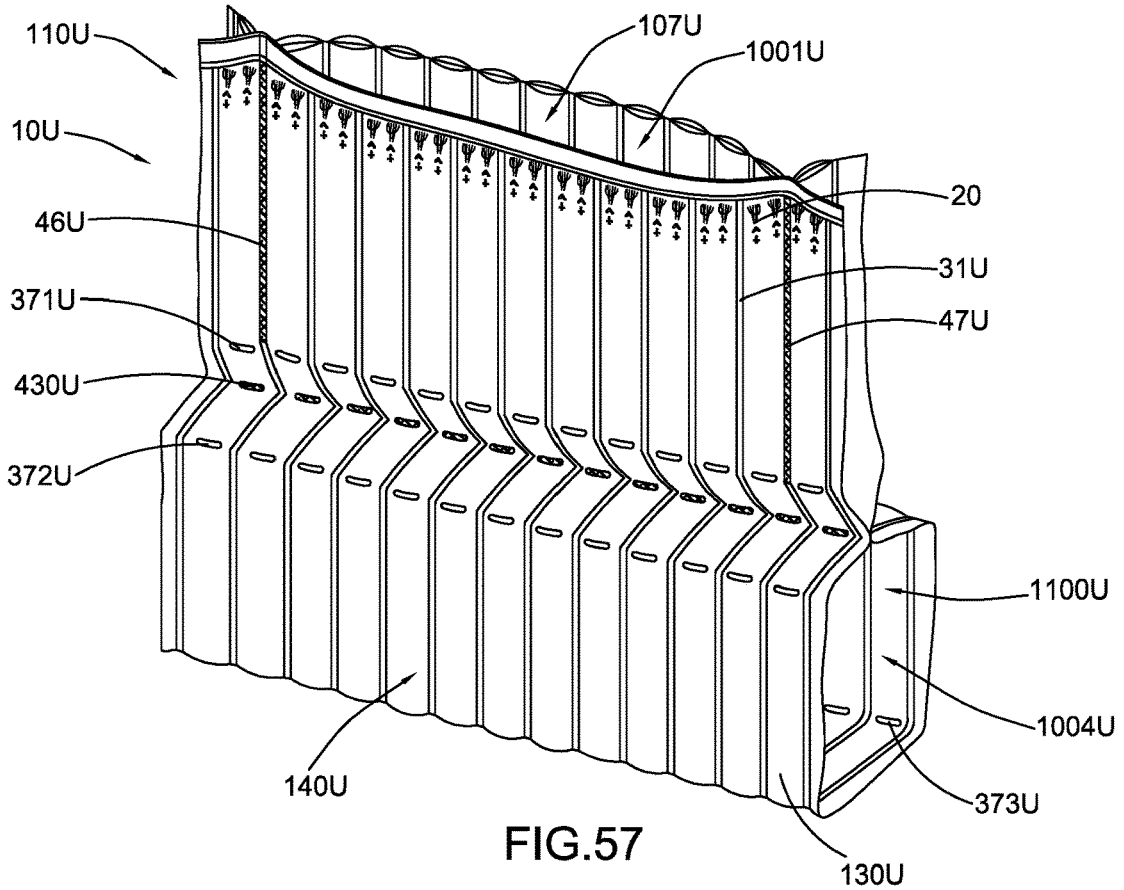
FIG. 57 is a 3D perspective view of the air-filling packaging apparatus according to a 12th preferred embodiment of the present invention.

It is understandable that the dividing seam 31U on the top side and the bottom side can respectively become a top side boundary seam and a bottom side boundary seam of the air cushion body 10U, as FIG. 57 illustrated. It is worth mentioning that the top side and bottom side mentioned here are relative concepts defined based on the relative positions to the air-filling packaging apparatus and the transverse. In other words, when the dividing seam 31U of the air-filling packaging apparatus is perpendicular to the transverse, a top side and a bottom side will be defined. On the other hand, when the dividing seam 31U of the air-filling packaging apparatus is parallel to the transverse, a left side and a right side will be defined. The dividing seam 31U may also be an intermittent heat-sealed line so as to have a plurality of the air-storing units 13U be interconnected. The air-storing unit 13U may have various shapes, such as linear shape, circular shape, polygonal shape, irregular shape, and etc. Referring to FIGS. 57-60, the air cushion body 10U according to the present invention may comprise a plurality of air-storing pillars of the same size abreast arranged or a plurality of air-storing pillars of different sizes abreast arranged. In addition, the arrangements of the large or small air-storing pillars can be diverse, such as in an alternate manner, having only small air-storing pillars regionally, and etc., while the present invention shall not be limited thereto.

Figure 68:
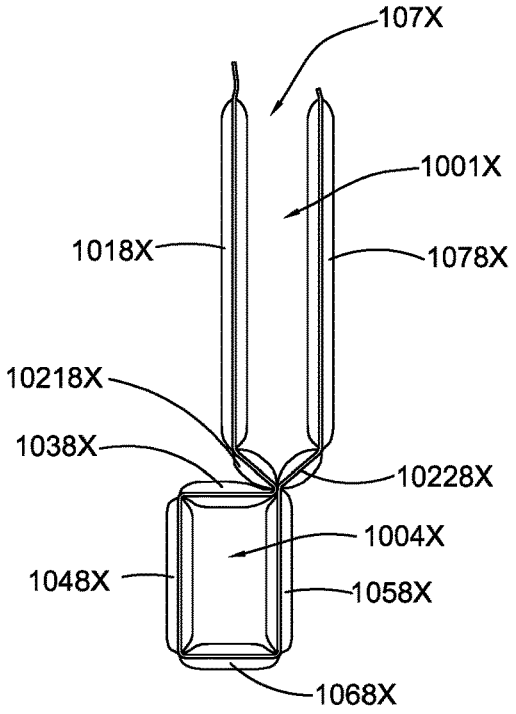
FIG. 68 is a sectional view of the inflated air-filling packaging apparatus according to the above 15th preferred embodiment of the present invention.

According to the above preferred embodiment, FIGS. 71A-71C illustrated perspective views of the inflation valve 20 according to the present invention. Referring to FIG. 71A, the air-filling packaging apparatus further comprises an inflation valve 20 to formed by at least two valve films 21 and 22. The two valve films 21 and 22 of the inflation valve 20 and the air chamber films 11U and 12U are overlappedly arranged. Besides, an air inlet channel 23 is formed between the valve films 21 and 22 for inflating to the air storage chamber 14U. It is understandable that the lengths of the valve films 21 and 22 are shorter than the lengths of the air chamber films 11U and 12U. When the air storage chamber 14U is inflated via the air inlet channel 23 and the air pressure in the air storage chamber 14U has attained the predetermined required value, the air pressure in the air storage chamber 14U will act on the valve films 21 and 22 so as to attach the valve films 21 and 22 on one of the air chamber film, which closes the air inlet channel 23 and makes the inflation valve 20 serve as a one-way valve. When each air-storing unit 13U has at least an air inlet channel 23 formed therein and each of the air-storing units 13U is independent to one another, even if one of the air-storing units 13U is damaged and leaks, the rest of the air-storing units 13U will not be affected, but still serve as air cushions. Referring to FIG. 71B, the inflation valve 20 can further comprise an additional layer of valve film 25 between the two valve films 21 and 22 so as to enhance the sealing property. Referring to FIG. 68, the inflation valve 20 can further comprise a layer of valve film 26 arranged between the air chamber film 12 and the valve film 22, which is to be arranged on the outer side of the two valve films 21 and 22, so as to prevent the junction between the valve film 22 and the air chamber film 12 from being torn, such that the connection can be strengthened and stabilized. It is understandable that the specific structures of the inflation valve 20 are just examples, rather than limits to the scope of the present invention.

It is understandable that the air chamber films 11U and 12U of the air cushion body 10U and the valve films 21 and 22 of the inflation valve 20 can respectively be made of various suitable membrane materials, such as polyethylene film, polypropylene film, polyvinyl chloride film, polyester film, polystyrene film, composite film, and etc., wherein the present invention shall not be limited thereto, as long as suitable flexible films are utilized. It is worth mentioning that in order to enhance the one-way sealing function, the valve films 21 and 22 of the inflation valve 20 can also be self-adhesive films acquired by adding chemical composition to the above films.

The air cushion body 10H further comprises a main channel unit 15U connected with each of the air-storing units 13U or, preferably, integrally extended from each of the air-storing units 13U. More specifically, according to an embodiment, the extending directions of the main channel unit 15U and the air-storing unit 13U are perpendicular to each other. For example, according to an embodiment, each the air-storing unit 13U is extended along a longitudinal direction, while the main channel unit 15U is extended along a transverse direction. The main channel unit 15U forms a main channel 151U that has an inflation inlet 152U. When the inflation inlet 152U has an inflation nozzle arranged thereat for conducting an inflation process, gas will enter the main channel 151U from the inflation inlet 152U along a transverse direction, and enter each the air-storing unit 13U along a longitudinal direction. Then, when the air pressure of each the air storage chamber 14U reaches a predetermined value, the valve films 21 and 22 of the inflation valve 20 will attached on one of the air chamber films 11U and 12U, so as to self-seal and prevent the inflated gas from reversing into the main channel 151U.

It is understandable that the main channel unit 15U can be formed by two layers of the air chamber films 11U and 12U, two layers of the valve films 21 and 22, or either one layer of the air chamber films 11U and 12U and either one layer of the valve films 21 and 22.

Referring to FIG. 59, the 2D heat-sealing seams 30U further comprise a continuously sealed edge sealing seam 32U respectively on the left and right sides and a continuously sealed main channel sealing seam 33U on the left side of the air cushion body 10U, wherein the main channel 151U is formed between the left edge sealing seam 32U and the main channel sealing seam 33U. It is understandable that the edge sealing seam 32U is formed through heat-sealing technology, such as adhesive bonding, heat-sealing, and etc., to sealedly connect the two air chamber films 11U and 12U. The main channel sealing seam 33U is formed through heat-sealing technology, such as adhesive bonding, heat-sealing, and etc., to sealingly connect the two air chamber films 11U and 12U and the two valve films 21 and 22 respectively, as FIGS. 71A-71C illustrated. For example, the main channel sealing seam 33U on the up and down sides that was formed through a first heat-sealing technology respectively heat-sealedly connects the air chamber film 11 and the valve film 21 at the position corresponding to the air inlet channel 23, heat-sealedly connects the air chamber film 12 and the valve film 22, and integrally heat-sealedly connects multiple layers of films at the rest places, which also divides the air cushion body 10U into the main channel unit 15U and the air-storing unit 13U.

Referring to FIG. 71A-71C, each of the air-storing units 13U is arranged near the main channel 151U, wherein the valve films 21 and 22 are further heat-sealedly connected with the air chamber film 11U through a plurality of connecting seams 35U, such that when the air pressure in the air storage chamber 14U attained a predetermined value, the air pressure will act on the valve films 21 and 22 and because of the arrangement of the connecting seams 35U, the valve films will be pushed toward the air chamber film 11U and eventually be attached on the air chamber film 11U, so as to close the air inlet channel 23. That is to say, the connecting seam 35U heat-sealedly connects the two valve films 21 and 22 and the air chamber film 11. Besides, referring to FIG. 71A-71C, the shape of each connecting seam 35U allows it to further prevent the air from backflow. In other words, when the air in the air storage chamber 14U is going to flow back, it will be obstructed by the connecting seam 35U and cannot return into the main channel 151U easily. In addition, when the 2D heat-sealing seams 30U are being formed through heat-sealing, the air inlet channel 23 of the valve films 21 and 22 of the inflation valve 20 can be formed through the arrangement a heatproof barrier device. Then the heatproof barrier device can be removed after the heat-sealing process. According to an embodiment, referring to FIGS. 71A-71C, a heatproof layer 24 is arranged between the valve films 21 and 22 of the inflation valve 20 and connected with the main channel 151U, so as to prevent the access from being closed by heat-sealing. The heatproof layer 24 can be embodied as thermostable inks and etc. According to an embodiment, the main channel 151U is formed by the two air chamber films 11U and 12U, the heatproof layer 24 and the valve films 21 and 22 respectively have extending section extended into the main channel 151U, and the 2D heat-sealing seams 30U further comprises a joint seam 36U longitudinally and spacingly arranged at the position corresponding to the extending section of the heatproof layer 24. Because of the arrangement of the heatproof layer 24, the joint seam 36U respectively connects the two air chamber films 11U and 12U and the two valve films 21 and 22, while the two valve films 21 and 22 are not heat-sealedly connected with each other. The arrangement of the joint seam 36U allows adjacent valve films 21 and 22 and the correspondingly connected air chamber films 11U and 12U to be expanded together to open the corresponding air inlet channel 23 when air enters the main channel 151U during the inflation of the air cushion body 10U.

The 2D heat-sealing seams 30U further comprises a plurality intermittent bending seam 37U, wherein the inflated air cushion body 10U is adaptable for bending along the bending seam 37U, such that the air cushion body 10U can form a plurality of side walls. More specifically, the bending seam 37U divides each of the air-storing units into a plurality of sub-air-storing units 130U. The bending seam 37U can be arranged in the middle of the air-storing units 13U and respectively form a connecting channel 132U on the two sides thereof such that the adjacent sub-air-storing units 130U can be interconnected and communicated, as FIG. 59 illustrated. It is understandable that the bending seam 37U can also be arranged on the two sides of the air-storing units 13U, while the connecting channel 132U is arranged in the middle of the air-storing units 13U. Correspondingly, it is understandable that each the bending seam 37U heat-sealedly connects two layers of the air chamber films 11U and 12U.

Further, referring to FIGS. 57-61, according to the above 12th preferred embodiment of the present invention, the bending seam 37U comprises intermittently heat-sealed first bending seam 371U, second bending seam 372U, and third bending seam 373U, which divide each air-storing unit 13U into a plurality of sub-air-storing units 131U, 1321U, 1322U, 133U, 134U, 135U, 136U, 1371U, and 1372U. Because each the connecting channel 132U can connect and communicate the adjacent air-storing units 13U, each adjacent sub-air-storing units 131U, 1321U, 1322U, 133U, 134U, 135U, 136U, 1371U, and 1372U can be connected and communicated. Hence, the air cushion body 10U is adapted for being bent along the bending seam 37U so as to form a plurality of side walls of the air-filling packaging apparatus. Specifically, the two first bending seams 371U, the two second bending seams 372U, and the third bending seam 373U are bent to form a first main side wall 1018U, a second main side wall 1078U, a first main connecting wall 10218U, a second main connecting wall 10228U, a first accessory connecting wall 10318U, a second accessory connecting wall 10328U, a first side subsidiary wall 1048U, a second side subsidiary wall 1058U, and a third side subsidiary wall 1068U of the air-filling packaging apparatus. Correspondingly, referring to FIGS. 57-60, the 3D heat-sealing seams 40U comprises a left 3D heat-sealing seam 46U on the left side of the air cushion body 10U, a right 3D heat-sealing seam 47U on the right side of the air cushion body 10W, and a main accessory 3D heat-sealing seam 430U between the first bending seam 371U and the second bending seam 372U. The left 3D heat-sealing seam 46U heat-seals the left sides of each first main side wall 1018U and each second main side wall 1078U. The right 3D heat-sealing seam 47U heat-seals the right sides of each first main side wall 1018U and each second main side wall 1078U. The main accessory 3D heat-sealing seam 430U heat-seals the first main connecting wall 10218U and the second main connecting wall 10228U. The main accessory 3D heat-sealing seam 430U heat-seals the first accessory connecting wall 10318U and the second accessory connecting wall 10328U.

Hence, the air cushion body 10U obtains a main accommodating portion 110U and an accessory accommodating portion 140U through the above-mentioned plane heat-sealing 3D heat-sealing. In other words, the first main side wall 1018U, the second main side wall 1078U, the first main connecting wall 10218U, and the second main connecting wall 10228U form the main accommodating portion 110U through a series of the 2D heat-sealing seams 30U and a second heat-sealing of the 3D heat-sealing seams 40U. Namely, the sub-air-storing units 131U, 1321, 1371, and 136 are arranged in a ringlike manner to form the main accommodating portion 110U, which has an opening 107U on the top thereof and a main accommodating chamber 1001U. The main accommodating portion 110U is utilized for packaging the main body of the object. The main body of the object is put into the main accommodating chamber 1001U through the opening 107U. The first main connecting wall 10218U and the second main connecting wall 10228U can be utilized as the bottom portion of the main accommodating portion 110U to provide cushioning function.

Figure 58:
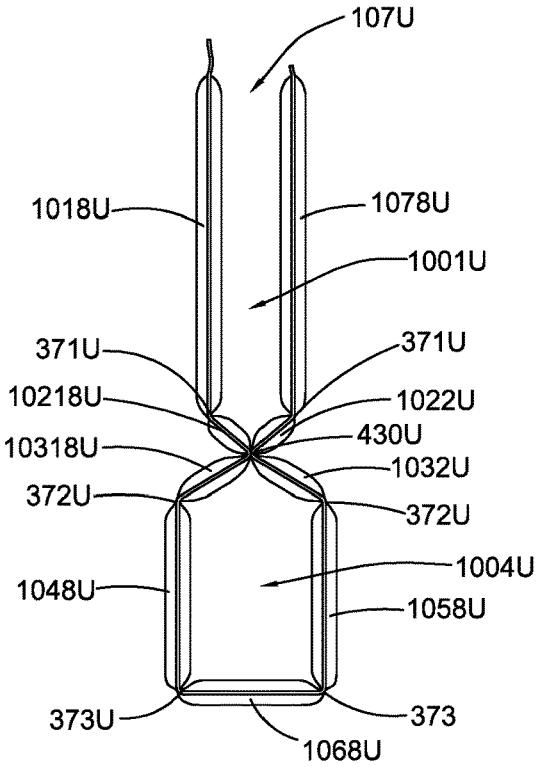
FIG. 58 is a sectional view of the inflated air-filling packaging apparatus according to the above 12th preferred embodiment of the present invention.

Similarly, the first accessory connecting wall 10318U, the second accessory connecting wall 10328U, the first side subsidiary wall 1048U, the second side subsidiary wall 1058U, and the third side subsidiary wall 1068U form the accessory accommodating portion 140U through a series of the 2D heat-sealing seams 30U and the second heat-sealing of the 3D heat-sealing seams 40U, as FIG. 58 illustrated. Namely, the sub-air-storing units 13U22, 133, 134, 135, and 1372 are surroundingly arranged to form the accessory accommodating portion 140U. The accessory accommodating portion 140U comprises two accessory accommodating portion openings 107U and an accessory chamber 1004U. The accessory accommodating portion 140U is utilized for packaging the accessory of the object. The accessory of the object is put into the accessory chamber 1004U through the accessory accommodating portion opening 107U. The first accessory connecting wall 10318U and the second accessory connecting wall 10328U can be utilized as the top portion of the accessory accommodating portion to provide cushioning function.

It is worth mentioning that the first main connecting wall 10218U and the second main connecting wall 10228U as well as the first accessory connecting wall 10318U and the second accessory connecting wall 10328U provide cushioning function for the main accommodating portion 110U and the accessory accommodating portion 140U and thicken the cushion between the main accommodating portion 110U and the accessory accommodating portion 140U.

It is worth mentioning that the length of the first main side wall 1018U and the length of the second main side wall 1078U can be the same or different. Similarly, the length of the first main connecting wall 10218U and the length of the second main connecting wall 10228U can be the same or different. The length of the first accessory connecting wall 10318U and the length of the second accessory connecting wall 10328U can be the same or different. The length of the first side subsidiary wall 1048U and the length of the second side subsidiary wall 1058U can be the same or different.

According to this preferred embodiment, for instance, preferably, the length of the first main side wall 1018U and the length of the second main side wall 1078U are the same; the length of the first main connecting wall 10218U and the length of the second main connecting wall 10228U are the same; the length of the first accessory connecting wall 10318U and the length of the second accessory connecting wall 10328U are the same; and the length of the first side subsidiary wall 1048U and the length of the second side subsidiary wall 1058U are the same. Certainly, it is understandable that there could also be other reasonable alternative modes.

It is worth mentioning that according to this preferred embodiment of the present invention, the left 3D heat-sealing seam 46U and the right 3D heat-sealing seam 47U respectively form a flank cushion portion 16U on the two sides of the main accommodating portion of the air-filling packaging apparatus. The 3D heat-sealing seam 46U and 47U are respectively arranged between the two adjacent air-storing units 13U on the left and right sides, so as to respectively turn one or more of the air-storing units on the outermost left and right sides into the flank cushion portions 16U. Referring to FIGS. 57 and 59, the leftmost sub-air-storing units 131U and 136U of the main accommodating portion 110U of the air cushion body 10U are bent through the bending seam 371U and heat-sealed through the left 3D heat-sealing seam to form a left flank cushion portion 16U that has a buffer space. The rightmost sub-air-storing units 131U and 136U of the air cushion body 10U are bent through the bending seam 371U and heat-sealed through the right heat-sealing seam 47U to form a right flank cushion portion 16U that has a buffer space. Hence, the flank cushion portions 16U on the two sides of the main accommodating portion 110U of the air cushion body 10U are to reinforce the side cushioning function. In other words, the flank cushion portion 16U provides cushioning function on the side of the main accommodating portion 110U.

Referring to FIGS. 57-60, according to this preferred embodiment, the main accommodating portion 110U of the air cushion body 10U is adapted for accommodating the main part of the object. The main part of the object accommodated in the main accommodating chamber 1001U can touch the first main side wall 1018U and the second to main side wall 1078U. The first main side wall 1018U and the second main side wall 1078U provide cushioning function for the main body of the object, the first main connecting wall 10218U and the second main connecting wall 10228U provide cushioning function on the bottom side for the main body of the object, and the flank cushion portion 16U provides cushioning function on the side of the object. The accessory accommodating portion 140U of the air cushion body 10U is suitable for accommodating the accessory of the object, wherein the accessory of the object is accommodated in the accessory chamber 1004U and is allowed to contact the first side subsidiary wall 1048U, the second side subsidiary wall 1058U, and the third side subsidiary wall 1068U. The first accessory connecting wall 10318U and the second accessory connecting wall 10328U can provide cushioning function on the top side for the accessory of the object. In other words, the accessory accommodating portion 140U avoids the main body and accessory of the object from contacting and colliding each other and provides accommodation for the accessory of the object, so as to prevent the object from being damaged.

It is worth mentioning that when the accessory accommodating portion 140U does not accommodate the accessory of the object, the accessory chamber 1004U may still be considered as a buffer space that provides a second cushioning function for the main body of the object.

It is worth mentioning that when the air cushion body 10U is utilized to bear the object and is inflated with gas, the inner surfaces of the first main side wall 1018U and the second main side wall 1078U may or may not attach the outer surface of the object. For example, one may also add a packing bag to wrap the object. According to this embodiment, referring to FIG. 60, the object is, for instance, a laptop M. The main body of the laptop M can be partially or fully put in the main accommodating chamber 1001U. Preferably, in order to retain the laptop M and prevent it from sliding during transportation, there is one of the air cushion bodies 10U respectively arranged on the two sides of the laptop M. That is to say, the laptop M can be packaged through coupling two of the air-filling packaging apparatuses. Namely, the present invention provides a packaging assembly, which comprises two of the air-filling packaging apparatuses, wherein two extremities of the laptop M are respectively accommodated in two accommodating chambers 1001U of the air-filling packaging apparatuses that have sloping cushion portions, wherein the entire package is put in other packing case or packaging box so as for storing or transporting the laptop M.

Correspondingly, the accessories of the laptop M, such as power adapter, mouse, and etc., are adapted to be put in the accessory chamber 1004U of the air-filling packaging apparatus. When the laptop M was impacted or shocked due to external factors, the air-filling packaging apparatus can provide cushion for the laptop M, such that the main body of the laptop M will not directly collide with the accessory, which reduce the risk of damage of the laptop M. The accessory accommodating portion 140U can also be utilized to provide a second cushioning function for the main body of the laptop M.

Correspondingly, when the flank cushion portion 16U receives external shock or impact, the external shock or impact will not directly pass through the flank cushion portion 16U to the object, which means the flank cushion portion 16U provides a cushion so as to achieve the cushioning function.

It is worth mentioning that the 3D heat-sealing seams 40U can be continuous heat-sealed seams or intermittent heat-sealed seams. The left and right 3D heat-sealing seams 46U and 47U can be respectively located at the dividing seam 31U on the sides of the air cushion body 10U or be formed with the dividing seam 31U through a first heat-sealing process at the same time. According to the above preferred embodiment, the left and right 3D heat-sealing seams 46U and 47U can respectively be an independent heat-sealed seam formed on the left or right edge of the air cushion body 10U.

Figure 61:
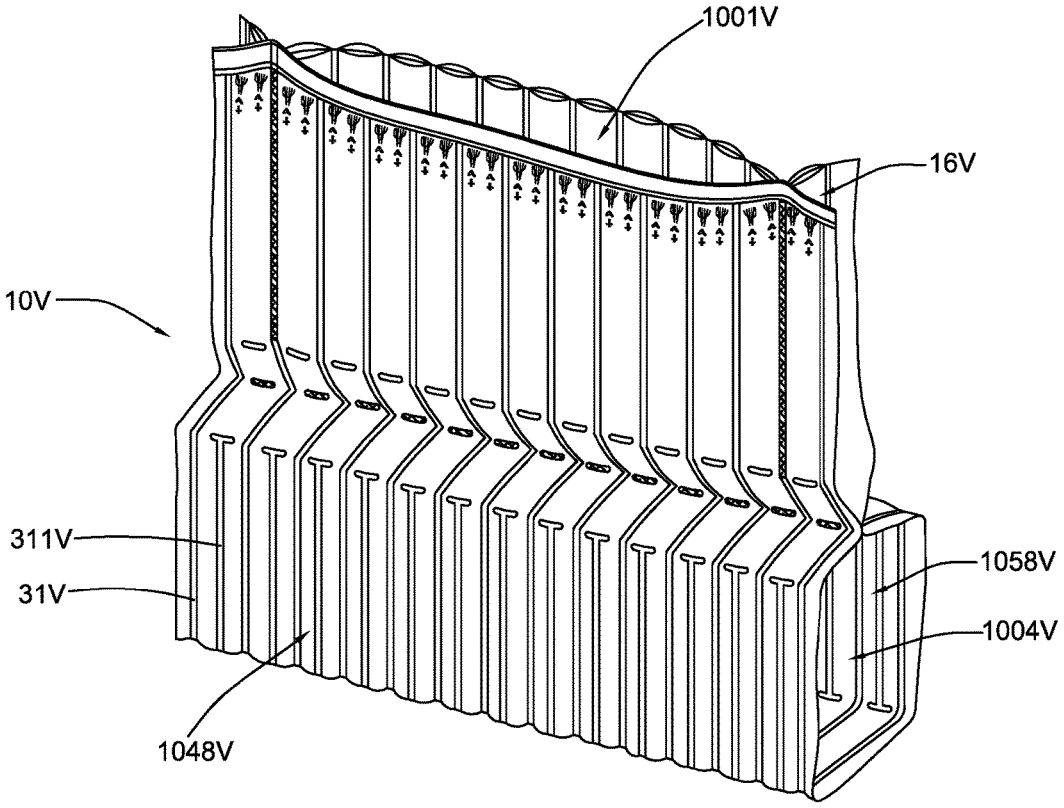
FIG. 61 is a 3D perspective view of the air-filling packaging apparatus according to a 13th preferred embodiment of the present invention.
Figure 62:
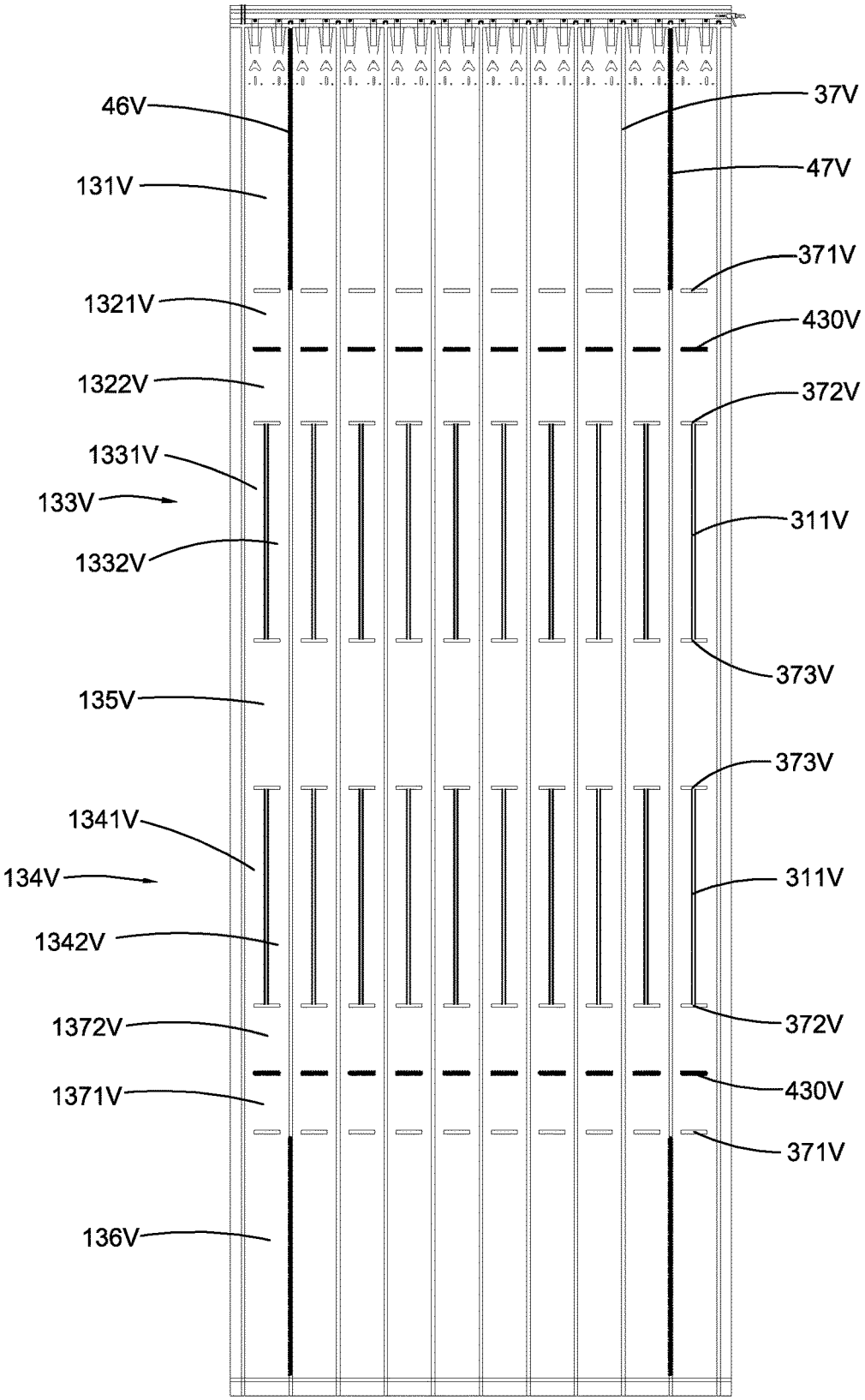
FIG. 62 is a perspective view illustrating the uninflated air-filling packaging apparatus being expanded in a plane manner according to the above 13th preferred embodiment of the present invention.
Figure 63:
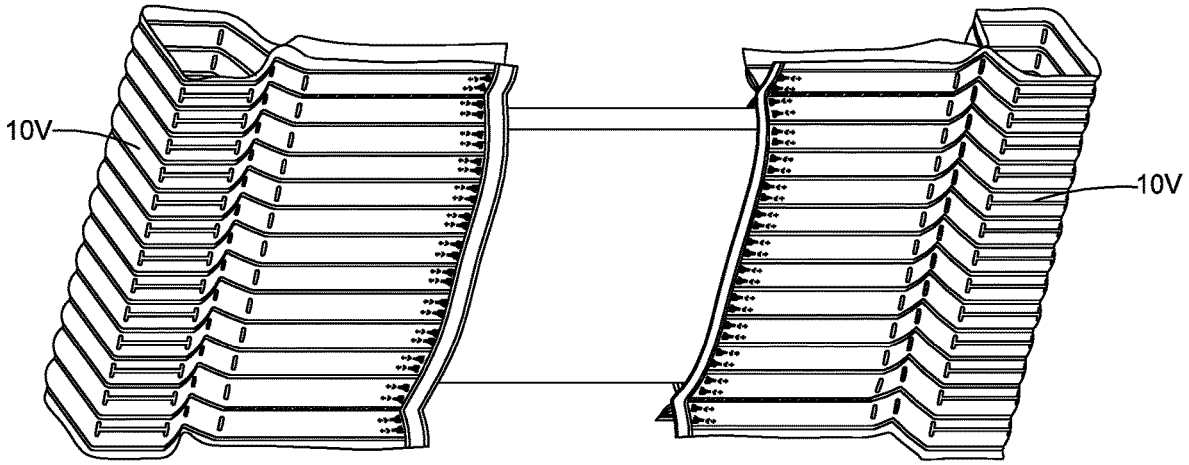
FIG. 63 is a perspective view of the air-filling packaging apparatus being utilized to package a object according to the above 13th preferred embodiment of the present invention.

FIGS. 61-63 illustrate a 13th preferred embodiment of the present invention. Similarly, it is, for example, inflated. According to this embodiment, the air-filling packaging apparatus comprises an air cushion body 10V. The 3D packaging apparatus formed by the heat-sealed and inflated air cushion body 10V has a main accommodating portion 110V and an accessory accommodating portion 140V. The structure of the main accommodating portion 110U is the same with it in the above preferred embodiment, while the accessory accommodating portion 140V is different here.

Specifically, according to this embodiment of the present invention, the bending seam 37V comprises intermittently heat-sealed first bending seam 371V, second bending seam 372V, and third bending seam 373V, which divide each air-storing unit 13V into a plurality of sub-air-storing units 131V, 1321V, 1322V, 133V, 134V, 135V, 136V, 1371V, and 1372V. Because each the connecting channel 132V can connect and communicate the adjacent air-storing units 13V, each adjacent sub-air-storing units 131V, 1321V, 1322V, 133V, 134V, 135V, 136V, 1371V, and 1372V can be connected and communicated. Hence, the air cushion body 10V is adapted for being bent along the bending seam 37V so as to form a plurality of side walls of the air-filling packaging apparatus.

Unlike the above 12th preferred embodiment, the sub-air-storing units 133V and 134V have different air chamber structures with the sub-air-storing units 131V, 1321V, 1322V, 135V, 136V, 1371V, and 1372V. More specifically, the sub-air-storing units 133V and 134V are further divided into a plurality of branch inflation units 1331V, 1332V, 1341V, and 1342V by a sub-dividing seam.

Specifically, the two first bending seams 371V, the two second bending seams 372V, and the third bending seam 373V are bent to form a first main side wall 1018V, a second main side wall 1078V, a first main connecting wall 10218V, a second main connecting wall 10228V, a first accessory connecting wall 10318V, a second accessory connecting wall 10328V, a first side subsidiary wall 1048V, a second side subsidiary wall 1058V, and a third side subsidiary wall 1068V of the air-filling packaging apparatus. Correspondingly, referring to FIGS. 61-63, the 3D heat-sealing seams 40V comprises a left 3D heat-sealing seam 46V on the left side of the air cushion body 10V, a right 3D heat-sealing seam 47V on the right side of the air cushion body 10W, and a main accessory 3D heat-sealing seam 430V between the first bending seam 371V and the second bending seam 372V. The left 3D heat-sealing seam 46V heat-seals the left sides of each first main side wall 1018V and each second main side wall 1078V. The right 3D heat-sealing seam 47V heat-seals the right sides of each first main side wall 1018V and each second main side wall 1078V. The main accessory 3D heat-sealing seam 430V heat-seals the first main connecting wall 10218V and the second main connecting wall 10228V. The main accessory 3D heat-sealing seam 430V heat-seals the first accessory connecting wall 10318V and the second accessory connecting wall 10328V.

In other words, the first main side wall 1018V, the second main side wall 1078V, the first main connecting wall 10218V, and the second main connecting wall 10228V form the main accommodating portion 110V through a series of the 2D heat-sealing seams 30V and a second heat-sealing of the 3D heat-sealing seams 40V. Namely, the sub-air-storing units 131V, 1321V, 1371V, and 136V are arranged in a ringlike manner to form the main accommodating portion 110V, which has an opening 107V on the top thereof and a main accommodating chamber 1001V. The main accommodating portion 110U is utilized for packaging the main body of the object. The main body of the object is put into the main accommodating chamber 1001V through the opening 107V. The first main connecting wall 10218V and the second main connecting wall 10228V can be utilized as the bottom portion of the main accommodating portion 110V to provide cushioning function.

Similarly, the first accessory connecting wall 10318V, the second accessory connecting wall 10328V, the first side subsidiary wall 1048V, the second side subsidiary wall 1058V, and the third side subsidiary wall 1068V form the accessory accommodating portion 140V through a series of the 2D heat-sealing seams 30V and the second heat-sealing of the 3D heat-sealing seams 40V, as FIG. 61 illustrated. Namely, the sub-air-storing units 1322V, 1331V, 1332V, 1341V, 1342V, 135V, and 1372V are surroundingly arranged to form the accessory accommodating portion 140V. The accessory accommodating portion 140V comprises two accessory accommodating portion openings 107V and an accessory chamber 1004V. The accessory accommodating portion 140V is utilized for packaging the accessory of the object. The accessory of the object is put into the accessory chamber 1004V through the accessory accommodating portion opening 107V. The first accessory connecting wall 10318V and the second accessory connecting wall 10328V can be utilized as the top portion of the accessory accommodating portion to provide cushioning function.

In other words, according to this embodiment, unlike the above preferred embodiment, the main accommodating portion 110V forms large diameter air chamber structure, while the accessory accommodating portion 140V forms partially small diameter air chamber and partially large diameter air chamber structure. Therefore, the main accommodating portion 110V and the accessory accommodating portion 140V can form a multilayer air chamber structure arrangement, where each layer of the air chamber provides cushioning function of a different level.

Person skilled in the art should be able to understand that according to other embodiment of the present invention, the accessory accommodating portion 140V can comprise small diameter air chamber structure at all. The present invention shall not be limited thereto.

Figure 64:
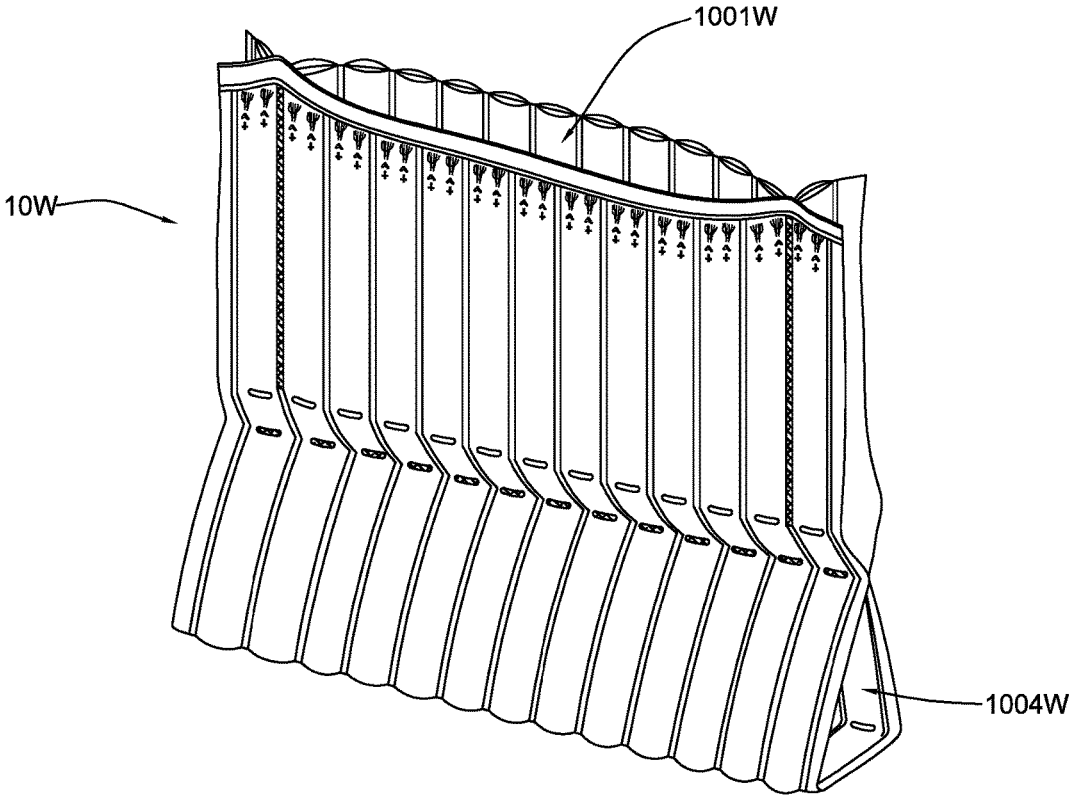
FIG. 64 is a 3D perspective view of the air-filling packaging apparatus according to a 14th preferred embodiment of the present invention.
Figure 65:
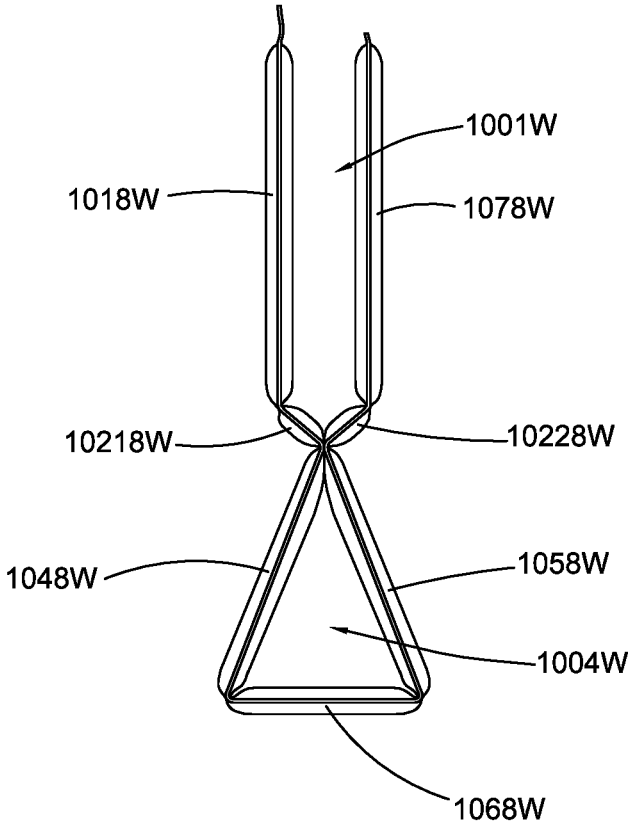
FIG. 65 is a sectional view of the inflated air-filling packaging apparatus according to the above 14th preferred embodiment of the present invention.
Figure 66:
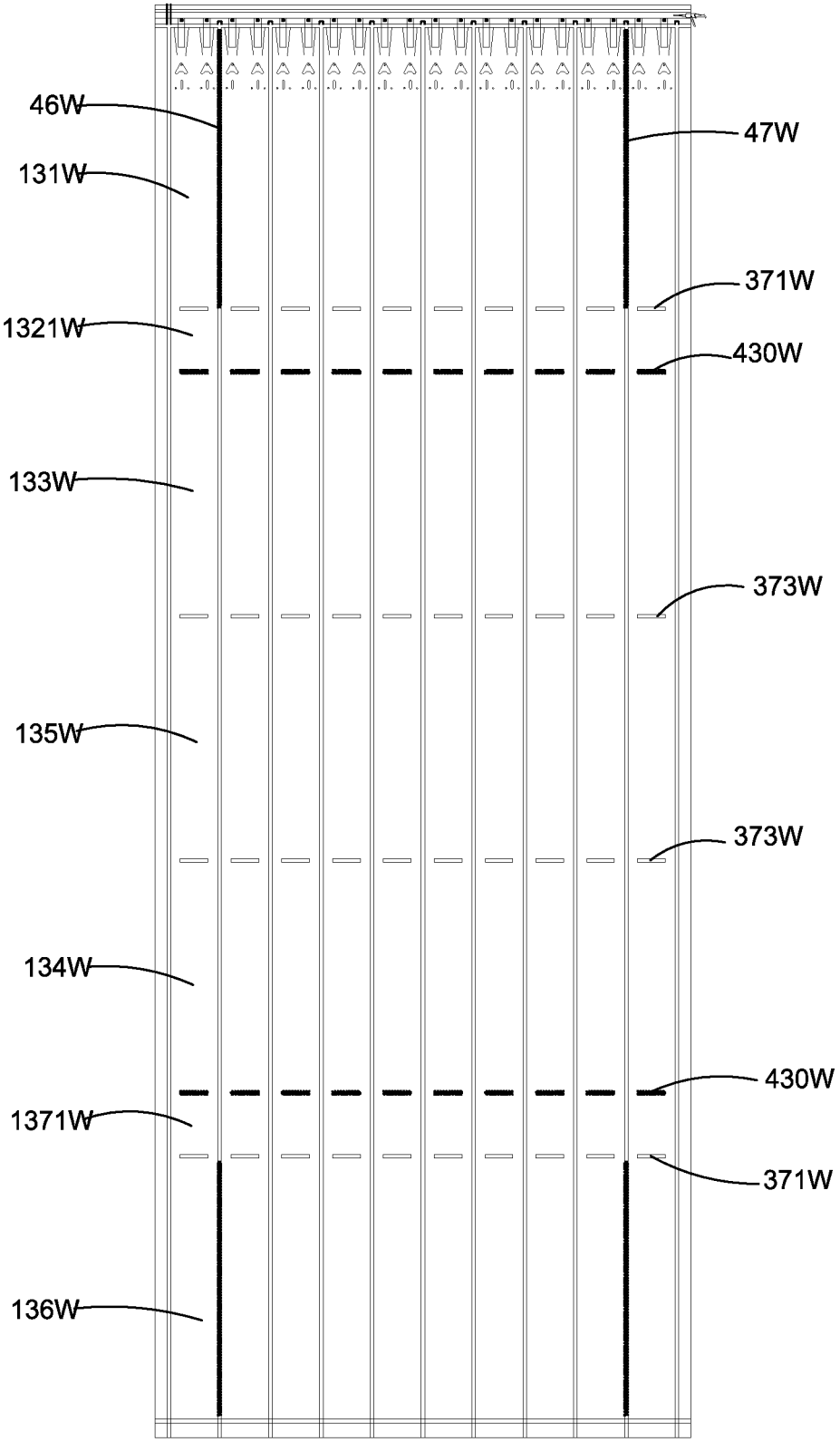
FIG. 66 is a perspective view illustrating the uninflated air-filling packaging apparatus being expanded in a plane manner according to the above 14th preferred embodiment of the present invention.

According to a 14th preferred embodiment illustrated in FIGS. 64-66, the air-filling packaging apparatus comprises an air cushion body 10W. The 3D packaging apparatus formed by the heat-sealed and inflated the air cushion body 10W has a main accommodating portion 110W and an accessory accommodating portion 140W. The structure of the main accommodating portion 110W is the same with it of the above preferred embodiment of the present invention, while the accessory accommodating portion 140W is different here.

Specifically, according to this embodiment of the present invention, unlike the above preferred embodiment, the air cushion body 10W does not have the second bending seam 372W thereof. In other words, according to this embodiment of the present invention, the bending seam 37W comprises intermittently heat-sealed first bending seam 371W and third bending seam 373W that divide each air-storing unit 13W into a plurality of sub-air-storing units 131W, 1321W, 1322W, 133W, 134W, 136W, and 1371W. Because each the connecting channel 132W can connect and communicate the adjacent air-storing units 13W, each adjacent sub-air-storing units 131W, 1321W, 1322W, 133W, 134W, 136W, and 1371W can be connected and communicated. Hence, the air cushion body 10W is adapted for being bent along the bending seam 37W so as to form a plurality of side walls of the air-filling packaging apparatus.

Specifically, the two first bending seams 371W and the third bending seam 373W are bent to form a first main side wall 1018W, a second main side wall 1078W, a first main connecting wall 10218W, a second main connecting wall 10228W, a first side subsidiary wall 1048W, a second side subsidiary wall 1058W, and a third side subsidiary wall 1068W of the air-filling packaging apparatus. Correspondingly, referring to FIGS. 64-66, the 3D heat-sealing seams 40W comprises a left 3D heat-sealing seam 46W on the left side of the air cushion body 10W, a right 3D heat-sealing seam 47W on the right side of the air cushion body 10W, and a main accessory 3D heat-sealing seam 430W between the first bending seam 371W and the third bending seam 373W. The left 3D heat-sealing seam 46W heat-seals the left sides of each first main side wall 1018W and each second main side wall 1078W. The right 3D heat-sealing seam 47W heat-seals the right sides of each first main side wall 1018W and each second main side wall 1078W. The main accessory 3D heat-sealing seam 430W heat-seals the first main connecting wall 10218W and the second main connecting wall 10228W.

In other words, the first main side wall 1018W, the second main side wall 1078W, the first main connecting wall 10218W, and the second main connecting wall 10228W form the main accommodating portion 110W through a series of the 2D heat-sealing seams 30W and a second heat-sealing of the 3D heat-sealing seams 40W. Namely, the sub-air-storing units 131W, 1321W, 1371W, and 136W are arranged in a ringlike manner to form the main accommodating portion 110W, which has an opening 107W on the top thereof and a main accommodating chamber 1001W. The main accommodating portion 110W is utilized for packaging the main body of the object. The main body of the object is put into the main accommodating chamber 1001W through the opening 107W. The first main connecting wall 10218W and the second main connecting wall 10228W can be utilized as the bottom portion of the main accommodating portion 110W to provide cushioning function.

Similarly, the first side subsidiary wall 1048W, the second side subsidiary wall 1058W, and the third side subsidiary wall 1068X form the accessory accommodating portion 140W through a series of the 2D heat-sealing seams 30W and the second heat-sealing of the 3D heat-sealing seams 40W, as FIG. 66 illustrated. Namely, the sub-air-storing units 1322W, 133W, 134W, and 135W are surroundingly arranged to form the accessory accommodating portion 140W. The accessory accommodating portion 140W comprises two accessory accommodating portion openings 107W and an accessory chamber 1004W. The accessory accommodating portion 140W is utilized for packaging the accessory of the object. The accessory of the object is put into the accessory chamber 1004W through the accessory accommodating portion opening 107W.

It is worth mentioning that, according to other alternative modes of the present embodiment, the main accommodating portion 110W can form a large diameter air chamber structure, small diameter air chamber structure, or combination of large and small diameter air chamber structures. Similarly, the accessory accommodating portion 140W can form a large diameter air chamber structure, small diameter air chamber structure, or combination of large and small diameter air chamber structures. The present invention shall not be limited thereto. Therefore, the main accommodating portion 110W and the accessory accommodating portion 140W can form an arrangement having multilayer air chamber structure, where the each layer of the air chamber can provide a different level of cushioning function.

Figure 67:
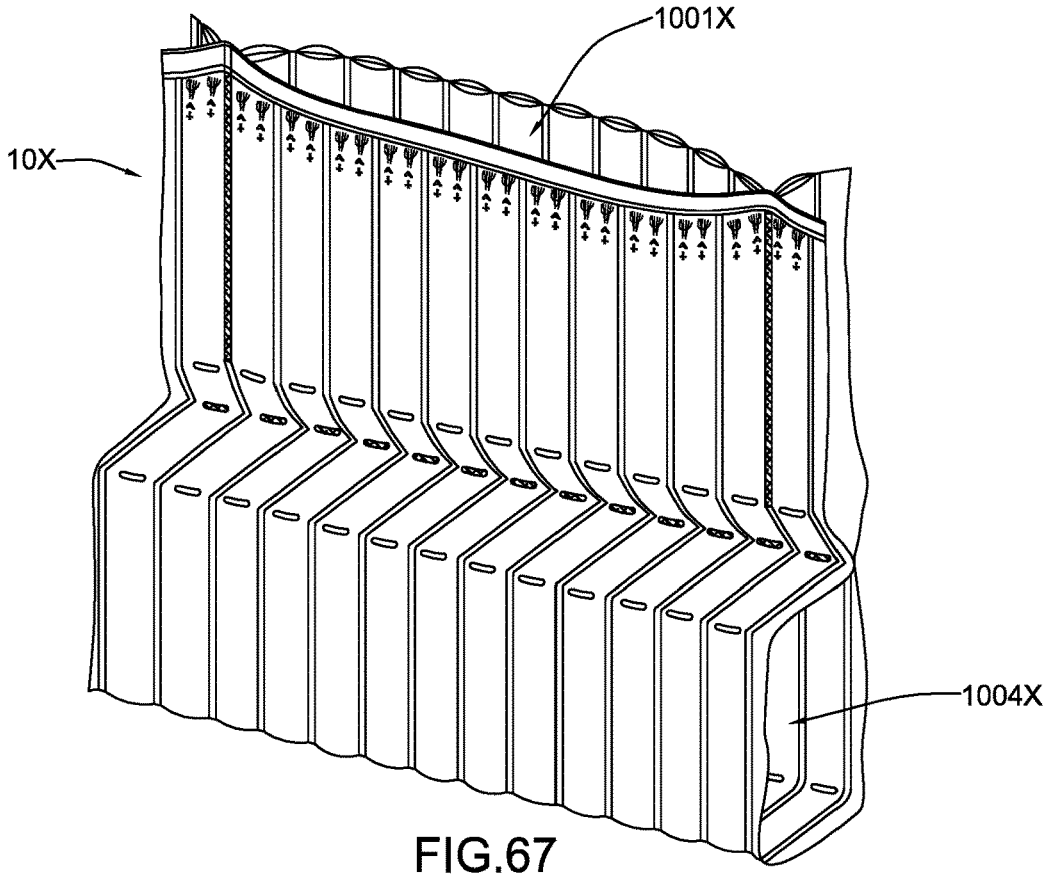
FIG. 67 is a 3D perspective view of the air-filling packaging apparatus according to a 15th preferred embodiment of the present invention.
Figure 69:
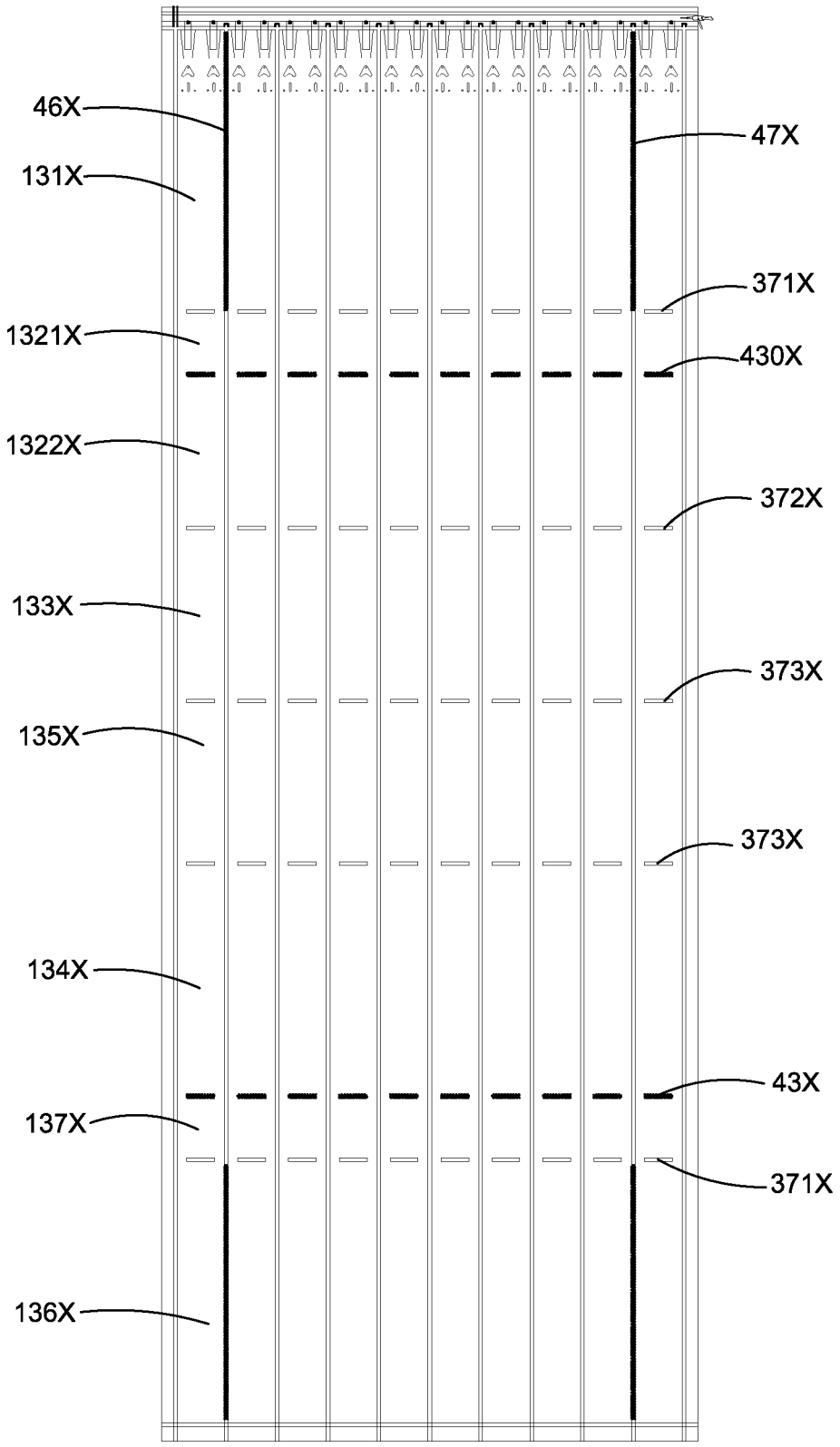
FIG. 69 is a perspective view illustrating the uninflated air-filling packaging apparatus being expanded in a plane manner according to the above 15th preferred embodiment of the present invention.

According to a 15th preferred embodiment illustrated in FIGS. 67-69, the air-filling packaging apparatus comprises an air cushion body 10X. The 3D packaging apparatus formed by the heat-sealed and inflated the air cushion body 10X has a main accommodating portion 110X and an accessory accommodating portion 140X. The structure of the main accommodating portion 110X is the same with it of the above preferred embodiment of the present invention, while the accessory accommodating portion 140X is different here.

Specifically, according to this embodiment of the present invention, the bending seam 37X comprises two first bending seams 371X, a second bending seam 372X, and two third bending seam 373X that are intermittently heat-sealed and divide each air-storing unit 13X into a plurality of sub-air-storing units 131X, 1321X, 1322X, 133X, 134X, 135X, 136X, and 137X. Because each the connecting channel 132X can connect and communicate the adjacent air-storing units 13X, each adjacent sub-air-storing units 131X, 1321X, 1322X, 133X, 134X, 135X, 136X, and 137X can be connected and communicated. Hence, the air cushion body 10X is adapted for being bent along the bending seam 37X so as to form a plurality of side walls of the air-filling packaging apparatus.

Specifically, the two first bending seams 371X, the second bending seam 372X, and the third bending seam 373X are bent to form a first main side wall 1018X, a second main side wall 1078X, a first main connecting wall 10218X, a second main connecting wall 10228X, a first side subsidiary wall 1048X, a second side subsidiary wall 1058X, a third side subsidiary wall 1068X, and a fourth subsidiary side wall 1038X of the air-filling packaging apparatus. Correspondingly, referring to FIGS. 67-69, the 3D heat-sealing seams 40X comprises a left 3D heat-sealing seam 46X on the left side of the air cushion body 10X, a right 3D heat-sealing seam 47X on the right side of the air cushion body 10R, and a main accessory 3D heat-sealing seam 430X. The left 3D heat-sealing seam 46X heat-seals the left sides of each first main side wall 1018X and each second main side wall 1078X. The right 3D heat-sealing seam 47X heat-seals the right sides of each first main side wall 1018X and each second main side wall 1078X. The main accessory 3D heat-sealing seam 430X heat-seals the first main connecting wall 10218X and the second main connecting wall 10228X.

In other words, the first main side wall 1018X, the second main side wall 1078X, the first main connecting wall 10218X, and the second main connecting wall 10228X form the main accommodating portion 110X through a series of the 2D heat-sealing seams 30X and a second heat-sealing of the 3D heat-sealing seams 40X. Namely, the sub-air-storing units 131X, 1321X, 137X, and 136X are arranged in a ringlike manner to form the main accommodating portion 110X, which has an opening 107X on the top thereof and a main accommodating chamber 1001X. The main accommodating portion 110X is utilized for packaging the main body of the object. The main main body of the object is put into the main accommodating chamber 1001X through the opening 107X. The first main connecting wall 10218X and the second main connecting wall 10228X can be utilized as the bottom portion of the main accommodating portion 110X to provide cushioning function.

Similarly, the first side subsidiary wall 1048X, the second side subsidiary wall 1058X, the third side subsidiary wall 1068X, and the fourth side subsidiary wall 1038X form the accessory accommodating portion 140X through a series of the 2D heat-sealing seams 30X and the second heat-sealing of the 3D heat-sealing seams 40X, as FIG. 69 illustrated. Namely, the sub-air-storing units 1322X, 133X, 134X, and 135X are surroundingly arranged to form the accessory accommodating portion 140X. The accessory accommodating portion 140X comprises two accessory accommodating portion openings 107X and an accessory chamber 1004X. The accessory accommodating portion 140X is utilized for packaging the accessory of the object. The accessory of the object is put into the accessory chamber 1004X through the accessory accommodating portion opening 107X.

It is worth mentioning that, according to other alternative modes of the present embodiment, the main accommodating portion 110X can form a large diameter air chamber structure, small diameter air chamber structure, or combination of large and small diameter air chamber structures. Similarly, the accessory accommodating portion 140X can form a large diameter air chamber structure, small diameter air chamber structure, or combination of large and small diameter air chamber structures. The present invention shall not be limited thereto. Therefore, the main accommodating portion 110X and the accessory accommodating portion 140X can form an arrangement having multilayer air chamber structure, where the each layer of the air chamber can provide a different level of cushioning function.

It is worth mentioning that the accessory accommodating portion 140U according to the present invention may be optionally combined with and utilized on the air cushion body 10U based on the object and the needs. The air cushion body 10Y, referring to FIG. 70, comprises two the accessory accommodating portions 140Y, wherein the structure of one of the accessory accommodating portions 140Y is the same with the structure of the accessory accommodating portion 140U according to the above preferred embodiment of the present invention, while the structure of the other accessory accommodating portion 140Y is the same with the structure of the accessory accommodating portion 140X according to another embodiment of the present invention.

Figure 70:
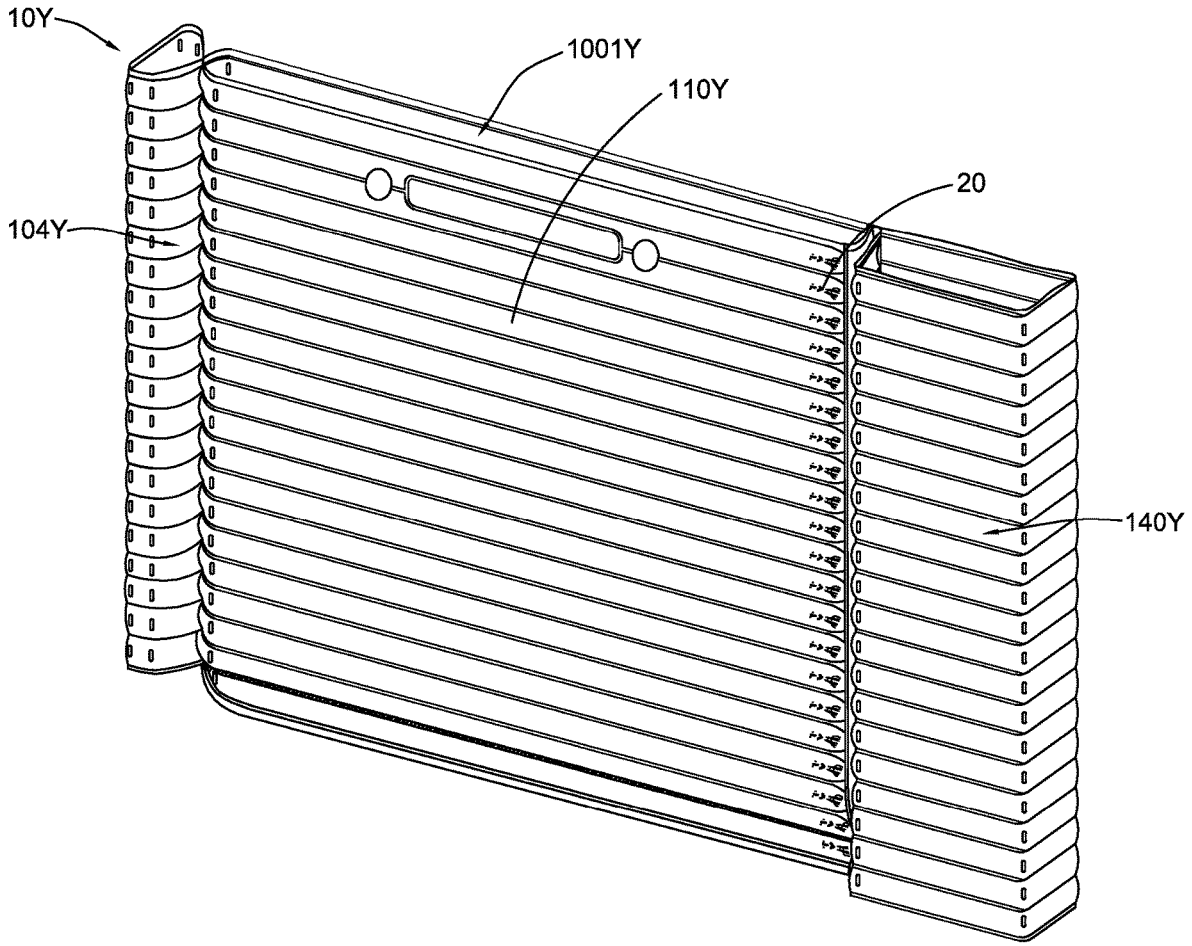
FIG. 70 is a perspective view of the air-filling packaging apparatus according to an alternative mode of a 16th preferred embodiment of the present invention illustrating a combination application of accessory accommodating portions with different structures in packaging the object.

The object is embodied as a laptop M, referring to FIG. 70. That is, the above preferred embodiment of the present invention is equal to provide a packaging assembly, where the air cushion body 10Y comprises a main accommodating portion 110Y and two air-filling packaging apparatuses with the accessory accommodating portions 140Y. The main accommodating portion 110Y has an opening 107Y and a main accommodating chamber 1001Y formed by surroundingly arranging a plurality of air-storing units 13Y. When the air cushion body 10Y is inflated and utilized for bearing the laptop M, the main body of the laptop M can be completely put in the main accommodating chamber 1001Y. The accessories of the laptop M, such as mouse, power adapter, and etc., are respectively put in the two accessory accommodating portions 140Y. Then the air cushion body 10Y will be put into other packing case or packaging box so as for storing and transporting the laptop M.

When the laptop M was impacted or shocked due to external factors, the air-filling packaging apparatus can provide cushion for the laptop M, such that the main body of the laptop M will not directly collide with the accessory, which reduce the risk of damage of the laptop M. The accessory accommodating portion 140Y can also be utilized to provide a second cushioning function for the main body of the laptop M.

FIGS. 71A-71C illustrate perspective views of the inflation valve 20 of the air-filling packaging apparatus according to the present invention. Referring to FIG. 71A, the inflation valve 20 comprises two valve films 21 and 22 that are shorter than the air chamber films 11 and 12 and respectively overlap with the air chamber films 11 and 12 so as to form the air inlet channel 23 for inflating the air storage chamber 14 of each the air-storing unit 13. Referring to FIG. 71B, the inflation valve 20 can further comprise an additional layer of valve film 25 between the two valve films 21 and 22 so as to enhance the sealing property. Referring to FIG. 71C, the inflation valve 20 can further comprise a layer of valve film 26 arranged between the air chamber film 12 and the valve film 22, which is to be arranged on the outer side of the two valve films 21 and 22, so as to prevent the junction between the valve film 22 and the air chamber film 12 from being torn, such that the connection can be strengthened and stabilized. It is understandable that the specific structures of the inflation valve 20 are just examples, rather than limits to the scope of the present invention.

Besides, it should be noted that the features of an embodiment of the present invention may also be utilized in other embodiments. That is, features of the embodiments may be properly combined, so as to allow the air-filling packaging apparatus of the present invention to provide cushioning function in a multistage manner.

One skilled in the art will understand that the embodiment of the present invention as shown in the drawings and described above is exemplary only and not intended to be limiting. Objectives of the present invention are completely and effectively implemented. Notions of the functions and structures of the present invention have been shown and described in the embodiments, whereas implementations of the present invention may have modifications or changes in any ways without going against the above notions.

What is claimed is:

1. An air-filling packaging apparatus for packaging an object, comprising at least an air cushion body formed by at least two layers of air chamber films and at least an inflation valve formed by at least two layers of valve films, wherein said air cushion body comprises a plurality of air-storing units which is circumferentially extended and comprises a plurality of interconnected and communicated sub-air-storing units, wherein a part of said sub-air-storing units forms an packaging body having a cavity with an opening circumferentially enclosed by said sub-air-storing units for packaging the object, while another part of said sub-air-storing units forms at least a flank cushion portion on an outer side of said packaging body adjacent to said opening, such that said flank cushion portion and said packaging body provide a cushioning effect in a multistage manner for the object, wherein said air-storing units form an inner bag portion and an outer bag portion, wherein said outer bag portion comprises said packaging body and said flank cushion portion, wherein said inner bag portion is adapted for being arranged in said outer bag portion and has an accommodating chamber defining said cavity with said opening for accommodating the object, such that said inner bag portion and said outer bag portion provide a cushioning function in a multistage manner, wherein said inner bag portion is uninflatable, while said outer bag portion is inflatable, wherein said air cushion body has a main channel, wherein said inflation valve is adapted for inflating said air-storing units and self-sealing after the inflation so as to prevent air leakage, wherein said inflation valve has a plurality of air inlet channels providing an air inlet to each of said air-storing units, wherein one of said air-storing units for forming said inner bag portion is an uninflatable air-storing unit by heat-sealedly closing said air inlet channel through at least a row of choke seam formed on said uninflatable air-storing unit for forming said inner bag portion, while the rest of said air-storing units form said outer bag portion.

2. The air-filling packaging apparatus, as recited in claim 1, wherein said inner bag portion is formed by one or more layers of films of said air chamber films and said valve films.

3. The air-filling packaging apparatus, as recited in claim 1, further comprising at least two stopping seams respectively arranged on and connecting two sides of said inner bag portion so as for limiting the object between said stopping seams and keeping the object be spaced apart from said outer bag portion.

4. The air-filling packaging apparatus, as recited in claim 3, wherein each of said stopping seams is longitudinally extended.

5. The air-filling packaging apparatus, as recited in claim 3, wherein each of said stopping seams is inclinedly extended with respect to an extending direction of said air-storing units.

6. An air-filling packaging apparatus for packaging an object, comprising at least an air cushion body formed by at least two layers of air chamber films and a plurality of air resisting seams arranged on said air cushion body, wherein said air cushion body comprises a plurality of air-storing units which is circumferentially extended and comprises a plurality of interconnected and communicated sub-air-storing units, wherein a part of said sub-air-storing units forms an packaging body having a cavity with an opening circumferentially enclosed by said sub-air-storing units for packaging the object, while another part of said sub-air-storing units forms at least a flank cushion portion on an outer side of said packaging body adjacent to said opening, such that said flank cushion portion and said packaging body provide a cushioning effect in a multistage manner for the object, wherein said air-storing units form an inner bag portion and an outer bag portion, wherein said outer bag portion comprises said packaging body and said flank cushion portion, wherein said inner bag portion is adapted for being arranged in said outer bag portion and has an accommodating chamber defining said cavity with said opening for accommodating the object, such that said inner bag portion and said outer bag portion provide a cushioning function in a multistage manner, wherein said air-storing units provided with said air resisting seams have smaller air storage to form said inner bag portion.

7. An air-filling packaging apparatus for packaging an object, comprising at least an air cushion body formed by at least two layers of air chamber films and at least two stopping seams, wherein said air cushion body comprises a plurality of air-storing units which is circumferentially extended and comprises a plurality of interconnected and communicated sub-air-storing units, wherein a part of said sub-air-storing units forms an packaging body having a cavity with an opening circumferentially enclosed by said sub-air-storing units for packaging the object, while another part of said sub-air-storing units forms at least a flank cushion portion on an outer side of said packaging body adjacent to said opening, such that said flank cushion portion and said packaging body provide a cushioning effect in a multistage manner for the object, wherein said air-storing units form an inner bag portion and an outer bag portion, wherein said outer bag portion comprises said packaging body and said flank cushion portion, wherein said inner bag portion is adapted for being arranged in said outer bag portion and has an accommodating chamber defining said cavity with said opening for accommodating the object, such that said inner bag portion and said outer bag portion provide a cushioning function in a multistage manner, wherein said air-storing units form an inner bag portion and an outer bag portion, wherein said outer bag portion comprises said packaging body and said flank cushion portion, wherein said inner bag portion is adapted for being arranged in said outer bag portion and has an accommodating chamber defining said cavity with said opening for accommodating the object, such that said inner bag portion and said outer bag portion provide a cushioning function in a multistage manner, wherein said at least two stopping seams respectively arranged on and connecting two sides of said inner bag portion so as for limiting the object between said stopping seams and keeping the object be spaced apart from said outer bag portion.

8. An air-filling packaging apparatus for packaging an object, comprising at least an air cushion body formed by at least two layers of air chamber films, wherein said air cushion body comprises a plurality of air-storing units which is circumferentially extended and comprises a plurality of interconnected and communicated sub-air-storing units, wherein a part of said sub-air-storing units forms an packaging body having a cavity with an opening circumferentially enclosed by said sub-air-storing units for packaging the object, while another part of said sub-air-storing units forms at least a flank cushion portion on an outer side of said packaging body adjacent to said opening, such that said flank cushion portion and said packaging body provide a cushioning effect in a multistage manner for the object, wherein said air-storing units form an inner bag portion and an outer bag portion, wherein said outer bag portion comprises said packaging body and said flank cushion portion, wherein said inner bag portion is adapted for being arranged in said outer bag portion and has an accommodating chamber defining said cavity with said opening for accommodating the object, such that said inner bag portion and said outer bag portion provide a cushioning function in a multistage manner, wherein ends of said air cushion body are heat-sealedly connected through at least a longitudinal heat-sealing seam, and a bottom side of said air cushion body is heat-sealed through at least a transverse heat-sealing seam so as to connect a front side and a back side thereof, wherein said transverse heat-sealing seam at the bottom side is arranged between two adjacent said air-storing units at the bottom side so as to make one or more said air-storing units on an outer side of a lateral heating-sealing seam into one or more reinforcing cushion units.

* * * * *